US009619968B2

(12) United States Patent
Gagner et al.

(10) Patent No.: US 9,619,968 B2
(45) Date of Patent: Apr. 11, 2017

(54) METHODS OF RECEIVING ELECTRONIC WAGERS IN A WAGERING GAME VIA A HANDHELD ELECTRONIC WAGER INPUT DEVICE

(71) Applicant: Bally Gaming, Inc., Las Vegas, NV (US)

(72) Inventors: Mark B. Gagner, West Chicago, IL (US); Timothy T. Gronkowski, Chicago, IL (US); Paul M. Lesley, Blue Island, IL (US); Timothy C. Loose, Chicago, IL (US); Jim Motyl, Chicago, IL (US); James M. Rasmussen, Chicago, IL (US); Victor T. Shi, Morton Grove, IL (US); Alfred Thomas, Las Vegas, NV (US); Jesse Smith, Chicago, IL (US)

(73) Assignee: Balley Gaming, Inc., Las Vegas, NV (US)

( * ) Notice: Subject to any disclaimer, the term of this patent is extended or adjusted under 35 U.S.C. 154(b) by 0 days.

(21) Appl. No.: 15/150,565

(22) Filed: May 10, 2016

(65) Prior Publication Data

US 2016/0253870 A1 Sep. 1, 2016

Related U.S. Application Data

(63) Continuation of application No. 14/872,824, filed on Oct. 1, 2015, now Pat. No. 9,361,755, which is a (Continued)

(51) Int. Cl.
*G07F 17/32* (2006.01)
*G07F 17/34* (2006.01)

(52) U.S. Cl.
CPC ..... *G07F 17/3244* (2013.01); *G07F 17/32* (2013.01); *G07F 17/3202* (2013.01);

(Continued)

(58) Field of Classification Search
CPC .. G07F 17/32; G07F 17/3202; G07F 17/3206; G07F 17/3209; G07F 17/3218;

(Continued)

(56) References Cited

U.S. PATENT DOCUMENTS 5,651,548 A 7/1997 French
5,941,769 A 8/1999 Order (Continued)

FOREIGN PATENT DOCUMENTS

WO WO 2008/045464 4/2008

OTHER PUBLICATIONS

International Search Report mailed Nov. 6, 2009 which issued in corresponding International Patent Application No. PCT/US2009/050279 (4 pages).

(Continued)

*Primary Examiner* — Corbett B Coburn
(74) *Attorney, Agent, or Firm* — Nixon Peabody LLP

(57) ABSTRACT

A gaming system for conducting a multi-player wagering game includes a multi-touch table surface that is touched by a handheld electronic wager input device (EWID) carried by a player for placing wagers on a wagering game displayed on the multi-touch table surface. Each EWID carried by a player has an associated unique identification code, which is linked to the respective player's account. Players indicate an amount to be wagered by touching the EWID to designated wager amount areas, then place the wager by touching the EWID to a designated wagering area. Because each EWID is uniquely associable with distinct player accounts, the gaming system can support any number of players placing wagers. The funds remain safe in the player account and no funds are stored on the EWID. Only the identification code is detected, which is compared with the associated player account before allowing that player to place wagers.

20 Claims, 48 Drawing Sheets

Related U.S. Application Data continuation of application No. 14/596,424, filed on Jan. 14, 2015, now abandoned, which is a continuation of application No. 13/599,016, filed on Aug. 30, 2012, now Pat. No. 8,956,224, which is a continuation of application No. 13/000,933, filed as application No. PCT/US2009/050279 on Jul. 10, 2009, now Pat. No. 8,333,655.

(60) Provisional application No. 61/107,783, filed on Oct. 23, 2008, provisional application No. 61/134,629, filed on Jul. 11, 2008.

(52) U.S. Cl.
CPC ..... *G07F 17/3206* (2013.01); *G07F 17/3209* (2013.01); *G07F 17/3218* (2013.01); *G07F 17/3258* (2013.01); *G07F 17/3272* (2013.01); *G07F 17/34* (2013.01)

(58) Field of Classification Search
CPC ..... G07F 17/3244; G07F 17/3258; G07F 17/3272
See application file for complete search history.

(56) References Cited

U.S. PATENT DOCUMENTS

| | | | | |
|---|---|---|---|---|
| 6,508,709 | B1 | 1/2003 | Karmarkar | |
| 6,702,672 | B1 | 3/2004 | Angell | |
| 7,329,186 | B2 | 2/2008 | Griswold | |
| 9,129,473 | B2 | 9/2015 | Nguyen | |
| 2002/0040518 | A1 | 4/2002 | Butts | |
| 2002/0198052 | A1 | 12/2002 | Soltys | |
| 2003/0027632 | A1 | 2/2003 | Sines | |
| 2004/0014523 | A1 | 1/2004 | Kastner | |
| 2004/0229677 | A1 | 11/2004 | Gray | |
| 2005/0052695 | A1 | 3/2005 | Fukunaga | |
| 2005/0197191 | A1 | 9/2005 | McKinley | |
| 2006/0178182 | A1 | 8/2006 | Sines | |
| 2006/0202422 | A1 | 9/2006 | Bahar | |
| 2007/0010310 | A1* | 1/2007 | Goossens | A63F 1/00 463/17 |
| 2007/0035399 | A1 | 2/2007 | Hecht | |
| 2007/0046985 | A1 | 3/2007 | Komada | |
| 2007/0077987 | A1 | 4/2007 | Gururajan | |
| 2007/0095900 | A1 | 5/2007 | Kingsley-Hefty | |
| 2007/0123330 | A1 | 5/2007 | Hishinuma | |
| 2007/0215685 | A1 | 9/2007 | Self | |
| 2007/0259716 | A1 | 11/2007 | Mattice | |
| 2008/0092154 | A1 | 4/2008 | Hogyoku | |
| 2008/0113772 | A1 | 5/2008 | Burrill | |
| 2008/0182644 | A1 | 7/2008 | Lutnick | |
| 2009/0124379 | A1 | 5/2009 | Wells | |
| 2009/0131151 | A1 | 5/2009 | Harris | |
| 2009/0143141 | A1 | 6/2009 | Wells | |
| 2009/0186676 | A1 | 7/2009 | Amaitis | |
| 2009/0191933 | A1 | 7/2009 | French | |
| 2009/0197676 | A1 | 8/2009 | Baerlocher | |
| 2009/0253503 | A1 | 10/2009 | Krise | |
| 2009/0288159 | A1 | 11/2009 | Husemann | |
| 2009/0319181 | A1 | 12/2009 | Khosravy | |
| 2010/0087241 | A1 | 4/2010 | Nguyen | |
| 2010/0093429 | A1 | 4/2010 | Mattice | |
| 2010/0130280 | A1 | 5/2010 | Arezina | |
| 2011/0089634 | A1 | 4/2011 | Thorson | |
| 2011/0105217 | A1* | 5/2011 | Haveson | G07F 17/32 463/20 |
| 2012/0054806 | A1 | 3/2012 | Reznic | |
| 2013/0237304 | A1 | 9/2013 | Oakes | |
| 2014/0106875 | A1 | 4/2014 | Nguyen | |
| 2015/0072774 | A1* | 3/2015 | Anderson | G07F 17/3209 463/25 |
| 2016/0027253 | A1 | 1/2016 | Gagner | |

OTHER PUBLICATIONS

Written Opinion mailed Nov. 6, 2009 which issued in corresponding International Patent Application No. PCT/US2009/050279 (16 pages).

* cited by examiner

METHODS OF RECEIVING ELECTRONIC WAGERS IN A WAGERING GAME VIA A HANDHELD ELECTRONIC WAGER INPUT DEVICE

CROSS REFERENCE TO RELATED APPLICATIONS

This application is a continuation of U.S. application Ser. No. 14/872,824, filed Oct. 1, 2015, now allowed, which is a continuation of U.S. application Ser. No. 14/596,424, filed Jan. 14, 2015, abandoned, which is a continuation of U.S. application Ser. No. 13/599,016, filed Aug. 30, 2012, now U.S. Pat. No. 8,956,224, which is a continuation of U.S. application Ser. No. 13/000,933, filed Dec. 22, 2010, now U.S. Pat. No. 8,333,655, which is a U.S. National Stage of International Application No. PCT/US2009/050279, filed Jul. 10, 2009, which claims the benefit of U.S. Provisional Application No. 61/134,629, filed Jul. 11, 2008 and U.S. Provisional Application No. 61/107,783, filed Oct. 23, 2008, all of which are incorporated herein by reference in their entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming systems, and methods for playing wagering games, and more particularly, to methods and systems for placing electronic wagers on gaming systems and detecting player or object identification information via a handheld electronic wager input device.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

Multi-touch table wagering games can support multiple players, but to distinguish among the players at the table, the player is required to touch or be seated at a designated player station to complete a circuit that is passed through the player's body. The players interact with virtual objects displayed on the table surface by touching the table surface with their fingers or hands. Players desiring the "feel" of physical chips to place wagers are left wanting. Mischief by unscrupulous players can occur when passing signals through the player's body to identify that player. What is needed are methods and systems that facilitate placement of electronic wagers via a handheld electronic wager input device. What is also needed are methods and systems that encode player or object identification information or wager information in a 2D code that can be imaged by a gaming system. This disclosure is directed to addressing these and other needs.

SUMMARY OF THE INVENTION

Some players like the feel of physical chips when placing wagers, and poker players often like to riffle the chips prior to wagering them. The gaming systems disclosed herein support multiple players, each carrying their own electronic wager input device (EWID) for placing wagers on a table-like display surface that displays a wagering game. Each EWID has an identification code associated with it that is unique and distinct from the respective identification codes associated with all other EWIDs in the gaming establishment. In this way, countless EWIDs can be distributed and used throughout a gaming environment, such as a casino.

The players need only carry the EWID with them as they go from table to table and use the EWID to place wagers. There is no need to pass any signals through the player to distinguish among multiple players at a wagering game, nor are players required to stand on any pads or sit in any designated chairs to distinguish them from other players. Possession of an EWID is what is required here to place wagers. The gaming system can differentiate among all the players by reading or detecting the unique identification code associated with each EWID, and those ID codes can be linked or associated with a player account. Players can "register" themselves at the table by placing the EWID on the table and entering secondary authorization information such as a PIN number or the like.

The EWID can mimic the look and feel of a physical stack of chips. Players feel like they are actually picking up and placing chips down on the table to place wagers. Moreover, players need to use only one hand to place wagers, just as they would with physical chips. However, no physical chips are needed in the gaming establishment, which greatly simplifies accounting and eliminates the need to store or handle physical chips. The EWIDs can be cheaply made, so that even if a certain number are lost or misplaced on a regular basis, they can be replaced quickly and inexpensively.

When placing wagers with the EWID, players can customize the face of the virtual chips displayed on the table where the EWID "places" them. When players place wagers, the gaming system reads or detects the identification code associated with the EWID along with the location of that the EWID touched on the table surface, and correlates those two pieces of information to determine which player placed a wager and where. When multiple players are interacting with and placing wagers on the wagering game, each time a touch of an EWID is detected, the gaming system detects its associated identification code, which is linked to a player account, to determine which player is interacting with the table. The touched location by the EWID is used by the gaming system to determine what wagering-game function needs to be carried out in response thereto.

No monetary value is stored on the EWID itself. Thus, if it is lost or stolen, the player will not lose any funds. The player's funds are securely stored on a remote server, and when the player places a wager with the EWID, the gaming system determines which player account is associated with the identification code for that EWID, and transfers the wager amount out of the player account to a casino account or to an escrow account, where it is held until the game outcome has been revealed or until the player ends a gaming session and leaves the table. A virtual chip tray can also be set up by the player that includes a portion of available funds to set a comfortable level of exposure for the player. If the player inadvertently leaves the EWID at the table and walks away while forgetting to take the EWID with the player, even if another player were to place wagers with that EWID, the player's exposure is limited to the amount in the virtual chip tray. To reduce this possibility, security scenarios can be put in place that balance security with inconvenience. For example, it would be very secure to require the player to enter a PIN number each time he uses the EWID, but that would not be very convenient. On the other hand, requiring authentication or verification every periodic interval can balance security against inconvenience. In any event, the player's exposure would be limited to that table only, because if another player were to try to use the EWID at another table, the player would be required to register the EWID with the new table.

According to an aspect of the present disclosure, a method of receiving a wager to play a wagering game includes displaying the wagering game on a display; detecting an identification code associated with a handheld electronic wager input device held by a first player of the wagering game and placed in proximity to a surface of a gaming terminal (which can correspond to a surface of the display); responsive to the detecting, determining a first wager amount associated with the first player; storing a value representing the first wager amount associated with the first player; randomly selecting an outcome of the wagering game from among a plurality of possible outcomes; and responsive to the randomly selecting, awarding an award to the first player commensurate with the first wager amount.

The aforementioned method may further include any or all of the following additional or alternative aspects. The first wager amount associated with the first player can be determined by determining a player account of the first player based on the identification code. The gaming terminal can include a multipoint sensing device. The method can further include sensing a touch on the multipoint sensing device by a second electronic wager input device held by a second player of the wagering game; responsive to the sensing, determining a second wager amount associated with the second player; storing a second value representing the second wager amount associated with the second player; and responsive to the randomly selected outcome being a winning outcome, awarding an award to the second player commensurate with the second wager amount.

The first wager amount can be determined by sensing a touch on the multipoint sensing device by the electronic wager input device; and responsive to the sensing, determining whether the electronic wager input device is positioned within one of a plurality of predetermined wager amount areas on the surface of the multipoint sensing device. The method can further include sensing a touch on the multipoint sensing device by a second electronic wager input device held by a first player of the wagering game, the second electronic wager input device having a second identification code associated therewith; and responsive to the sensing the touch by the second electronic wager input device, determining a second wager amount associated with the first player. Alternately, the method can further include sensing a touch on the multipoint sensing device by the electronic wager input device held by a second player of the wagering game; and responsive to the sensing, determining that a second wager amount is associated with the second player based on the identification code associated with the electronic wager input device.

The first wager amount can be determined by determining whether the electronic wager input device is positioned within a predetermined wagering area on the surface. The method can further include accessing a player account, associated with the first player, based on the identification code, the player account storing an account balance and being remote from the gaming terminal; and decrementing the account balance by the value representing the first wager amount.

The method can further include receiving an indication of a switch actuation on the electronic wager input device, wherein the storing the value representing the first wager amount is carried out responsive to the receiving the indication of the switch actuation. The method can further include displaying, on a video display of the electronic wager input device, the value representing the first wager amount. The method can further include displaying, on a video display of the electronic wager input device, indicia requesting that the first player confirm the first wager amount by actuating a switch on the electronic wager input device. The method can further include playing an audio sound via the electronic wager input device responsive to the first player actuating the switch.

The first wager amount can be determined responsive to the first player placing the electronic wager input device in proximity to at least one designated wagering area defined relative to the surface of the gaming terminal. The method can further include removing the first wager amount by detecting a dragging movement of the electronic wager input device across the surface of the gaming terminal away from the at least one designated wagering area.

The surface of the gaming terminal can define other areas designated for purposes other than wagering. The method can further include displaying a graphic associated with the first player on a video display of the electronic wager input device. The identification code can be detected by detecting through the surface a pattern disposed on the electronic wager input device.

The method can further include communicating the identification code to a player account server; and identifying an identity of the first player based on the identification code. The method can further include storing the identification code in the electronic wager input device. The method can further include wirelessly communicating data indicative of the first wager amount from the electronic wager input device to a controller. The method can further include determining how long the electronic wager input device remains in a fixed location relative to the surface, and, responsive thereto, increasing the first wager amount until an indication is received to cease increasing the first wager amount. The indication can include moving the electronic wager input device away from the fixed location.

The identification code can include sensing a contact by the electronic wager input device on a touch-sensitive substrate proximate the surface; sensing through the surface a pattern disposed on the electronic wager input device; and determining the identification code from data indicative of the pattern.

The wagering game can be a multi-player game in which multiple players, including the first player, can place wagers on the wagering game. The wagering game can be a roulette game.

According to another aspect of the present disclosure, a method of receiving a wager to play a wagering game includes: displaying the wagering game on a display; wirelessly detecting an identification code associated with a handheld electronic wager input device held by a first player of the wagering game and positioned in proximity to a surface of a gaming terminal; determining whether the handheld electronic wager input device is positioned within a predetermined wagering area on the surface, and, if so, determining a first wager amount; associating the identification code with a player account of the first player, the player account storing an account balance and being remote from the electronic wager input device; randomly selecting an outcome of the wagering game from among a plurality of possible outcomes; and responsive to the randomly selecting, awarding an award to the first player commensurate with the first wager amount.

The aforementioned method can additionally or alternatively include any or all of the following. The method can further include, prior to associating the identification code with the player account, verifying an identity of the first player at the gaming terminal. The verifying can include receiving secondary authorization information from the first player. The verifying can further include displaying on a video display of the electronic wager input device an image associated with the first player. The verifying can include detecting a biometric attribute of the first player via a biometric sensor in the electronic wager input device. The verifying can include passively detecting by the electronic wager input device an item worn or carried by the player. The verifying can further include: receiving a gaming card detected by the gaming terminal, the gaming card being associated with a player account; determining whether the identification code has been associated with an identity of the first player, and, if so, comparing the identity of the first player with an identity associated with the player account associated with the gaming card; responsive to the identity of the first player matching the identity associated with the player account, authorizing the first player to place wagers at the gaming terminal.

The identification code can be stored in the electronic wager input device. The method can further include decreasing the account balance by an amount corresponding to the first wager amount. The method can further include accumulating the first wager amount in an escrow account associated with the first player. The method can further include receiving an indication of the first wager amount by detecting that the handheld electronic wager input device is positioned within one of a plurality of a predetermined wager amount areas on the surface, each of the plurality of predetermined wager amount areas representing a different wager amount. The method can further include displaying, via the surface, an indication to the first player that the first wager amount has been placed. The method can further include displaying, on the electronic wager input device, an indication that the first wager amount has been placed. The method can further include displaying, on the electronic wager input device, the first wager amount.

The awarding can include increasing the account balance by an amount commensurate with the award. The method can further include: disassociating the identification code associated with the electronic wager input device from the player account associated with the first player; associating the identification code with a player account associated with a second player, the player account storing an account balance and being remote from the electronic wager input device; determining whether the electronic wager input device is positioned within a predetermined wagering area on the surface, and, if so, determining a second wager amount; and adjusting the account balance of the player account associated with the second player in response to randomly selecting an outcome of the wagering game from among a plurality of possible outcomes. The adjusting can include increasing the account balance of the player account associated with the second player by an amount commensurate with the second wager amount when the randomly selected outcome is a winning outcome.

The player account can be stored on an account server remote from the gaming terminal, which is communicatively linked to the account server over a network. The wirelessly detecting can be carried out without requiring the first player to touch any portion of the gaming terminal.

The method can further include: wirelessly detecting a second identification code associated with a second handheld electronic wager input device held by a second player of the wagering game and positioned in proximity to the surface of the gaming terminal; determining whether the second handheld electronic wager input device is positioned within the predetermined wagering area on the surface, and, if so, determining a second wager amount; associating the second identification code with a second player account of the second player, the second player account storing an account balance and being remote from the electronic wager input device; and responsive to the randomly selecting, adjusting the account balance of the second player account. The gaming terminal can include a multi-touch sensing device arranged relative to the surface for detecting simultaneously a plurality of touch inputs relative to the surface.

The method can further include arranging the surface over the display. The display can be projected onto the surface.

According to yet another aspect of the invention, a computer readable storage medium is encoded with instructions for directing a gaming system to perform any combination of the method or methods described herein.

The EWID can also feature a rotatable dial that the player turns to increase or decrease an amount to be wagered, change the wager denomination, or to confirm an amount to be wagered. A variety of structures for associating a turn of the dial with various wagering functions are disclosed herein. Alternately, the player can tilt the EWID in one of several possible directions to change or confirm a wager, or to change a wager denomination. The EWID can feature lights or other indicia to indicate that the amount to be wagered is increasing or decreasing. A button on the EWID's dial can be pressed to confirm a wager.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
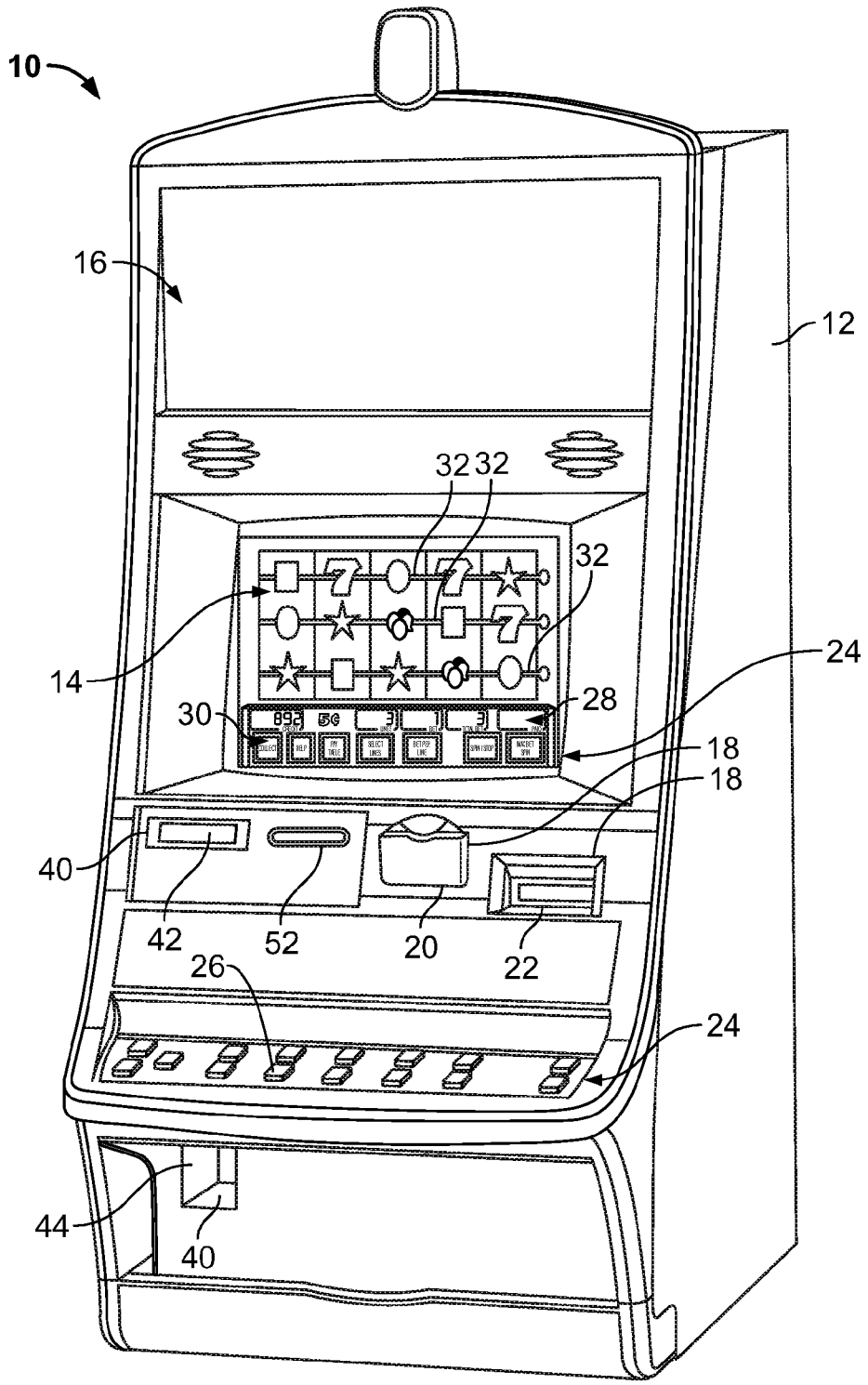
FIG. 1*a* is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
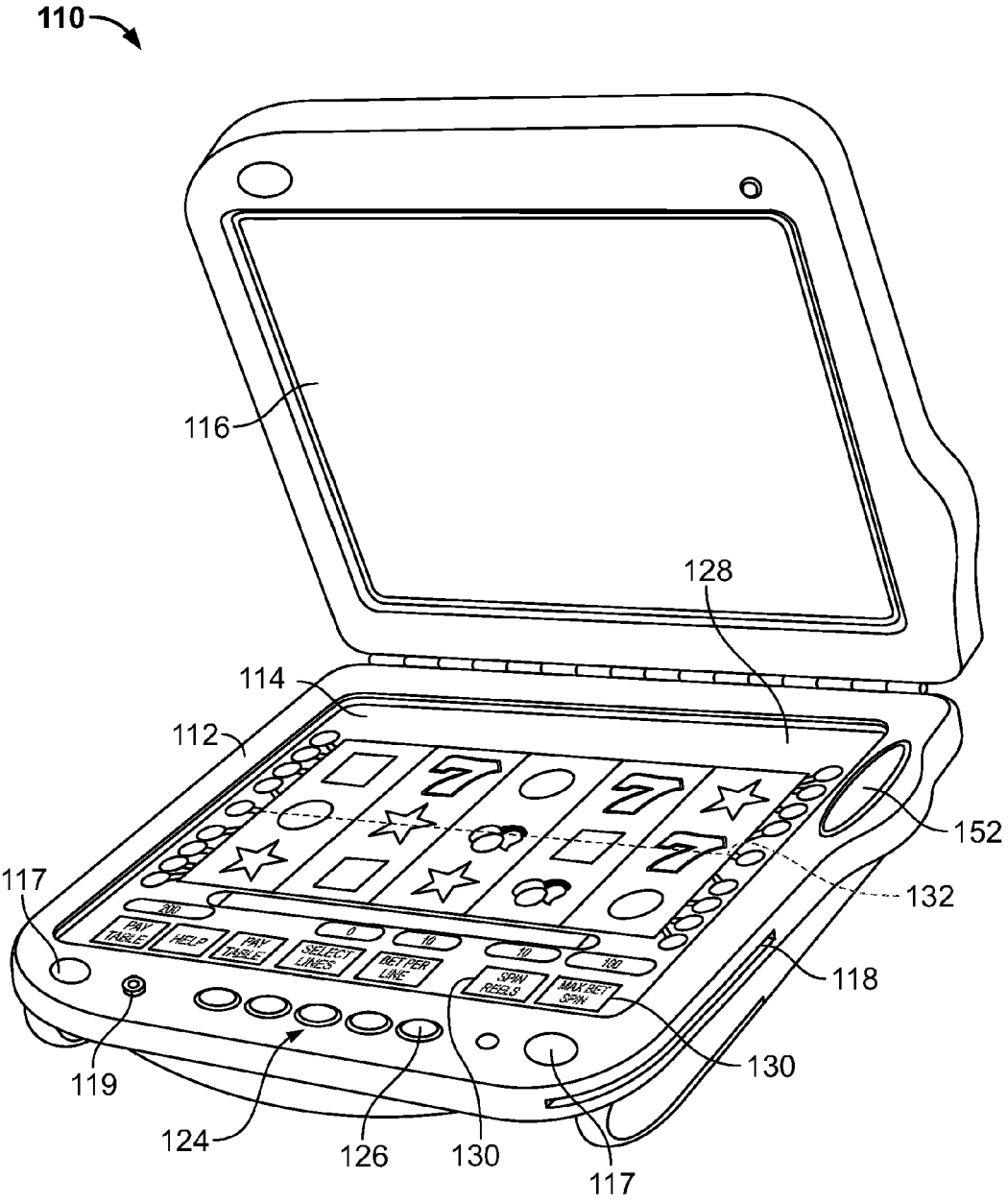
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electronic gaming machine configured to play a video casino game such as, but not limited to, slots, keno, poker, blackjack, and roulette. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen 128 mounted to a primary display 114 and/or secondary display 116. In one aspect, the touch screen 128 is matched to a display screen having one or more selectable touch keys 130 selectable by a user's touching of the associated area of the screen using a finger or a tool, such as a stylus pointer. A player enables a desired function either by touching the touch screen 128 at an appropriate touch key 130 or by pressing an appropriate push button 126 on the button panel. The touch keys 130 may be used to implement the same functions as push buttons 126. Alternatively, the push buttons may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably takes the form of a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 18 or an assignment of credits stored on the handheld gaming machine via the touch screen keys 130, player input device 124, or buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1*b*, comprises a biometric sensing device.

Figure 2:
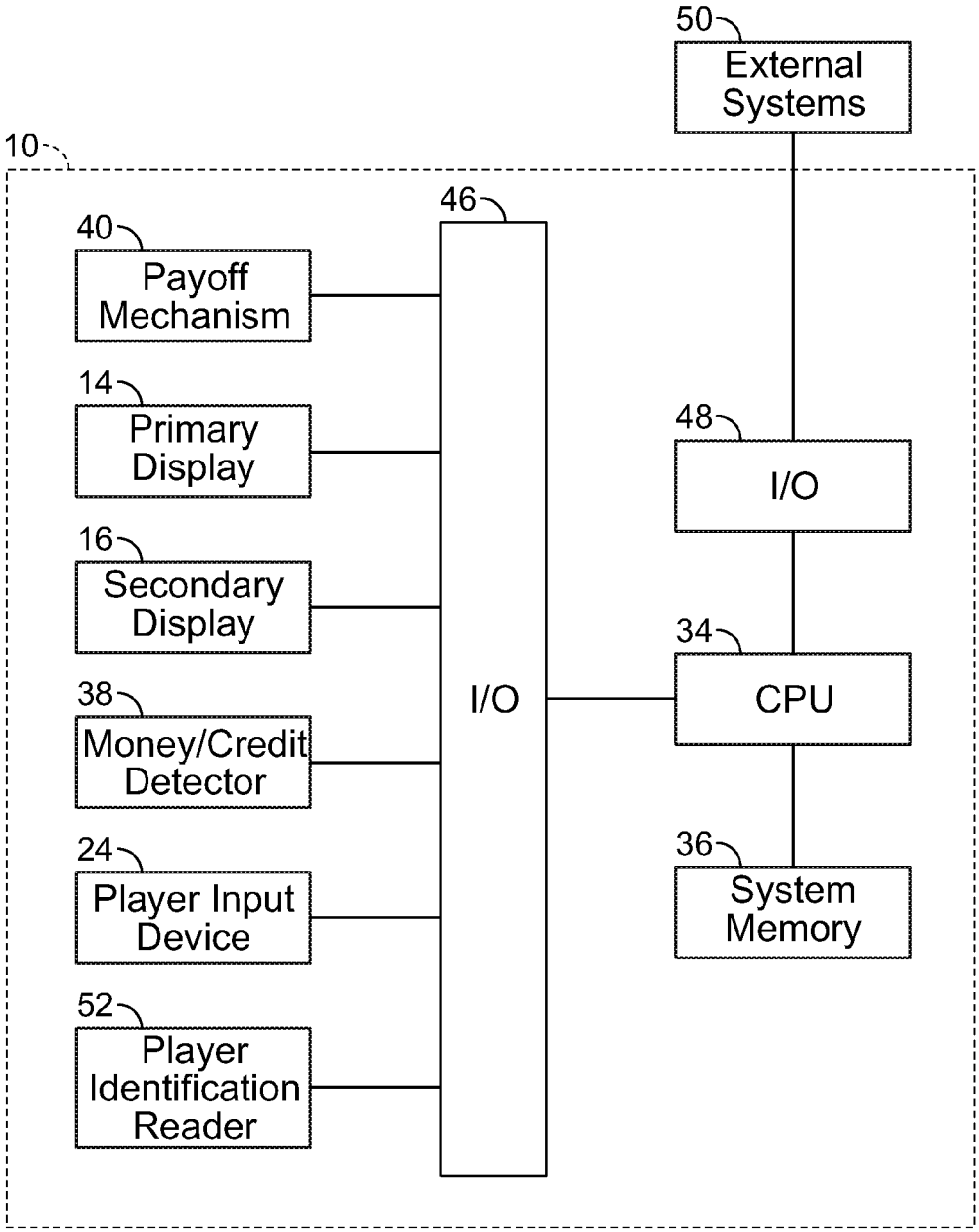
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality therebetween (e.g., a "rich client"). As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "rich client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Security features are advantageously utilized where the gaming machines 10,110 communicate wirelessly with external systems 50, such as through wireless local area network (WLAN) technologies, wireless personal area networks (WPAN) technologies, wireless metropolitan area network (WMAN) technologies, wireless wide area network (WWAN) technologies, or other wireless network technologies implemented in accord with related standards or protocols (e.g., the Institute of Electrical and Electronics Engineers (IEEE) 802.11 family of WLAN standards, IEEE 802.11i, IEEE 802.11r (under development), IEEE 802.11w (under development), IEEE 802.15.1 (Bluetooth), IEEE 802.12.3, etc.). For example, a WLAN in accord with at least some aspects of the present concepts comprises a robust security network (RSN), a wireless security network that allows the creation of robust security network associations (RSNA) using one or more cryptographic techniques, which provides one system to avoid security vulnerabilities associated with IEEE 802.11 (the Wired Equivalent Privacy (WEP) protocol). Constituent components of the RSN may comprise, for example, stations (STA) (e.g., wireless endpoint devices such as laptops, wireless handheld devices, cellular phones, handheld gaming machine 110, etc.), access points (AP) (e.g., a network device or devices that allow(s) an STA to communicate wirelessly and to connect to a(nother) network, such as a communication device associated with I/O circuit(s) 48), and authentication servers (AS) (e.g., an external system 50), which provide authentication services to STAs. Information regarding security features for wireless networks may be found, for example, in the National Institute of Standards and Technology (NIST), Technology Administration U.S. Department of Commerce, Special Publication (SP) 800-97, ESTABLISHING WIRELESS ROBUST SECURITY NETWORKS: A GUIDE TO IEEE 802.11, and SP 800-48, WIRELESS NETWORK SECURITY: 802.11, BLUETOOTH AND HANDHELD DEVICES, both of which are incorporated herein by reference in their entirety.

Figure 3:
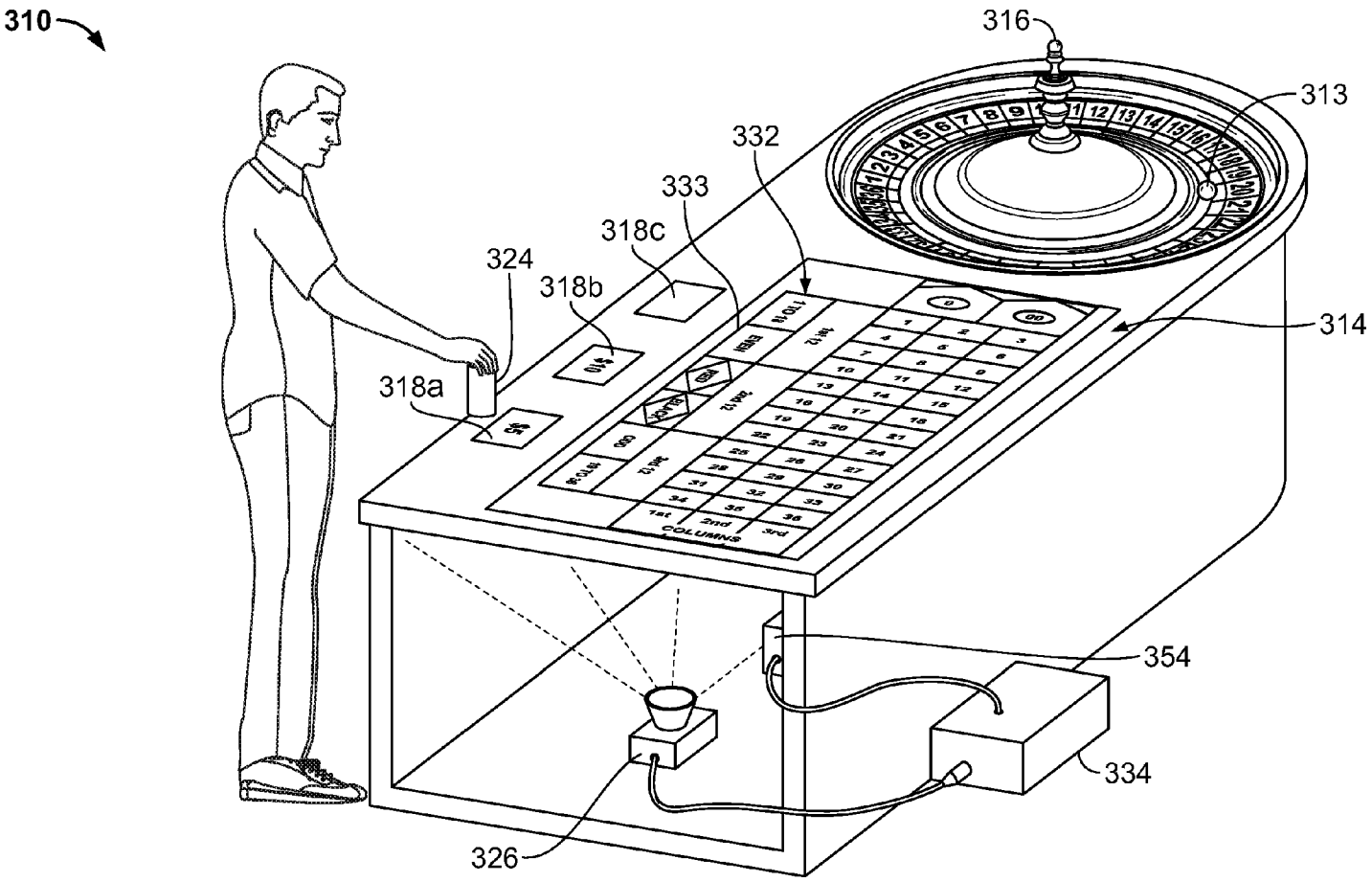
FIG. 3 is a functional diagram of a gaming system that includes a handheld electronic wager input device (EWID)

The foregoing details apply equally to any of the gaming systems disclosed herein. Turning now to FIG. 3, there is shown a gaming system 310 including displays 314, 316 and a handheld electronic wager input device 324 held by a player. It is understood that the gaming system 310 can include the gaming machines 10, 110 described above. The descriptions of the gaming system 310 apply equally to the gaming machines 10, 110. The electronic wager input device 324, or EWID for short, has dimensions sufficient to be held by the player. The term "electronic" in EWID does not necessarily imply that the EWID itself includes electronics. It simply means that the EWID is part of a gaming system that supports "electronic" wagering, wherein the wagers are represented electronically as opposed to being represented by physical chips or tokens, although in some aspects disclosed herein, the EWID does include electronic components. Electronic components of controller-based EWIDs will be described in more detail in connection with FIG. 4 below. Also disclosed herein are examples of EWIDs that lack electronics. The EWID 324 is used by the player to input wagers on the wagering game displayed on the displays 314, 316 in accordance with the aspects disclosed herein, which will be described in further detail below. The gaming system 310 also includes a sensing or imaging device 326 for sensing or detecting at least the EWID 324. The term sensing device and imaging device are used interchangeably herein. The sensing device 326 in the illustration is a camera whose output is received by a control system 334. The sensing device 326 is disposed under a surface of the display 314 to sense or detect objects or body parts interacting with the surface above. The control system 334 includes conventional controller-based electronic components for conducting the wagering game on the gaming system 310. The control system 334 is connected to a wireless transceiver system 354, which can communicate with the EWID 324 in the illustrated example.

The gaming system 310 displays a roulette wagering game having a wagering area displayed by the display 314 and a physical roulette wheel that forms the display 316. The display 314 is a video-type display wherein the images are displayed or projected onto a substrate surface of the display 314. This illustration is intended to convey that gaming systems contemplated herein can comprise displays that include video displays depicting video graphics, displays depicting physical structures, or both. An example of a gaming system that projects video images onto a contoured display surface and also includes a flat video display is disclosed in commonly assigned, U.S. Provisional Patent Application No. 61/002,522, filed Nov. 9, 2007, entitled "Wagering Game With a Table-Game Configuration." The illustration shows the displays 314, 316 arranged horizontally relative to the ground such that the gaming system 310 resembles a table. Examples of suitable technologies for the display 314 are described in commonly assigned, PCT Publication No. WO2008/045464, filed Oct. 10, 2007, entitled "Multi-Player, Multi-Touch Table for Use in Wagering Game Systems." Another technology suitable for the display 314 is the TouchTable® system available from TouchTable, Inc. based in Pasadena, Calif. The touch sensor of the display 314 can be based on frustrated total internal reflection (FTIR), diffused illumination (DI), laser light plan (LLP), or diffused surface illumination (DSI) technologies. It is emphasized that the EWID aspects disclosed herein do not require that the player touch the table to complete a circuit or to stand on a particular pad to be distinguished from among other players at the table. Note that the EWID can, in various implementations disclosed herein, transmit the same signal that the table requires to complete the circuit instead of passing it through the player. This disclosure describes systems and methods that allow differentiation among multiple players without requiring the players to stand or sit in any particular designated station or pad or to touch any part of the table to complete an electrical circuit.

The gaming system 310 includes a plurality of designated areas 318*a*, 318*b*, 318*c* for receiving the EWID 324, which can be placed on the surface of the display 314 or placed in proximity to the surface of the display 314. The surface of the display 314 also includes a plurality of wagering areas 332, and the purposes of these areas 318, 332 will be described in more detail below. A wagering area 333 corresponds to a wager on the probability that the roulette ball 313 will land in an "EVEN" pocket.

The EWID 324 was inspired in part by the "dauber" that is used to play Bingo games in which Bingo players mark their Bingo cards by "daubing" the number when called that appears on their cards. The Bingo dauber typically resembles a marker with a circular end that places a round circle on the marked area of the Bingo card. The physical actions of grasping the Bingo dauber, hunting for the number called, and daubing any found numbers contribute to making the game fun and interactive. When the player discovers a number match on a card, the daubing action produces a sort of psychological reward, motivating the player to continue playing. In the implementations disclosed herein, the EWID 324 is grasped by the player and held in the player's hand to place wagers on a wagering game. To use a very basic example, the player touches the EWID 324 at least once to a wager amount area representing a particular wager amount, such as the area 318*a*, say $5, and then touches the EWID 324 to a selected wagering area 332, such as "Red." These actions resemble the manner in which the player would place chips on a traditional roulette table, where the player would pick up an amount of chips to wager and place those chips somewhere on the betting layout of the roulette table, thereby placing the wager on the roulette wagering game. Of course, the chips in a traditional roulette game are in the physical custody of the player, so the player physically interacts with the chips and sees how many chips are being wagered. Here, most of the same physical gestures made by the player interacting with traditional chips is preserved.

Figure 4:
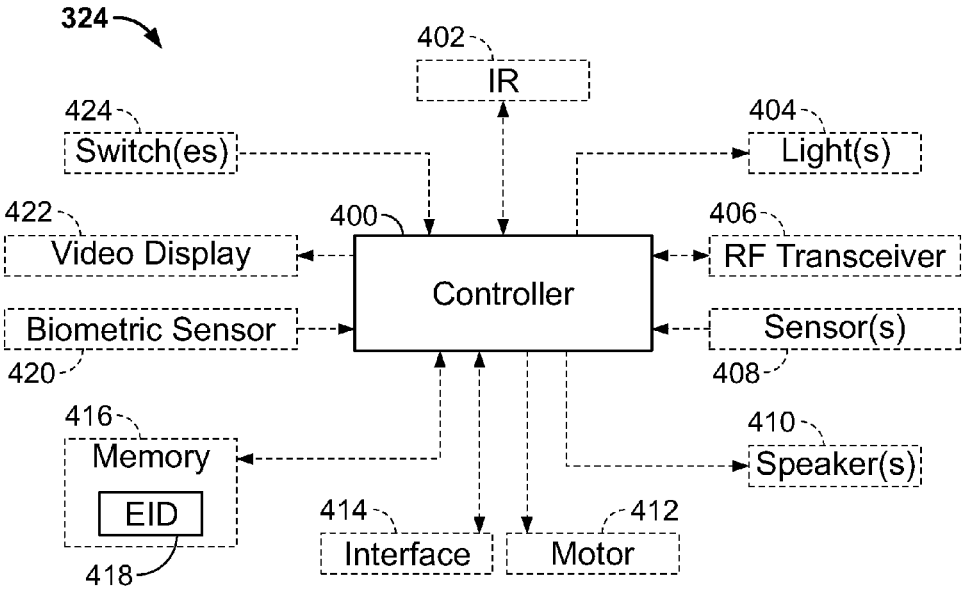
FIG. 4 is a functional block diagram of optional electronic components that are housed within the EWID.
Figure 5A:
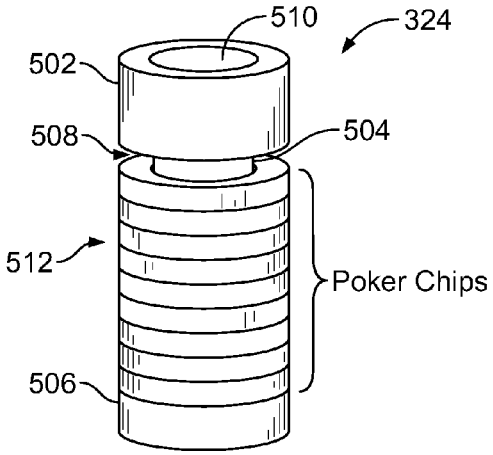
FIG. 5A is a perspective view of an exemplary EWID having a top-mounted button and a plurality of bored chips stacked to resemble a stack of chips.
Figure 5B:
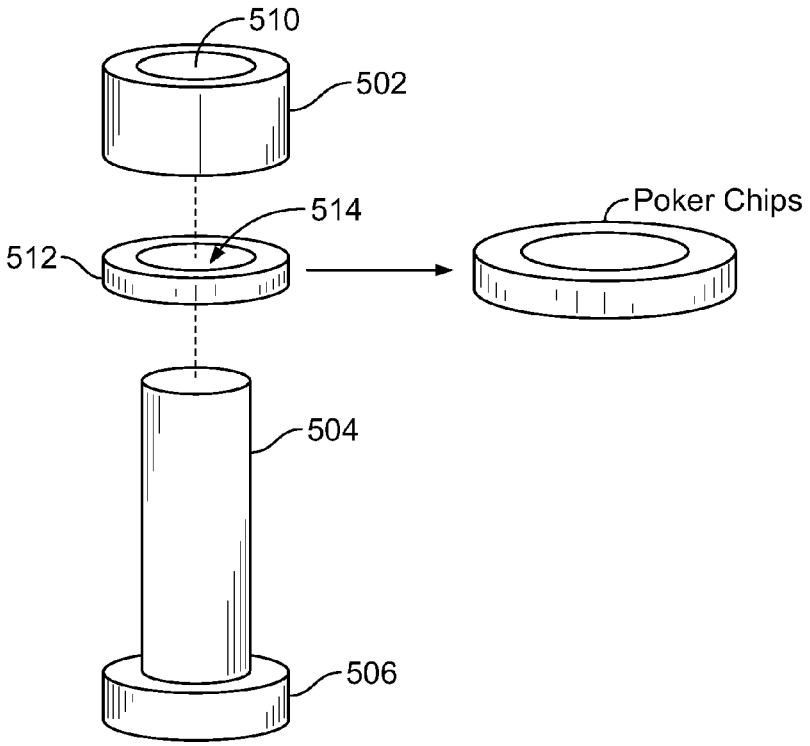
FIG. 5B is a perspective exploded view of the EWID shown in FIG. 5A including one of the bored chips.

As shown in FIGS. 5A and 5B, the EWID 324 is constructed to resemble a stack of poker chips 512. The EWID 324 includes a top 502 and a base 506, which are connected together by an intermediate structure 504 that has a cylindrical shape. The chips 512 have centrally formed openings 514 dimensioned to receive the intermediate structure 504 therethrough. A plurality of such chips 512 are arranged as shown in FIG. 5A such that their respective centrally formed openings 514 receive the intermediate structure 504. An exploded perspective view showing one such chip 512 with the top 502 removed is illustrated in FIG. 5B. One or more of the chips 512 can serve as a switch, such as the top chip 512 shown in FIG. 5B. A player can twist that chip 512 to cause a function to be performed by the EWID 324. Likewise, the top 502 and/or the base 506 can be twistable to actuate a switch for causing a function to be performed by the EWID 324 or the control system 334 (e.g., such as confirming a wager placed with the EWID 324). A gap 508 is maintained between the topmost chip 512 and the top 502 to allow the player to riffle the chips, thereby preserving the tactile and audible sensations associated with traditional chips. Optional electronic components, such those as shown in FIG. 4, are housed within any combination of the top 502, the intermediate structure 504, and/or the base 506. The intermediate structure 504 can additionally or alternately house a battery for powering the optional electronic components.

Figure 5C:
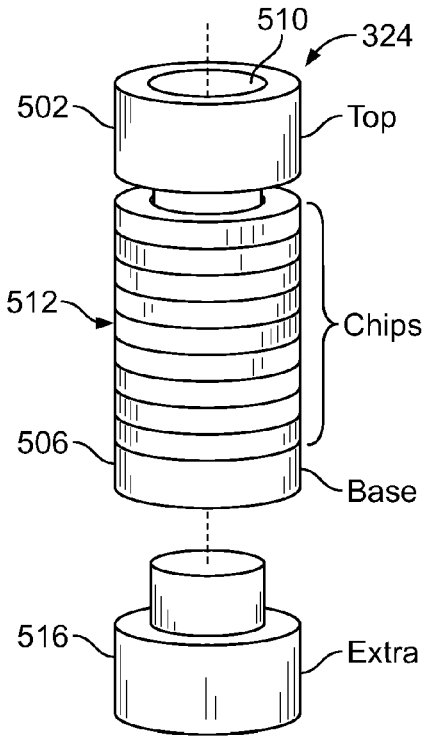
FIG. 5C is a perspective view of the EWID shown in FIG. 5A with an optional base attached for added functionality.
Figure 7A:
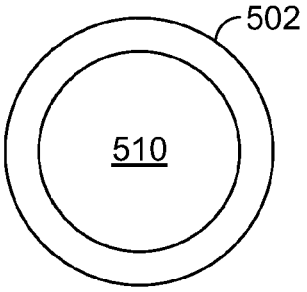
FIG. 7A is an exemplary top view of the EWID shown in FIG. 5A showing the button.
Figure 7B:
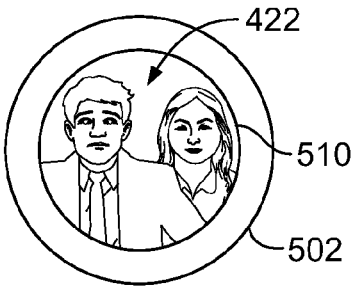
FIG. 7B is an exemplary top view of the EWID shown in FIG. 5A with a video display displaying a custom graphic associated with a player holding the EWID.

The top 502 includes an optional button or switch 510 that can be actuated and a further optional video display 422 (shown in FIG. 7B) for displaying a graphic. In FIG. 5C, the EWID 324 includes an extra base 516 that extends the length of the EWID 324. This extra base 516 includes extra functionality that is not available to EWIDs that lack the extra base 516. The extra base 516 can be given to high rollers or other honored patrons. For example, if the EWID 324 lacks any electronic components the extra base 516 includes electronic components such as those shown in FIG.

4 to add the functionality offered by those electronic components to the EWID 324. Examples of various forms of functionality offered by the extra base 516 are described in more detail below.

Although FIGS. 3, 5A-5C illustrate a specific example of the EWID 324, in other implementations, the EWID 324 takes different forms. For example, the EWID 324 is not necessarily drawn to scale in the figures, and can be dimensioned differently. Poker chips 512 are not used in other implementations. In its most basic form, the EWID 324 has a shape, such as cylindrical, and is made of a material, such as plastic. The EWID 324 has an associated identification code, which will be explained in more detail below in connection with at least FIGS. 6A-6C. Extra functionality can be added to the EWID 324 by attaching an extra base 516 to the bottom of the EWID 324 as shown in FIG. 5C.

Unlike with traditional chips, where the player retains physical custody of his chips and carries them from wagering game to wagering game, the EWID 324 is not necessarily associated with any particular player or any particular player account. Aspects disclosed herein overcome various challenges associated with identifying a player who is holding the EWID 324 and crediting or debiting credits from the proper player account. Players should be able to grab any EWID 324 and place wagers on any EWID-capable wagering game, and the gaming system should be able to access the proper player account so that funds can be deducted when wagers are placed and funds credited when awards are awarded. Players should be able to lose the EWID 324 or lose possession of the EWID 324 without fear that their player accounts will be compromised. Their funds always remain secure in a secure player account database that is remote from the gaming system on which the player is playing a wagering game with an EWID. EWIDs should be customizable and have a "look and feel" that is familiar or pleasing to the player. A gaming system should be able to recognize and distinguish among multiple EWIDs carried by different players and deduct or credit the appropriate amounts from or to the appropriate player accounts.

The EWID 324 can be an "intelligent" device insofar as it includes a controller 400 that is programmed to provide functionality to the device. In FIG. 4, several exemplary and optional electronic and mechanical components are shown. The EWID 324 can include any combination of one or more of the following components: an infrared receiver, transmitter, or transceiver 402, one or more lights 404, a radio-frequency transceiver 406, one or more sensors 408, one or more speakers 410, a motor 412, an interface 414, a memory 416 that stores, among other things, an electronic identification code 418, a biometric sensor 420, a video display 422, and one or more switches 424.

The infrared transceiver 402 and the RF transceiver 406 can be used to communicate data between the EWID 324 and the control system 334 of the gaming system 310. Preferably, the RF transceiver 406 communicates data according to the Bluetooth (IEEE 802.15.1) protocol, though any other conventional wireless communications protocol is contemplated. The control system 334 can detect the presence of an EWID 324 proximate the gaming system 310, and read its associated electronic identification code. The gaming system 310 can determine from the various detected EID codes which players are hovering near the gaming system 310, how long they linger, and whether they actually place a wager at the gaming system 310. In this manner, surreptitious tracking of the player's movements about the gaming establishment can be carried out without distracting the player.

Alternately, the RF transceiver 406 can employ an RFID tag or transponder, with the identification code encoded in the RFID tag. The wireless transceiver system 354 detects the RFID tag when the EWID 324 is brought within range, and reads the associated identification code. RFID systems for detecting RFID tags are also described in commonly assigned U.S. Provisional Patent Application No. 61/002,475, entitled "Interaction With 3D Space in a Gaming System," filed Nov. 9, 2007, the entirety of which is incorporated herein by reference.

One or more lights 404, such as light-emitting diodes (LEDs), can be used for verifying a player input on the EWID 324, providing a visual confirmation of a selection made by the player with the EWID 324, or for enhancing a visual aspect of the EWID 324. An LED 404 can be used to identify a distinct player from among a plurality of players at the gaming system 310. For example, the gaming system 310 can detect the presence of the EWID 324 by, for example, reading an RFID tag that encodes the EWID's identification code. When the gaming system 310 detects the identification code, it displays a prompt to the player to actuate a switch on the EWID 324 to activate the LED 404. The gaming system 310 needs both pieces of information, i.e., a detected identification code together with detection of the LED 404, to "identify" a player and associate that player with the EWID 324. By "identify" in this context, it is not necessarily intended to convey that the gaming system 310 knows (although it can) the actual identity (e.g., identification information in a player account) of the player. However, the gaming system 310 can, at a minimum, distinguish among various players playing a wagering game on the gaming system 310 by requiring some physical action by each player via their respective EWIDs as confirmation that each player has possession of an EWID. Thus, in this example, two pieces of information are needed to identify a player at the gaming system 310 or to confirm a player action at the gaming system 310, such as placement of a wager: passive or active detection of a unique identification code associated with the EWID and some physical action by the player (actuating a switch) that causes some response by the EWID (e.g., lighting an LED) that is detected simultaneously by the control system 334. This disclosure also contemplates multiple EWIDs being assigned or associated with the same player.

The one or more sensors 408 can be used for detecting a player input on the EWID 324 or for verifying that the EWID 324 has been placed proximate a designated area on the surface of the display 314. The one or more speakers 410 provide audible feedback to confirm a selection or an input by the player with the EWID 324 or to playback audio sounds as the player interacts with the EWID 324. For example, the one or more speakers 410 can announce the value of the wager amount placed by the player with the EWID 324 or can provide customized sounds such as the player's name when the player's identity is ascertained by the EWID 324. The speaker 410 can also provide audio cues in response to detection of a wager being placed or removed, for example, or in response to the EWID 324 being brought toward or away from the surface of the gaming system 310.

The motor 412 provides haptic feedback to the player when holding or grasping the EWID 324. The interface 414 interfaces the EWID 324 with an external system, such as the player's laptop or mobile phone or other storage device containing data to be transferred to the EWID 324, and can provide a faster and more robust communication interface than the wireless interfaces 402, 406. For example, the interface 414 is a USB interface that is used to connect the EWID 324 to another USB-enabled device (such as the player's laptop or personal digital assistant) for transferring data (e.g., the graphic displayed by the video display 422) between the EWID 324 and the USB-enabled device. If a wager placed by the player with the EWID 324 results in a winning outcome of the wagering game, the motor 412 can cause the EWID 324 to vibrate while audio cues are played through the speaker 410. The player can optionally walk away from the gaming system 310 after placing a wager there, and the gaming establishment can track the EWID 324 and wirelessly communicate a signal to the RF transceiver 406 of the EWID 324 in response to the player's receiving a winning outcome in the wagering game. The vibration and audio cue, such as "You have won!," will motivate the player to return to the gaming system 310 to collect the award commensurate with the amount wagered.

Figure 6A:
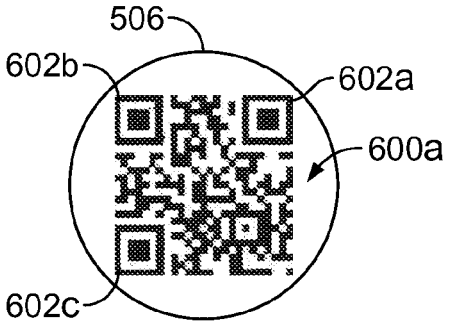
FIGS. 6A-6B are exemplary bottom views of a barcode pattern and a pattern of dots encoding a unique identification code associated with the EWID shown in FIG. 5A.
Figure 6B:
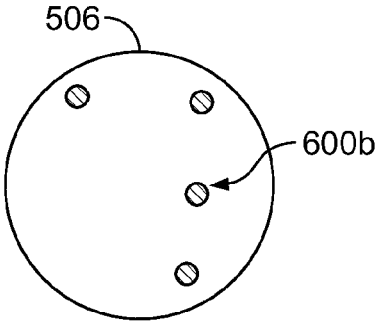

The memory 416 optionally stores an electronic identification code (EID) 418 that uniquely identifies the EWID 324 relative to other EWIDs in the wagering environment. A wagering environment such as a casino can have hundreds or even thousands of these EWIDs, and each EWID is assigned a unique EID, which can comprise any unique combination of alphanumeric characters. In other implementations, such as shown in FIGS. 6A-6B, the identification code is encoded in a graphic or pattern on the bottom of the base 506 of the EWID 324. The biometric sensor 420 can be disposed in the button 510 to sense a biometric attribute (e.g., a fingerprint) of the player to verify an identity characteristic of the player or to verify an identity of the player. The video display 422, such as a liquid crystal display, displays graphics, including animations, relating to the player, the wager input, or the wagering game. As explained in more detail below, the video display 422 can display a customized graphic that is transferred into the memory 416 of the EWID 324 via the interface 414, for "stamping" the customized graphic onto virtual chips being wagered by the EWID 324 on the surface of the display 314. The video display 422 can display the amount to be wagered so that the player to provide a visual confirmation of the amount to be wagered. The video display 422 can display the player's name or other identification information associated with the player to provide the player with confirmation that his or her identity has been correctly identified by the EWID 324. Finally, the one or more switches 424, which corresponds to the button 510 and other switches mentioned herein such as the twistable chip 512 or the twistable top or base 502, 506, provide inputs to the EWID 324 when actuated. The switches 424, when actuated, are used to verify an input or selection made by the player with the EWID 324 or to change or add functionality to the EWID 324. Examples of various switches 424 are described in more detail in connection with FIGS. 8A-8G below.

Figure 6C:
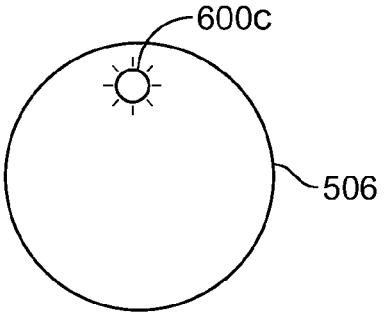
FIG. 6C is an exemplary bottom view of the EWID shown in FIG. 5A with an LED for communicating a unique identification code associated with the EWID.

FIGS. 6A-6C illustrate different examples of the bottom of the base 506 of the EWID 324, each bottom bearing a different graphic or pattern that is associated with an identification code for uniquely identifying the EWID 324. In FIG. 6A, the bottom of the base 506 includes a linear or 2D barcode 600*a* disposed thereon, the barcode encoding the identification code. The sensing device 326 reads the barcode 600*a* to decode the identification code associated with the EWID 324. The barcode 600*a* includes three registration members 602*a-c* that are detected by the sensing device 326 to determine how the EWID 324 is oriented relative to the surface of the display 314. The orientation of the EWID 324 can be used by the control system 334 to ensure that a graphic corresponding to the graphic displayed on the video display 422 is displayed on the surface of the display 314 in the same orientation. Thus, if the player has caused to be stored in the memory 416 of the EWID 324 a photo of a family dog, when the player orients the EWID 324 relative to the surface of the display 314 so that the family dog is facing the player, a graphic of the family dog will also be displayed facing the player on the surface of the display 314 (this example is explained in more detail in connection with FIGS. 9A-9D). The sensing device 326 detects the orientation of the EWID 324 to determine how to orient a corresponding graphic when displayed relative to the surface of the display 314, and the controller 334 transmits an orientation signal to the EWID 324 indicative of the orientation of the graphic. For example, the orientation signal can indicate that the EWID 324 needs to rotate the graphic 43 degrees counter-clockwise, which corresponds to the number of degrees required to orient the graphic so that it faces the player in an upright, forward orientation from the player's perspective. The EWID 324 transfers the graphic of the family dog from its memory 416 to the control system 334 via the IR transceiver 402 or the RF transceiver 406, for example. These examples allow the player to customize the virtual "chips" simulated being placed "on" the surface of the display 314 to distinguish that player's virtual chips being wagered on a wagering game played on the gaming system 310 from other players' virtual chips also being wagered on the same wagering game, who may also have their own respective customized graphics "stamped" on the virtual chips. Examples of other graphics that can encode an identification code associated with a player include a Domino tag developed by Microsoft in connection with its Surface project, a Mosey code, a shot code, a Semacode, the matrix code developed by Denso-Wave known as QR ("Quick Response") code, and ColorZip. Alternately, the bottom of the EWID 324 can display or bear a 2D code like the 2D code 1900, 1920 shown and described in connection with FIGS. 19A-19B below.

FIG. 6B illustrates a pattern of dots 600*b* that allow the sensing device 326 to detect an orientation of the EWID 324 in a similar manner as described in connection with FIG. 6A. The intent here is to show that different patterns or graphics are contemplated and those of ordinary skill in the art will appreciate that unique identification codes can be encoded or represented in a myriad of ways. An advantage to having the identification code imprinted or otherwise disposed on the bottom of the EWID 324 is that no power source is required in the EWID 324. Power sources such as batteries and inductive power sources add cost but are also tedious to maintain, although such power sources are clearly contemplated herein, particularly for the "intelligent" EWIDs that include the controller 400 and associated optional components shown in FIG. 4. EWIDs without power sources are inexpensive to make and replace, and if a player inadvertently leaves the wagering environment without returning the EWID, it can be easily replaced. The barcode 600*a* can be imprinted on a sticker, so that the barcode 600*a* can be easily replaced by another barcode by changing the sticker. Alternatively, the barcode 600*a* can be graphically shown on a small video display, such as an OLED or digital paper display, connected to the bottom of the EWID, so that the barcode 600*a* can be easily replaced by another barcode by changing the graphic on the video display. In FIG. 6C, an LED 600*c* is shown for detection by the sensing device 326 to indicate the presence of the EWID 324 relative to the surface of the display 314. For example, when the player actuates the switch 510, the LED 600*c* turns on, which signals to the sensing device 326 that the player has actuated the switch 510. The LED 600*c* can flash a pattern of lights, representing data such as the EID 418, to communicate the data to the control system 334 via the sensing device 326.

Although the barcode 600*a* and pattern of dots 600*b* are shown on the bottom of the EWID 324, they can also be disposed on both the top and bottom of the EWID 324 such that the player flips over the EWID 324 to reveal a different piece of encoded information to the gaming system 310. For example, this can allow two players to use the same EWID 324 to place wagers on the wagering game displayed on the gaming system 310. One player ensures that one side of the EWID is detected by the gaming system 310 to place wagers and hands it to another player who flips the EWID over to place wagers. The top and bottom of the EWID 324 is encoded with different identification codes. Or, a single player can associate multiple player accounts with different identification codes encoded on the top and bottom of the EWID 324.

FIGS. 8A-8G are illustrations of various examples of EWIDs 824*a-d* having different mechanical switches or push buttons. In all of the examples, a push button is disposed on the top of the EWID such that the player actuates the push button from the top of the EWID with a thumb or index finger, for example. In the example shown in FIGS. 8F and 8G, a push button is side-mounted relative to a wall of the EWID.

Figure 8A:
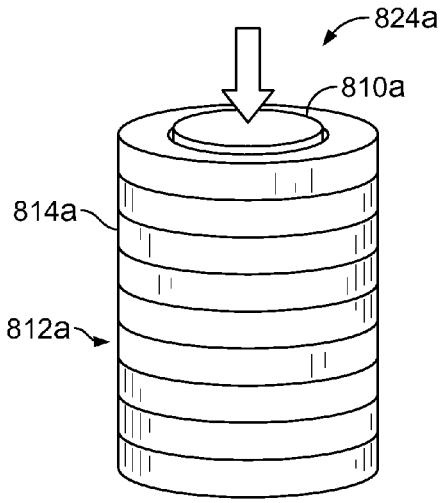
FIGS. 8A-8B are perspective and side cut-away views, respectively, of an EWID having a button assembly according to a first example.
Figure 8C:
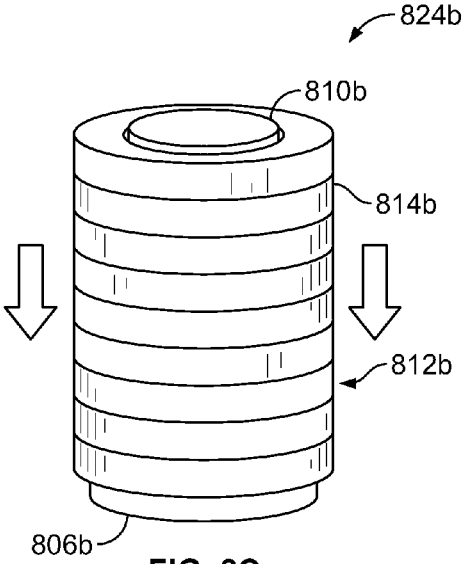
FIGS. 8C-8D are perspective and side cut-away views, respectively, of an EWID having a button assembly according to a second example, wherein actuation of the switch causes an outer side wall of the EWID to be urged downward toward the surface of the gaming system.
Figure 8B:
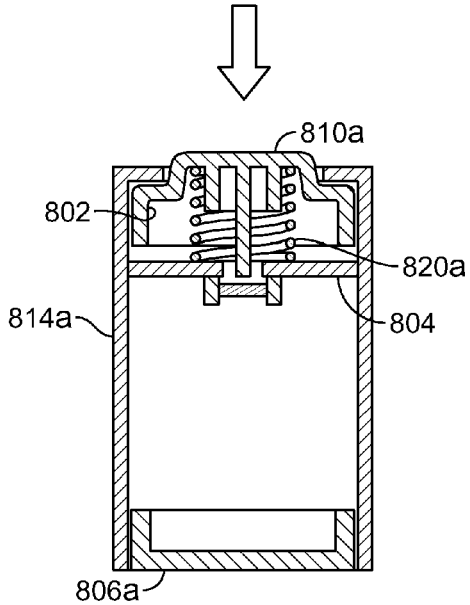
Figure 19A:
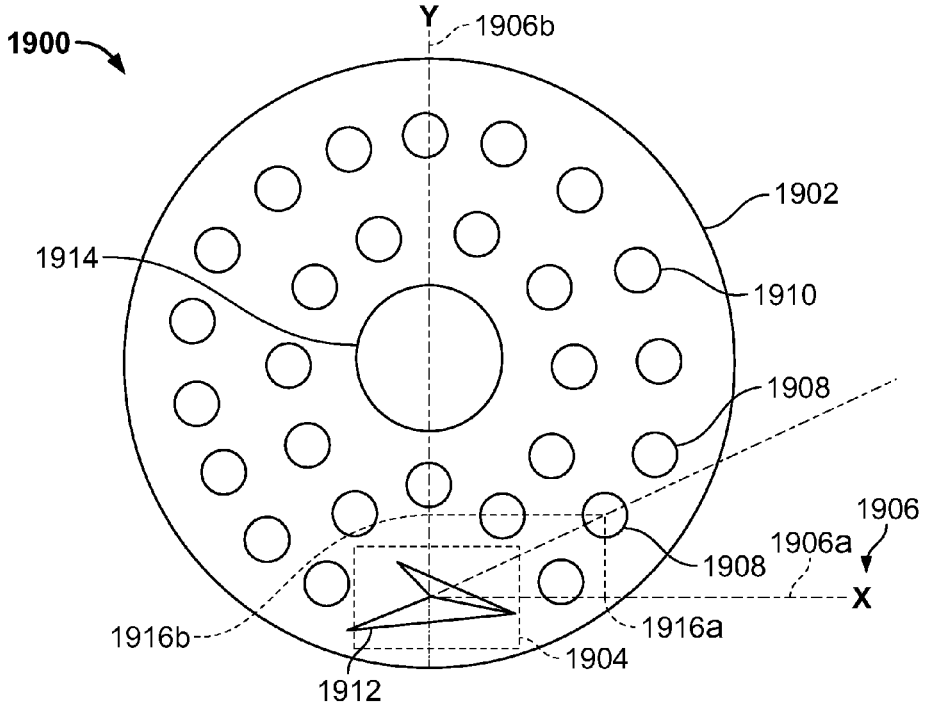
FIG. 19A is an illustration of an exemplary 2D code having an asymmetric base pattern and coded images representing encoded identification information.
Figure 19B:
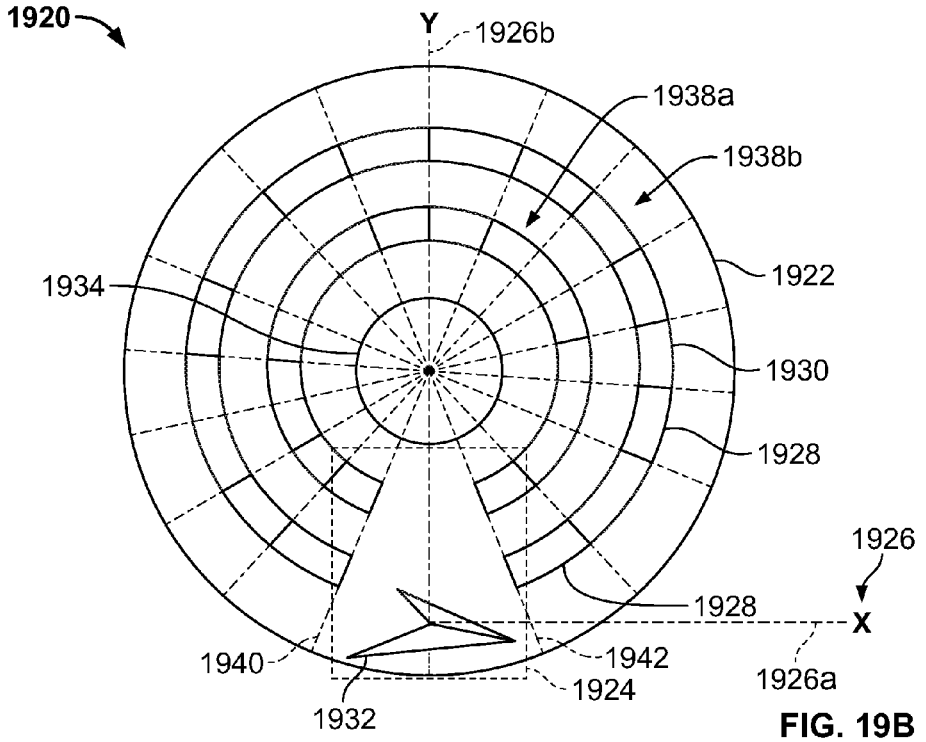
FIG. 19B is an illustration of another exemplary 2D code that includes an asymmetric base pattern and coded images in the shape of bars that are arranged in concentric circles.

In FIGS. 8A-8B, the EWID 824*a* includes a push button 810*a* disposed on a top surface of the EWID 824*a*. The EWID 824*a* includes a plurality of chips 812*a* as described above, such that an outer side wall 814*a* of the EWID 824*a* resembles a stack of chips. The push button 810*a* is held in tension against the top of the EWID 824*a* by a spring 820*a*. Actuating the push button 810*a* causes the spring 820*a* to compress, forcing end edges 802 in a downward direction making mechanical and optionally electrical contact with an internal structure 804. A base 806*a* of the EWID 824*a* can include a pattern or other indicia such as shown in FIGS. 6A-6C indicative of an identification code associated with the EWID 824*a* or a tag such as shown in FIGS. 19A-19B in the form of a 2D code, which encodes an identification code, identification information, object identification information, or wager information, to name a few examples.

Figure 8D:
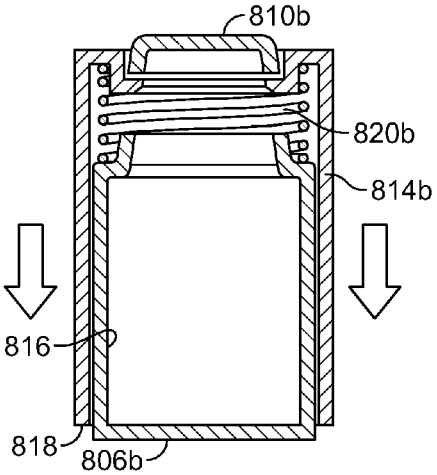

In FIGS. 8C-8D, the EWID 824*b* includes a button 810*b* and an outer side wall 814*b* that resembles a stack of chips 824*b* similar to that shown and described in connection with FIGS. 5A and 5B. The button 810*b* is mechanically coupled to an inner side wall 816 via a spring 820*b*. When the button 810*b* is actuated, the outer side wall 814*b* moves downward relative to the inner side wall 816 until end edges 818 of the outer side wall 814*b* are aligned with a base 806*b* adjacent to the inner side wall 816.

Figure 8E:
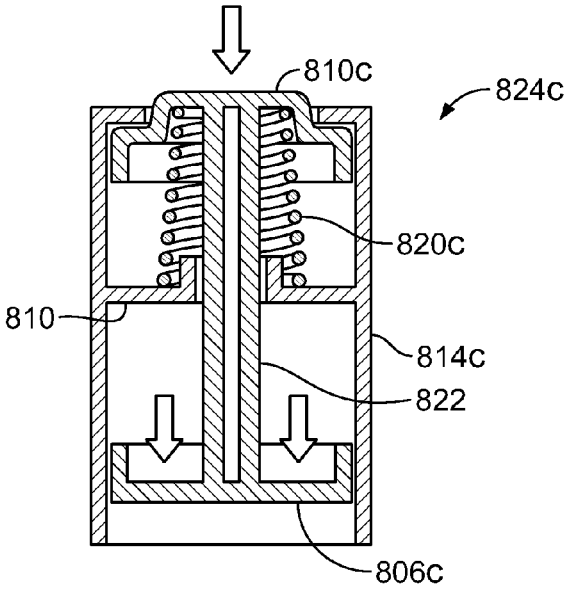
FIG. 8E is a side cut-away view of an EWID having a button assembly according to a third example where actuation of the switch causes an inner movable base of the EWID to be urged downward toward the surface of the gaming system.

In FIG. 8E, the EWID 824*c* includes a push button 810*c* mechanically coupled to a movable base 806*c* by a connecting rod 822. A spring 820*c* is held in tension between the push button 810*c* and a fixed internal structure 810. When the push button 810*c* is actuated, the connecting rod 822 forces the base 806*c* downward until it is flush with end edges of the outer side wall 814*c*, which resembles a plurality of stacked chips 824*c*. The bottom of the movable base 806*c* can include a pattern or indicia like that shown in FIGS. 6A-6C, such that when the push button 810*c* is not actuated, the sensing device 326 is unable to detect the pattern or indicia. Once the push button 810*c* is actuated, the bottom surface of the base 806*c* is flush against the surface of the display 314, allowing the sensing device 326 to detect the pattern or indicia. For example, the surface of the display 314 may be slightly opaque (such as used in the Diamond-Touch Table available from Circle Twelve, Inc., based in Framingham, Mass.) or translucent (akin to frosted glass, for example, as used in the Microsoft Surface project), such that the pattern or indicia is not detectable by the sensing device 326 until the push button 810*c* is actuated forcing the base 806*c* to be flush against the display surface. The translucent or opaque surface conceals from the player's view any electronics or other components underneath the surface of the display 814.

Figure 8F:
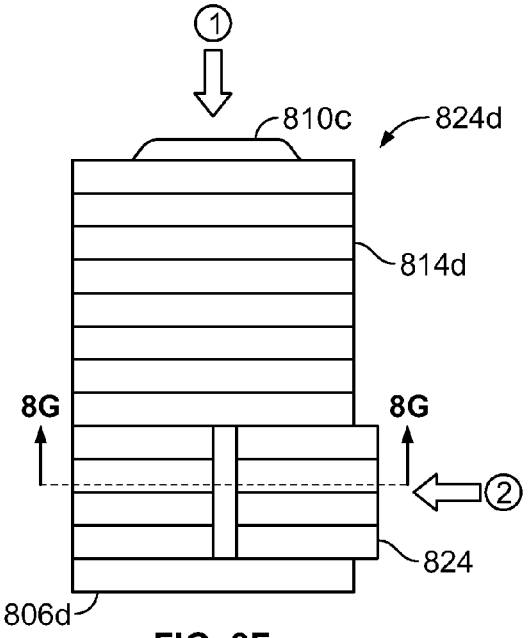
FIGS. 8F-8G are perspective and side cut-away views, respectively, of an EWID having a button assembly according to a fourth example, wherein the EWID includes a side-mounted button that can be actuated laterally.
Figure 8G:
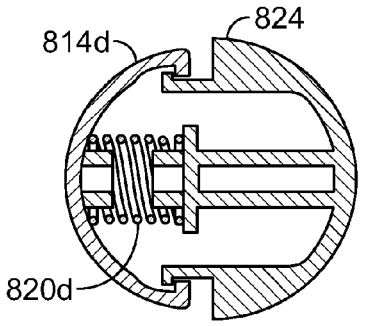

In FIGS. 8F-8G, there is shown a side-mounted button 824 formed in the outer side wall 814*d* of the EWID 824*d*, which also includes a top-mounted push button 810*c* that can be actuated in the direction of arrow 1. A cross-section of the button 824 is shown along lines A-A in FIG. 8G. The button 824 is mechanically coupled to the side wall 814*d* by a spring 820*d*. Some players will prefer to grasp or hold an EWID with palm of the hand hovering over the top of the EWID and the fingers extending downward along the outer side wall of the EWID, such as shown in FIG. 3, making the placement of the button 824 a convenient location for the index finger to actuate in the direction of arrow 2.

Prior to dispensing the EWID 324 to a player, the EWID 324 can be preconfigured or preset. The memory 416 can include configuration information that is established by the gaming establishment. For example, the configuration information can include a graphic, also stored in the memory 416, to be displayed on a virtual chip when a wager is placed therewith on a wagering game displayed on the gaming system 310. An important piece of information that is preset or preconfigured on the EWID 324 is the identification code (which can be stored in the memory of the EWID or encoded in a pattern disposed on the EWID), which is unique from all other identification codes associated with other EWIDs available in the gaming establishment.

Figure 9A:
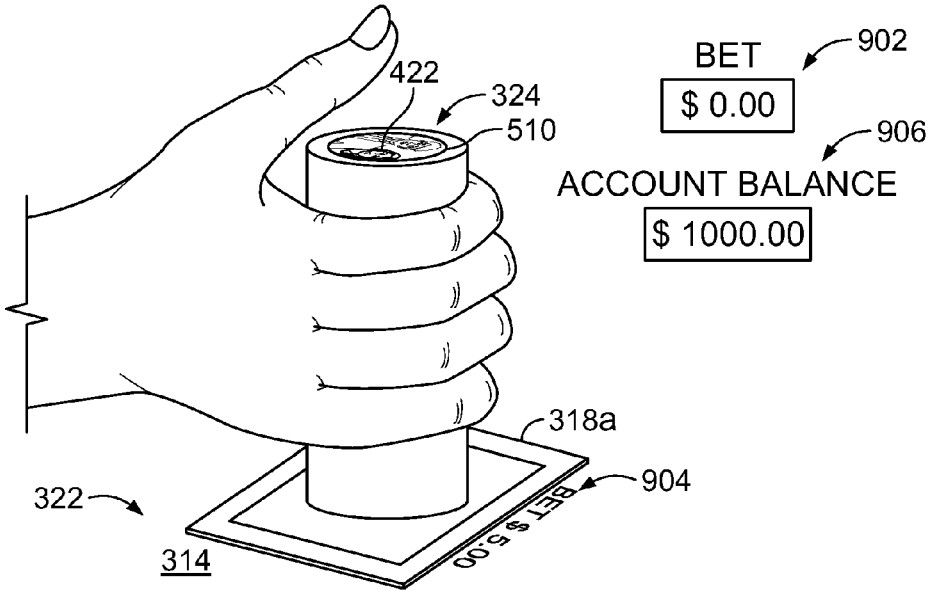
FIGS. 9A-9C represent a sequence of illustrations for indicating an amount to be wagered with the EWID by touching the EWID to various wager amount areas representing different denominations of wager amounts.

FIGS. 9A-9E illustrate ways of placing and removing wagers using the EWID 324, 824. In FIG. 9A, the player places the EWID 324 in a designated area 318*a* (which in this example is designated for displaying wager amounts to be wagered) displayed relative to the surface of the display 314. The designated area 318*a* corresponds to a wager amount of $5.00. Thus, if a player wishes to place a wager in the amount of $5.00 on a wagering game, the player places the EWID 324 in the designated area 318*a*. A graphic 902 indicating the value of the amount to be wagered can optionally be displayed relative to the surface of the display 314 proximate the designated area 318*a* or superimposed over it such that it wholly or partially overlaps the designated area 318*a*. The player's account balance 906 can optionally be displayed in a private area viewable only by the player. In this example, the player account balance 906 is shown to illustrate how the account balance changes. The account balance is stored in a secure server remote from the gaming system 310 in a player account database. In this way, no monetary value is stored in the EWID 324 itself such that if the EWID 324 is misplaced or stolen, there will be no value with which to place wagers on the EWID 324.

Figure 9B:
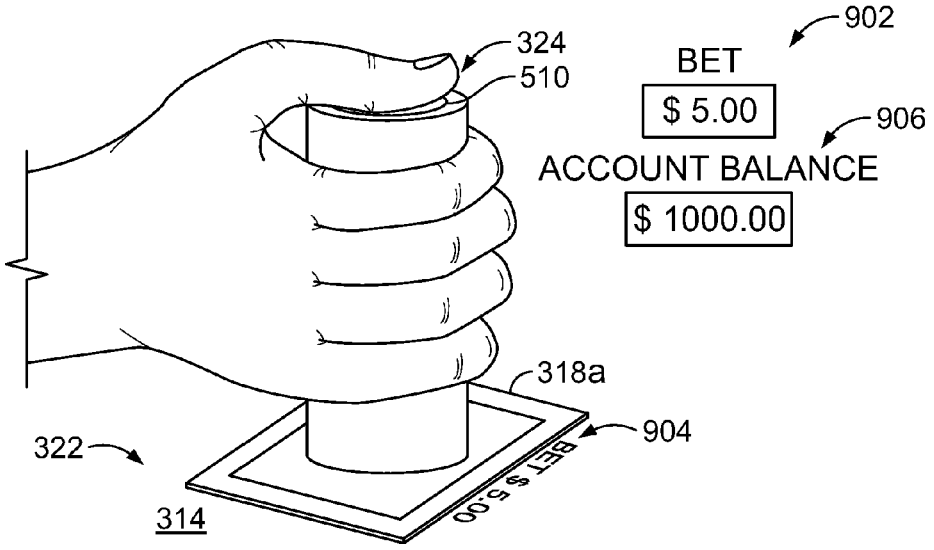

In this example, the mere placement of the EWID 324 in the designated area 318*a* is detected by the sensing device 326, which indicates that the amount to be wagered is $5.00, which is displayed in FIG. 9B. Optionally, the player actuates the button 510 or twists the twistable top 502 to confirm the wager amount. Note that the account balance 906 remains at $1000 because the player has not actually placed a wager yet.

Figure 9C:
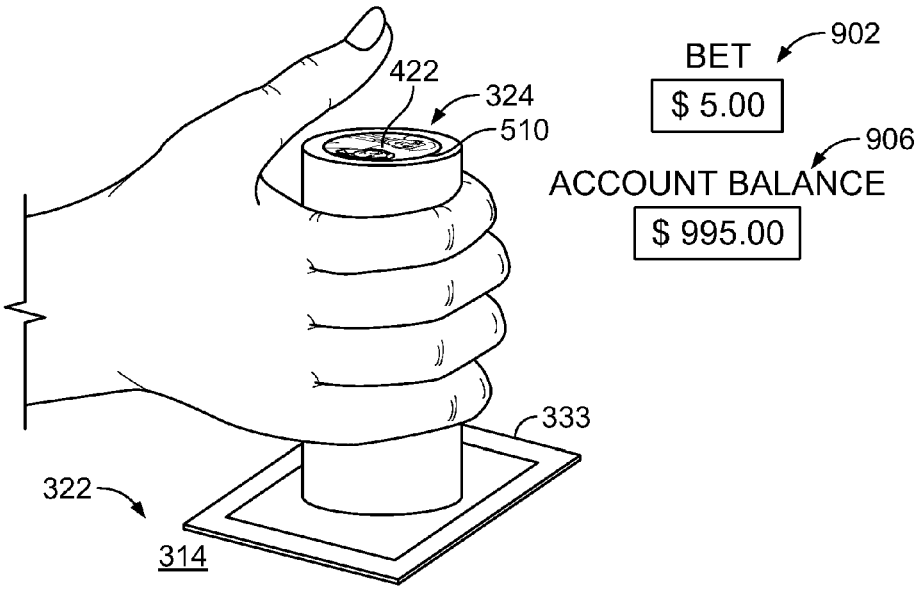

In FIG. 9C, the player now moves the EWID 324 to the designated wagering area 333 to place a wager of $5.00 on the probability that the roulette ball 313 will land in an EVEN pocket. The player can optionally actuate the button 510 to confirm the wager placement. The control system 334 has determined the identification code 318, 600*a*, 600*b* associated with the EWID 324, 824 and associated the identification code with the player's account. Once linked, when the player places the wager in the designated wagering area 333, the value of the wager is deducted from the player's account balance 906 and optionally displayed to the player. The optional graphic displayed on the optional video display 422 is transferred to the control system 334, such as via the RF transceiver 406, and a corresponding graphic 910 is displayed relative to the surface of the display 314 in the same orientation as the graphic displayed on the video display 422 as described above in connection with FIG. 6A.

Although the above description of FIGS. 9A-9D used specific examples of the EWID 324, 824, other examples are contemplated. For example, the button 510 can correspond to any switch 424 described herein, including those shown and described in connection with FIGS. 8A-8G. The button 510 is of course optional, and so is the video display 422.

Figure 9D:
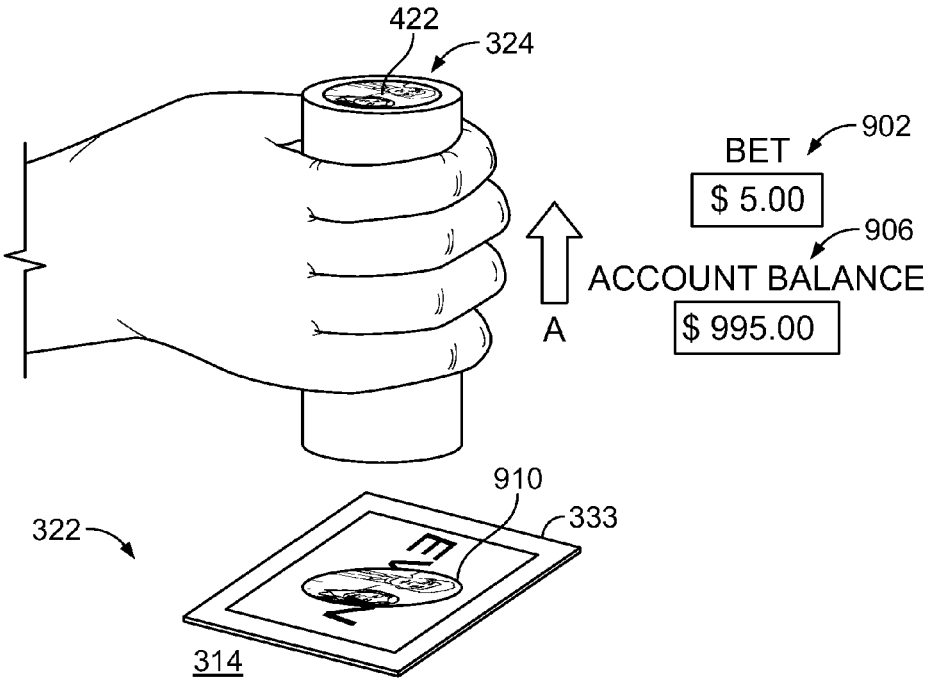
FIG. 9D is an illustration of a player placing a wager on the surface of the gaming system with the EWID and the corresponding deduction of the wager amount from the player's account balance that is associated with an EID that is associated with the EWID.
Figure 9E:
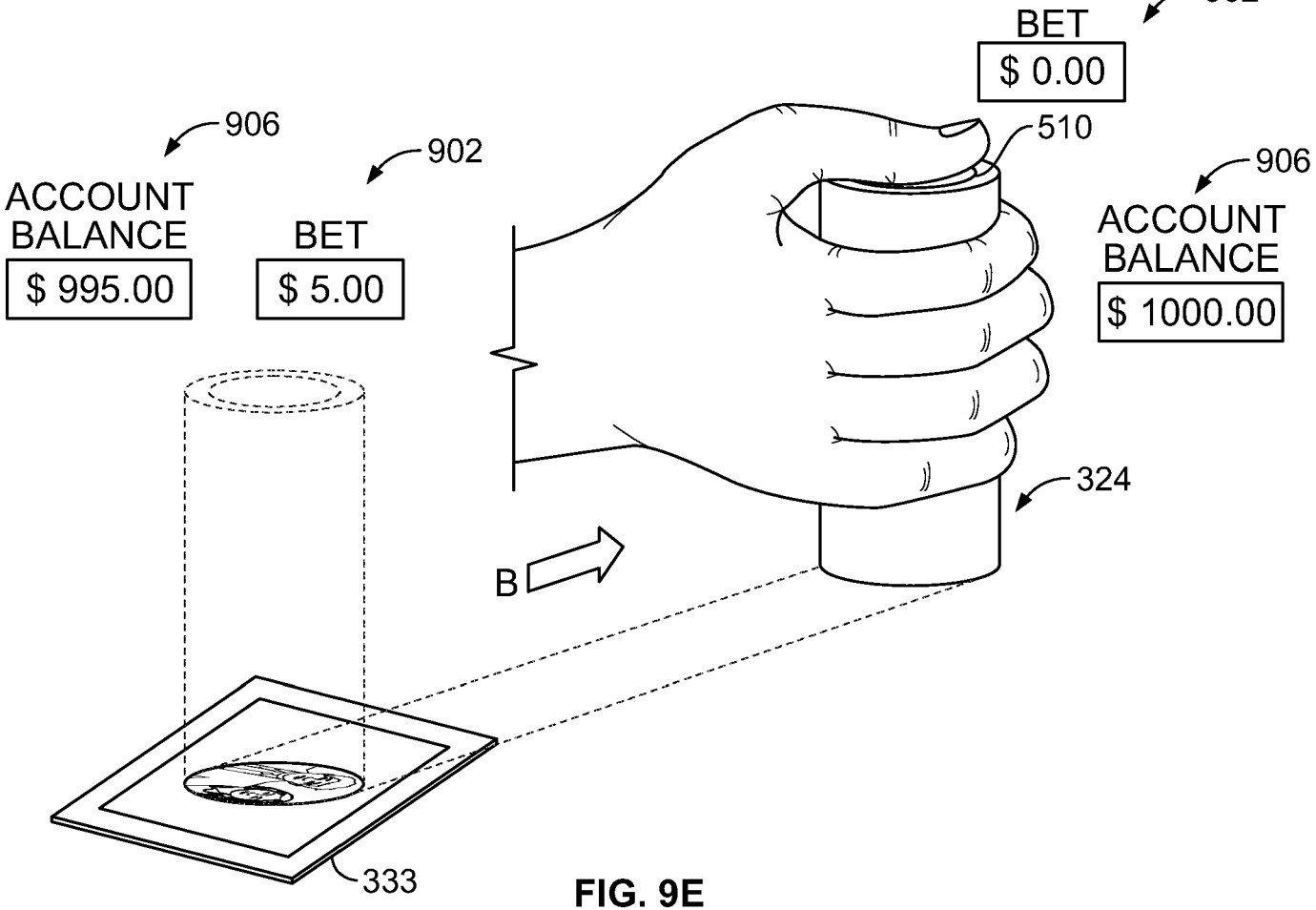
FIG. 9E is an illustration of a player removing a wager using the EWID in a manner similar to the player removing physical chips from the wagering table and the corresponding adjustment to the player's account balance.

In FIG. 9E, a functional diagram illustrating removal of a wager amount with an EWID 324 is shown. Initially, the player places the EWID 324 over a wager amount previously placed by the EWID, such as shown in the wagering area 333, and drags the EWID 324 along a direction indicated by arrow B away from the wagering area 333 to remove a wager. The account balance 906 is updated to reflect the removal of the wager amount. In the illustrated example, the player's removal of a $5 wager is reflected by updating the account balance 906 from $995.00 to $1000.00.

As used herein, a "touch" or "touch input" (and their grammatical variants) does not necessarily mean that a thing actually must physically contact or touch an area being sensed or monitored. As is known via techniques such as via capacitive sensing techniques and electromagnetic techniques, a thing or body part need not actually touch a surface of an area being sensed or monitored, but rather need only be placed in sufficient proximity thereto so as to be interpreted as a touch input. In other words, the word "touch" or "touch input" is intended to be interpreted as including near-touches.

As used herein, a multipoint gesture refers to multiple gestures that originate by contacting two or more points on the multipoint sensing device 300. Such gestures may be bimanual (i.e., require use of both hands to create a "chording" effect) or multi-digit (i.e., require use of two or more fingers as in rotation of a dial). Bimanual gestures may be made by the hands of a single player, or by different hands of different players, such as in a multi-player wagering game. By "simultaneously" it is meant that at some point in time, more than one point is touched. In other words, it is not necessary to touch two different points at the precise same moment in time. Rather, one point can be touched first, followed by a second point, so long as the first point remains touched as the second point is touched. In that sense, the first and second points are touched simultaneously. If contact is removed from the first point before the second touch is applied, then such a touch-scheme would be deemed to be a single-touch scheme.

Figure 10:
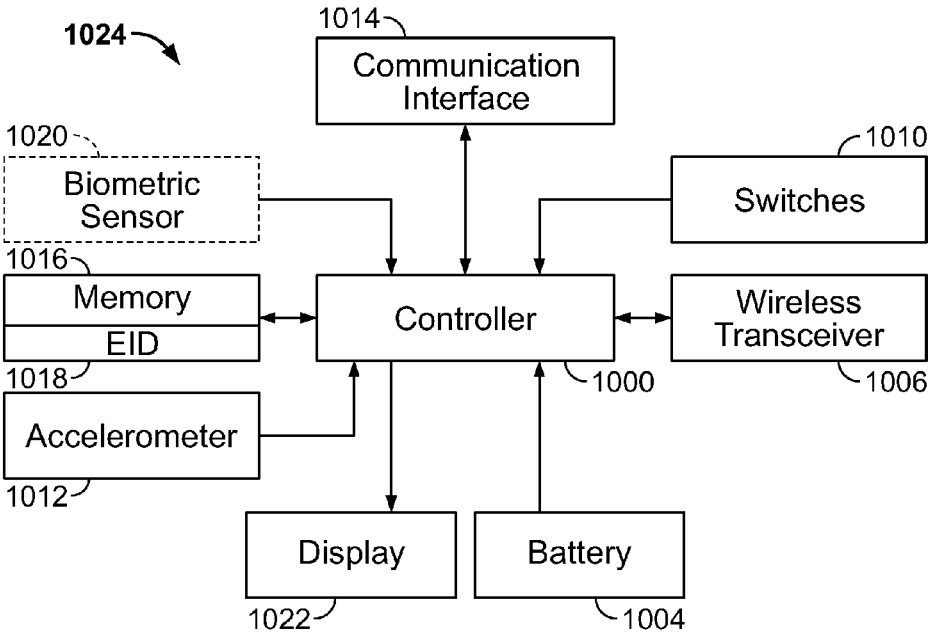
FIG. 10 is a functional block diagram of exemplary components of another EWID.

Turning now to FIG. 10, another example of a functional block diagram of an electronic wager input device 1024 is shown. This EWID was inspired by the "Siftable" user interface developed by David Merrill of the MIT Media Laboratory. The EWID 1024, like the EWID 324, allows a player to obtain, wager, collect, and cash in their funds. It does not actually store any funds, which are stored in a remote player account, and has no real monetary value outside of the gaming establishment in the same way real wagering chips have no monetary value outside of the gaming establishment. However, the EWID 1024 offers enhanced security relative to wagering chips, which when stolen or misplaced can be used by anyone who has possession of the chips, linking the EWID 1024 to a specific player account once the identity of the player of the EWID 1024 is known.

The EWID 1024 generally has the following attributes. It has a low-power consumption color video display 1022, a long-life, no-memory battery 1004, no physical or metal contacts for battery charging or communication (preferably, an inductive power charging mechanism is used and some form of wireless RF or other communications means), light weight, small enough to fit in the palm of a player's hand or in a pocket, and low cost to manufacture. Other components of the EWID 1024 include a controller 1000 coupled to one or more buttons or switches 1010, a wireless transceiver 1006 to support wireless communication between the EWID 1024 and external systems, an accelerometer 1012 to detect movements and orientations of the EWID 1024, a memory 1016 that includes an electronic identification code 1018 unique to that EWID 1024, an optional biometric sensor 1020 such as a fingerprint reader, and a (wired) communication interface 1014, such as a USB port. The buttons or switches 1010 are assignable or dynamically labeled such that the same switch when actuated can cause different functions to be performed depending upon how that button is programmed by software executed by the controller 1000. The accelerometer 1012 can detect an orientation of the EWID 1024 to ensure that a graphic displayed on the display 1022 is oriented in the same orientation when displayed on the surface of the gaming system 310. The accelerometer 1012 can also measure a speed that the EWID 1024 is moved to indicate, for example, removal or cancellation of a wager as described above.

Figure 11A:
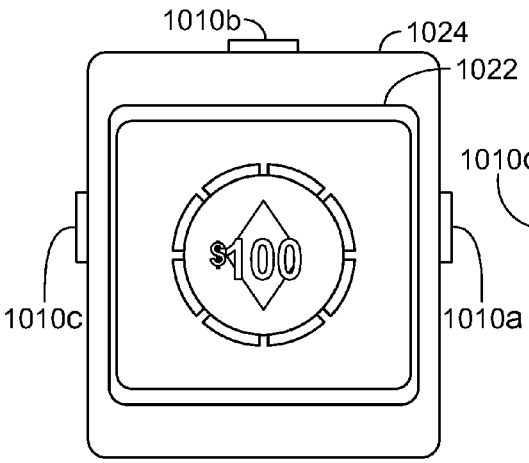
FIGS. 11A-11B are top views of example EWIDs, one lacking a biometric sensor and one having a biometric sensor, one showing a graphic of a chip and the other showing a custom graphic of the player's face.
Figure 11B:
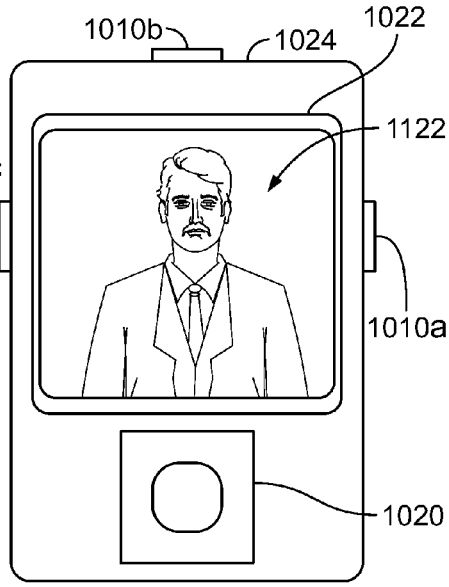

FIGS. 11A and 11B show top view illustrations of two exemplary EWIDs 1024, one with a biometric sensor 1020 (FIG. 11B) and one without (FIG. 11A). It should be noted that the EWIDs illustrated herein are not necessarily to scale. Some EWIDs are exaggerated to show more clearly the structural details of the EWIDs, but generally, the EWIDs herein are handheld or capable of being held in a player's hand or palm and easily carried in a shirt or pants pocket. The EWID 1024 has three buttons 1010*a,b,c* that can be dynamically labeled. When depressed or pushed, the function associated with that button is executed by the controller 1000. Examples of such functions are "Call Attendant," which initiates a call to an attendant. The buttons 1010 can be assigned to confirm or cancel an action related to the wagering game, such as confirm a wager amount or cancel a wager. The buttons 1010 can also be programmed to scroll through multi-screen messages or chooser lists on the display 1022 of the EWID 1024, or to advance a cursor through a list of text of graphic options, or to select an item from a list of options.

Figure 11C:
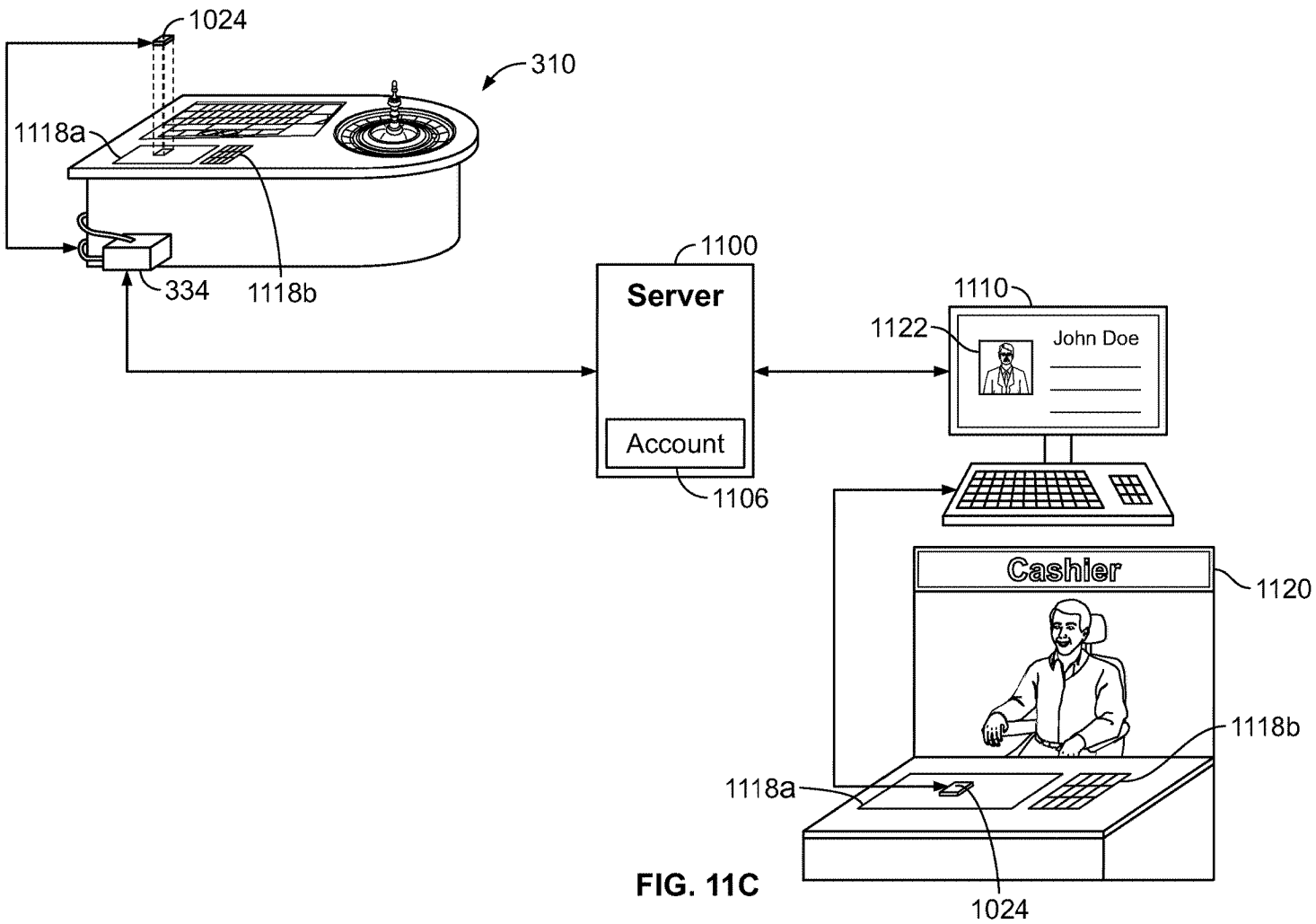
FIG. 11C is a block diagram of a system for linking an EWID to a player account stored on a remote server via an operator station or computer within the gaming establishment to allow the player to place wagers on a gaming system also communicatively coupled to the remote server.

FIG. 11C is a functional block diagram of an exemplary wagering system having a gaming system 310, an EWID 1024 shown hovering over a surface of the gaming system 310, a control system 334, an authentication area 1118*a*, and verification input area 1118*b*. These areas 1118*a*, 1118*b* are displayed and defined relative to the surface of the gaming system 310 to designate their respective functions.

The control system 334 is communicatively coupled to a remote server 1100 that stores a plurality of player accounts, including player account 1106. The remote server 1100 is also communicatively coupled to an operator station 1120 including an operator's computer 1110 that can access the information stored in the player account 1106, including a graphic or photograph of the player's face 1122 for verification. The computer 1110 can communicate with the EWID 1024 when placed in the designated authentication area 1118*a*. Instead of or in addition to a player account 1106, a "virtual chip tray" can be created and stored on the remote server 1100. A virtual chip tray is an account that is linked to the player's account balance, wherein the player designates a portion of available funds in the account balance 1206 that can be used for wagering with the EWID 1024. Players may be initially uncomfortable with placing wagers with an electronic device, even though their account balances remain safe, and may wish to designate only a portion of funds from a secure source for wagering with the EWID 1024. This disclosure will refer to a "player account," which can include the virtual chip tray. Both are player accounts (i.e., the funds in those accounts belong to the player), except that a virtual chip tray represents a subset of the account balance.

Figure 12A:
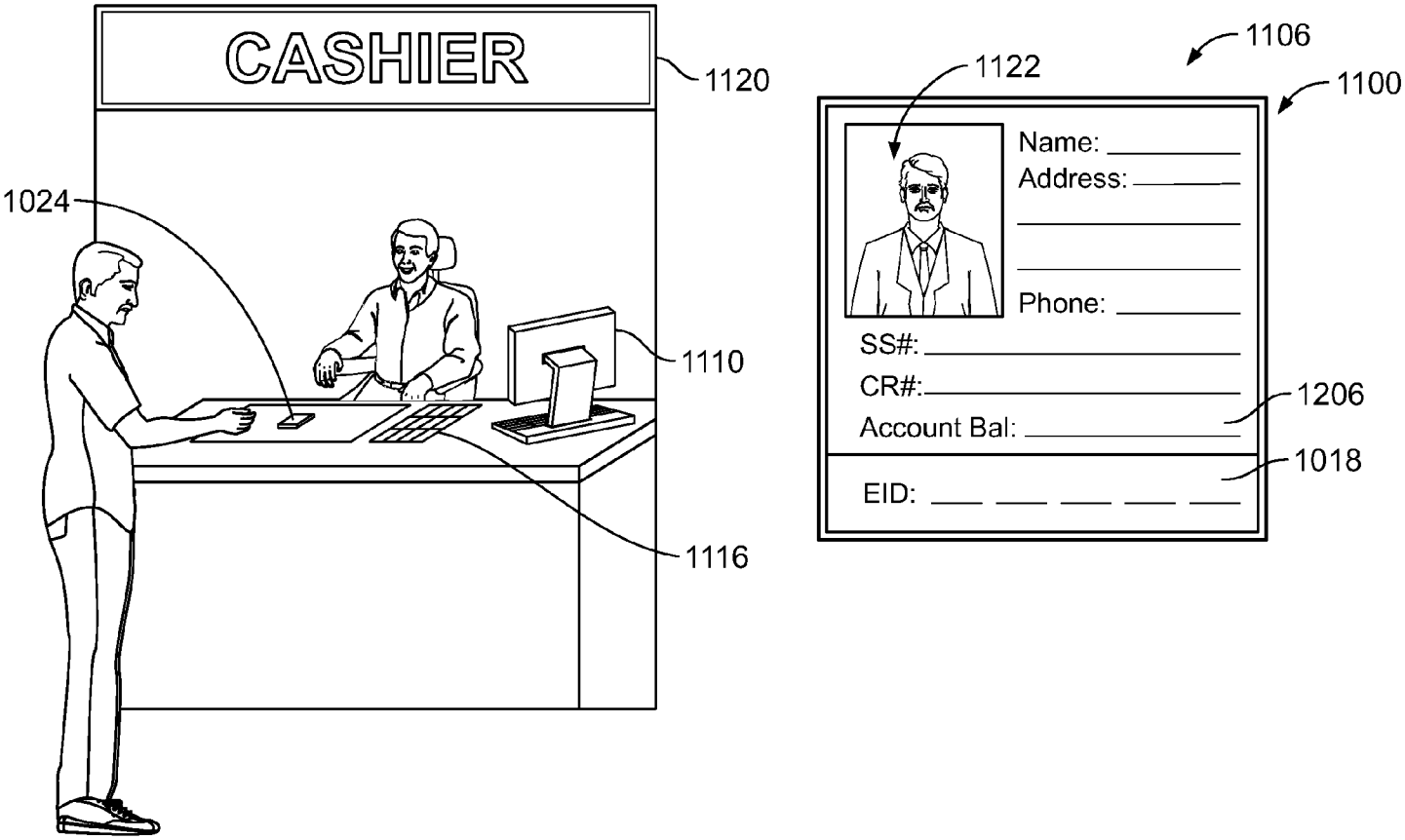
FIGS. 12A-12B are illustrations of a player receiving an EWID from an operator of a gaming establishment, wherein an EID associated with the EWID is linked to the player account to indicate "ownership" by that player of the EWID.
Figure 12B:
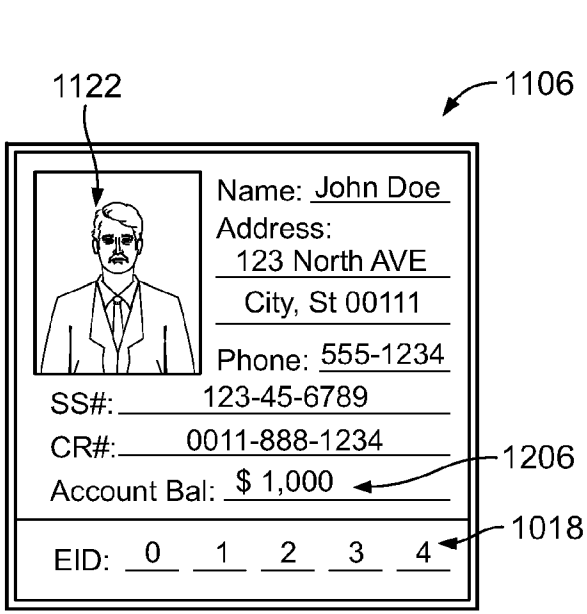
Figure 12B:
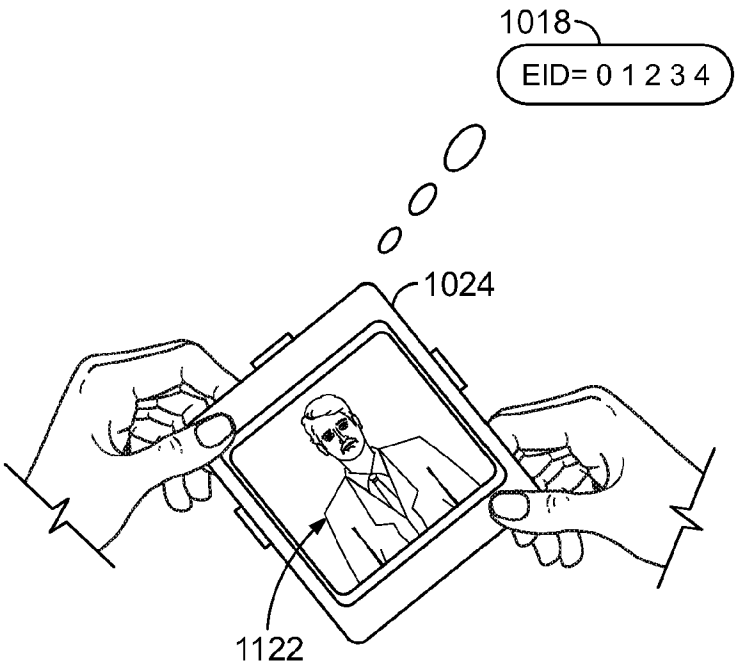

In FIGS. 12A and 12B, illustrations of a method of dispensing an EWID 1024 to a player are shown. In FIG. 12A, an EWID 1024 is presented to a player at the operator station 1120. The operator creates a new player account record or accesses a previously created one on the remote server 1100. The player account 1106 includes a graphic or photograph 1122 of the player, personal information about the player, such as the player's name, address, telephone number, social security number, and credit card number, an account balance 1206, and an electronic identification code (EID) 1018.

The operator computer 1100 reads the EID 1018 stored in the memory 1016 of the EWID, and associates that EID 1018 with the player account 1106. The player account 1106 includes an entry in the record for storing the EID 1018. Each EID 1018 is unique for every EWID that can be dispensed to a patron in the gaming establishment. Thus, in FIG. 12B, when the operator hands the EWID 1024 to the player, the EID 1018 has already been associated with the player account 1106. The player adds funds to the player account by conventional means, e.g., by credit card or ATM transfer from a bank account of the player, and these funds are stored as an account balance 1206 on the remote server 1100, not on the EWID 1024. Thus, if the EWID 1024 is lost or stolen, none of the player's funds will be compromised. When handing the player the EWID 1024, the EWID can display a graphic 1122 of the player on the video display 1022, reassuring the player and the operator that the correct player account has been associated with the EWID 1024. The graphic 1122 of the player's face can also be shown to a dealer at a wagering game for further verification that the player is authorized to place wagers with the EWID 1024. As mentioned earlier, the EWID 1024 is not drawn to scale, and would actually be physically smaller to fit within a palm of the player's hand.

Figure 13A:
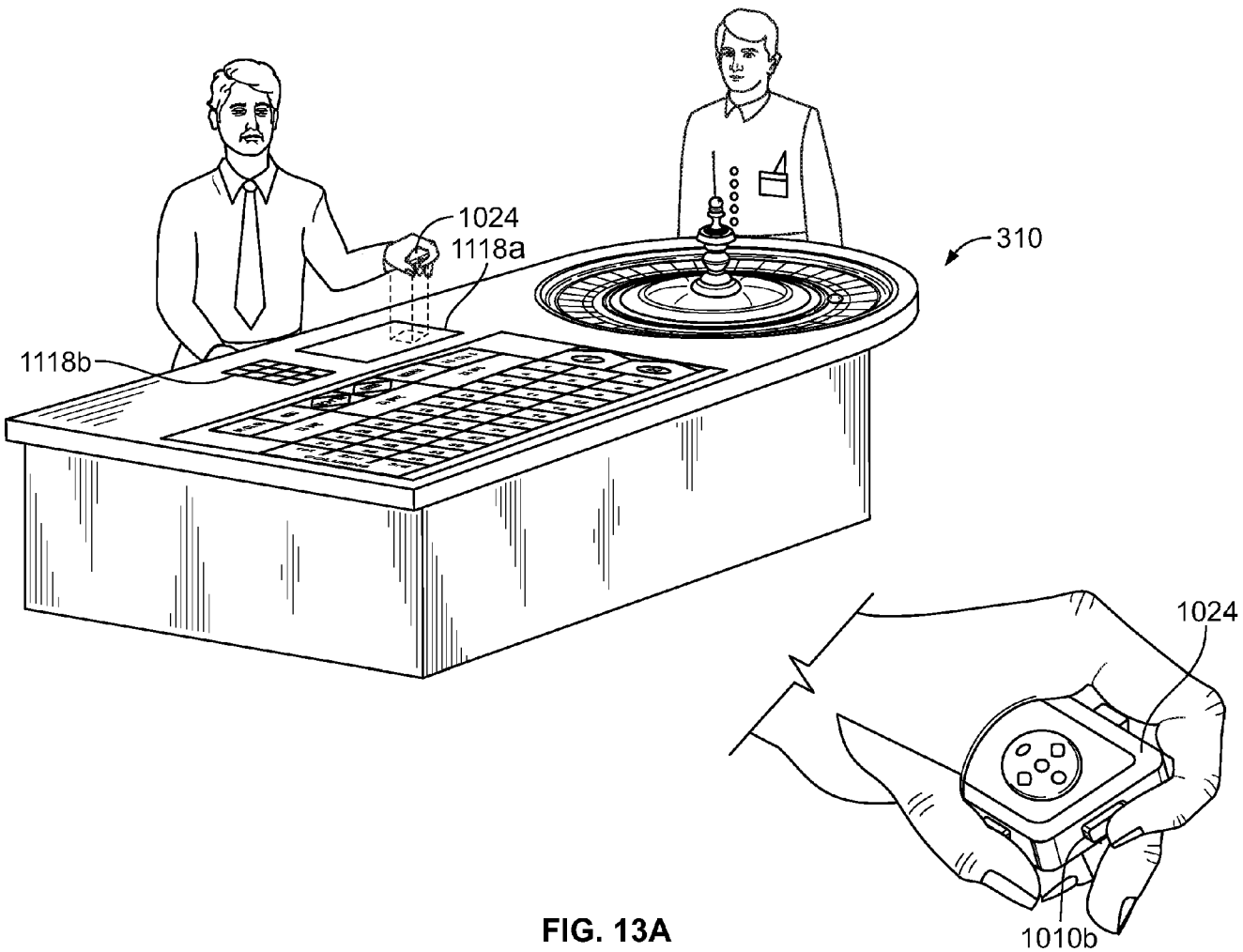
FIGS. 13A-13B are illustrations of a player registration at a gaming system using the EWID, whose EID is automatically detected by the gaming system, and a PIN number entered by and known only to the player carrying the EWID.
Figure 13B:
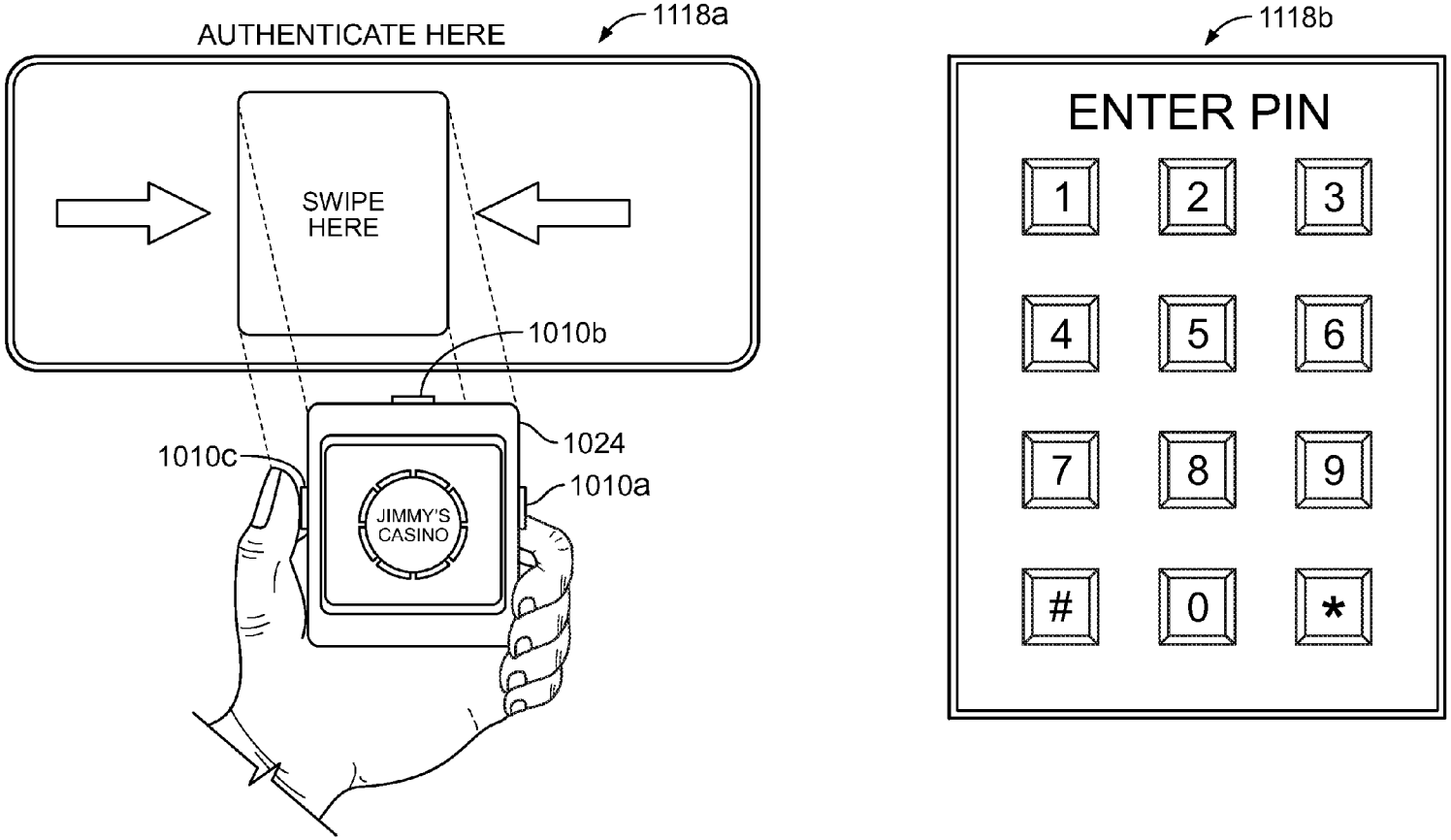

In FIGS. 13A and 13B, a method of authenticating or authorizing a player to place wagers with an EWID 1024 on the gaming system 310 is shown. In this example, the EWID 1024 lacks a biometric sensor 1020 (shown in FIG. 11A). To register himself at the gaming system 310 as an authorized "owner" of the electronic chips associated with the EWID 1024, the player places the EWID 1024 in the authentication area 1118*a* displayed on the surface of the gaming system 310. By placing "in" the authentication area 1118*a*, it should be noted that the EWID 1024 need not make physical contact with the surface of the gaming system 310, but rather brought in sufficient proximity to the surface so that the EID 1018 on the EWID 1024 can be detected by the control system 334 of the gaming system 310. Alternately, the player may actuate one of the assignable buttons, 1010*b*, to initiate the authentication process. The EWID 1024 transmits a wireless signal indicative of the button press as well as which button was actuated to the control system 334, which interprets the signal and carries out a function associated with that signal. In this example, the function is an authentication function that seeks to determine an identity of the person in possession of the EWID.

The player places the EWID 1024 in the authentication area 1118*a*, which may include a graphic with indicia indicating where the player should place the EWID 1024, and a keypad is displayed in the verification input area 1118*b*. The player inputs secondary authorization information, such as a PIN number known only to that player, on the keypad displayed in the verification input area 1118*b*, which is received by the control system 334. The control system 334 determines, based on the PIN number and EID, whether the player holding the EWID 1024 is the player whose account is linked to that EWID 1024. If so, the player is permitted to place wagers on the wagering game(s) being played at the gaming system 310. Alternately, the player may use the biometric sensor 1020 on the EWID 1024 to authenticate his identity, and a verification signal is communicated wirelessly from the EWID 1024 to the wireless transceiver system 354, which indicates to the control system 334 that the player is authorized to place wagers at the gaming system 310.

Player verification or authentication can be carried out in numerous other ways besides requiring entry of secondary authorization information such as a PIN number known only to the player or detecting a biometric attribute of the player or displaying a graphic of the player's face on the EWID 1024. The player can be required to wear an RFID bracelet, and the EWID 1024 detects the presence of the bracelet through passive electronic detection methods to verify the player. Alternately, the player can be required to use an account-based gaming card to verify the player. The account-based gaming card can be inserted into the EWID 1024 and detected via the communication interface 1014 or the gaming card can be detected by the gaming system 310. No identifying data for verifying an identity of the player is stored on the EWID 1024. Its EID 1018 is the only information transmitted to a remote server for accessing identification information associated with the player.

If a player loses an EWID 1024, the player must notify the gaming establishment, which then disassociates the EID 1018 of the device from the player's account 1106. Once disassociated, any other player attempting to place wagers with that EWID 1024 will not be successful because the remote server will not be able to correlate the EID 1018 with the player account. When the EWID 1024 is recovered, it can be returned to inventory and reused.

Once the player's identity has been authenticated, either by successful entry of a PIN number associated with the player's account or by successful detection of a biometric of the player, the player may use the EWID 1024 to input or place wagers on any of the wagering games being displayed on the gaming system 310. The player is presented with a wager amount area 1118*c* with a plurality of denominations representing different amounts to be wagered, e.g., $1, $5, $10, and so forth. Additional cancel wager and drop last wager areas 1118*d*, 1118*e* are also presented to the player for canceling an entire amount to be wagered 1118*d* or dropping only the last amount to be wagered 1118*e*. A display 1402 of a running total of the amount to be wagered is displayed on the surface of the gaming system 310. As shown in FIG.

14B, to indicate an amount to be wagered of $5, the player touches the EWID 1024 to the $5 denomination area of the wager amount area 1118*c*, and the presence of the EWID 1024 is detected by the control system 334 and its detected location is correlated with the displayed denomination to determine a wager amount. The display 1402 is updated to reflect that the player intends to place a $5 wager. The amount to be wagered can also be displayed on the EWID 1024 so that the player can confirm that the amount to be wagered was accurately detected by the gaming system 310. It should be emphasized that no funds are actually stored on the EWID 1024. An optional escrow account 1404, separate from the player account 1106, can be increased by the amount to be wagered, whose corresponding funds are deducted from the player account balance 1206. These funds are held in escrow until a wager is actually placed by the player.

Figure 14A:
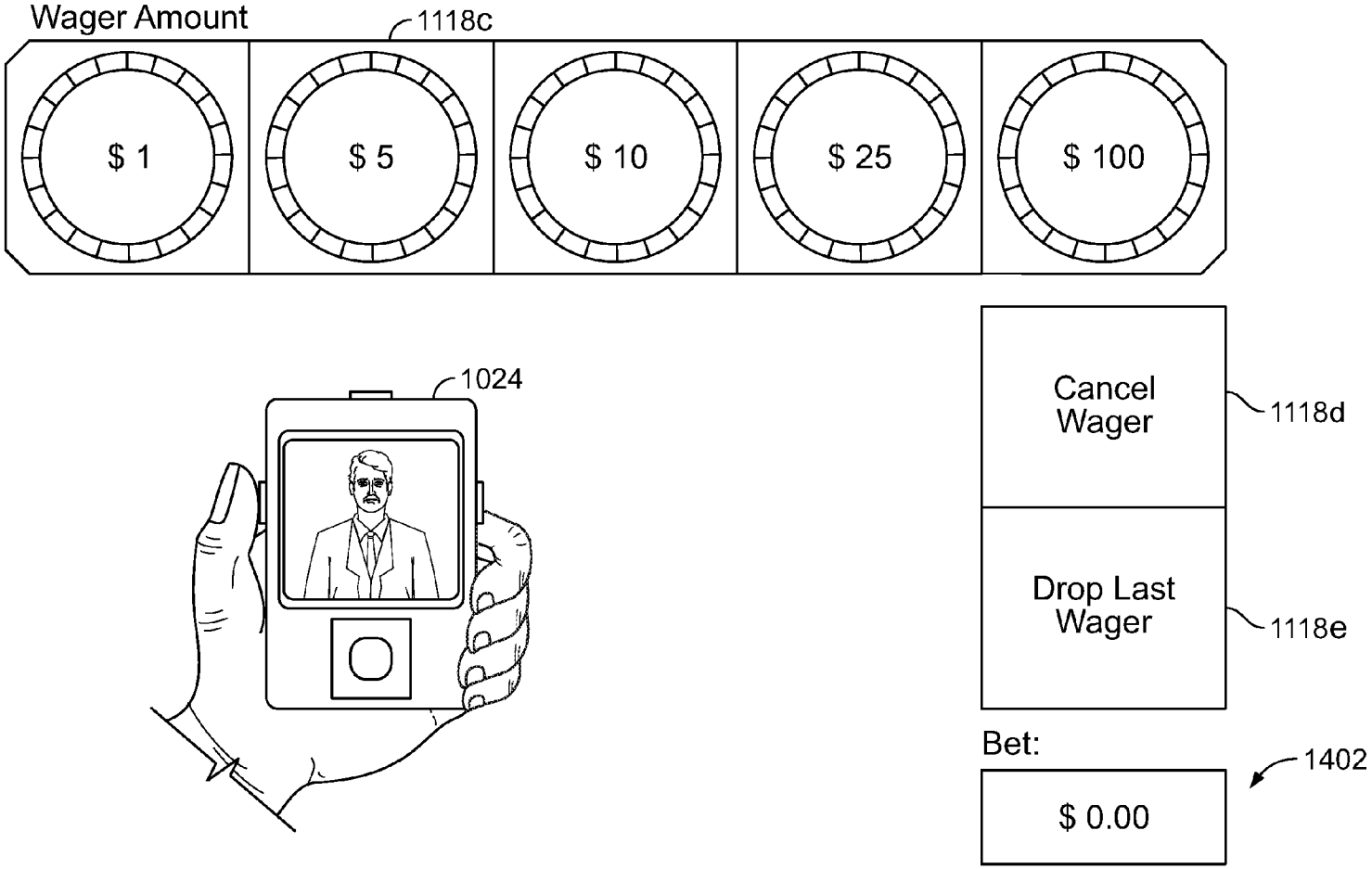
FIGS. 14A-14C are illustrations of a player indicating an amount to be wagered using the EWID to indicate denominations of wager amounts to be wagered by touching various designated wager amount areas on the surface of the gaming system.
Figure 14B:
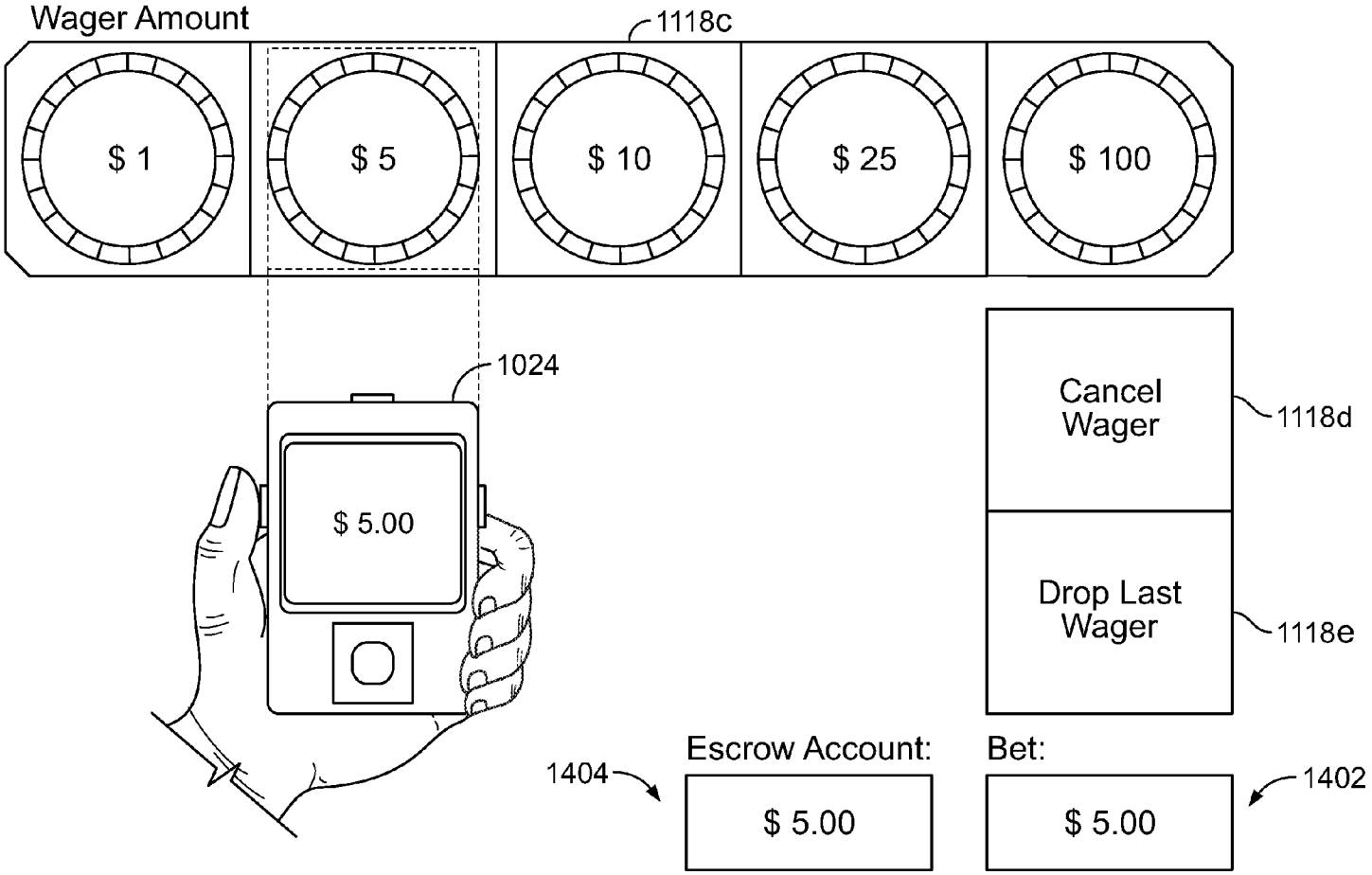
Figure 14C:
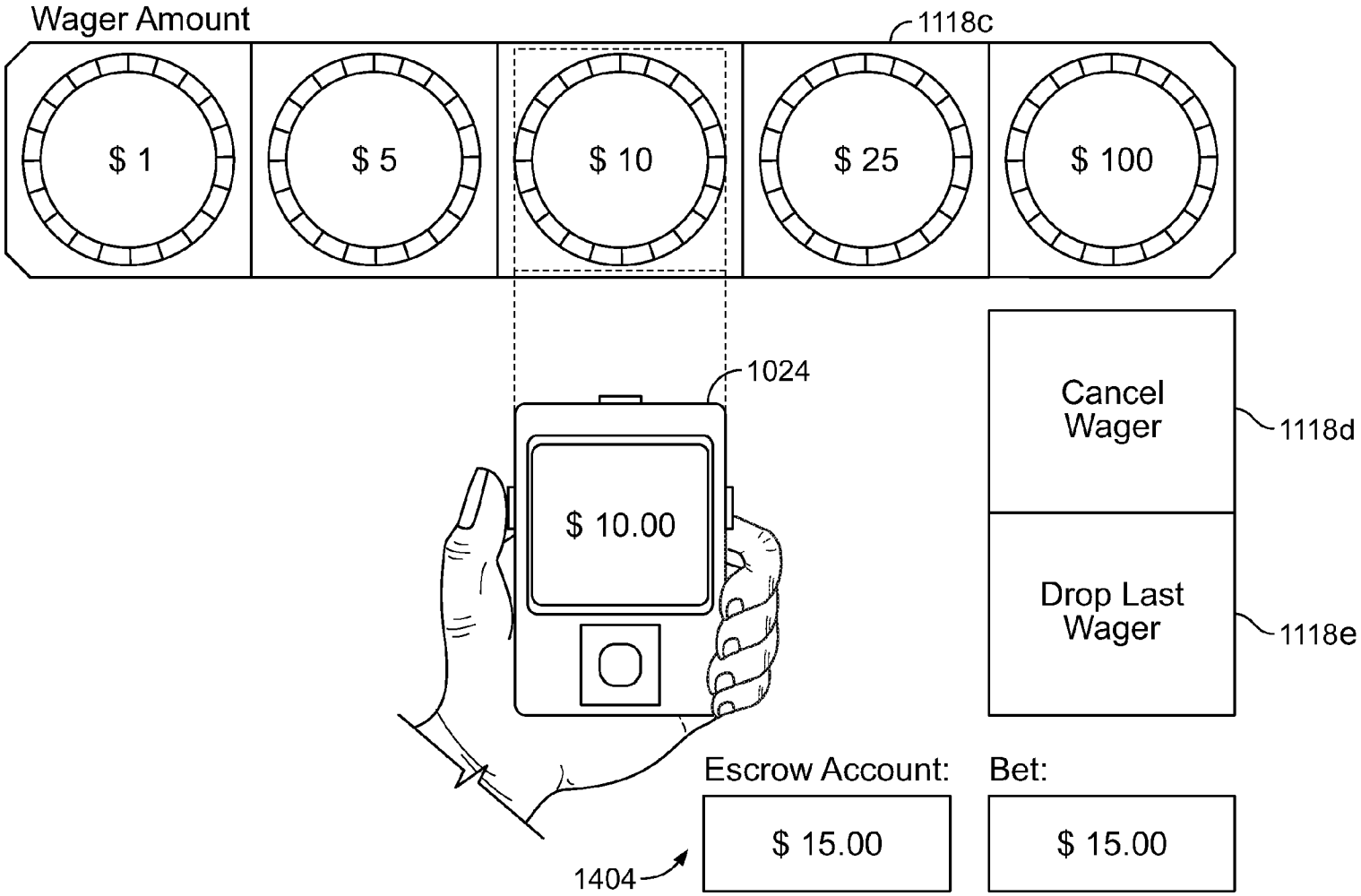

To increase an amount to be wagered, the player touches the EWID 1024 to additional one or ones of the plurality of denomination areas in the wager amount area 1118*c*, such as the $10 denomination as shown in FIG. 14C, and this amount to be wagered is added to the total amount to be wagered 1402 displayed on the surface of the gaming system. The amount to be wagered is also displayed on the EWID 1024 to provide a visual assurance to the player. To wager $2, for example, the player can touch the EWID 1024 twice to an area designated for $1 denominations in the wager amount area 1118*c*. After each touch, the EWID 1024 displays $1, then $2, to visually confirm the amount to be wagered. Alternately, the player can keep the EWID 1024 within a designated wager amount area 1118*c* for a predetermined period of time, and as the player holds the EWID 1024 there, the amount to be wagered increases in increments of that denomination, until the player removes the EWID 1024 from that wager amount area.

Figure 14D:
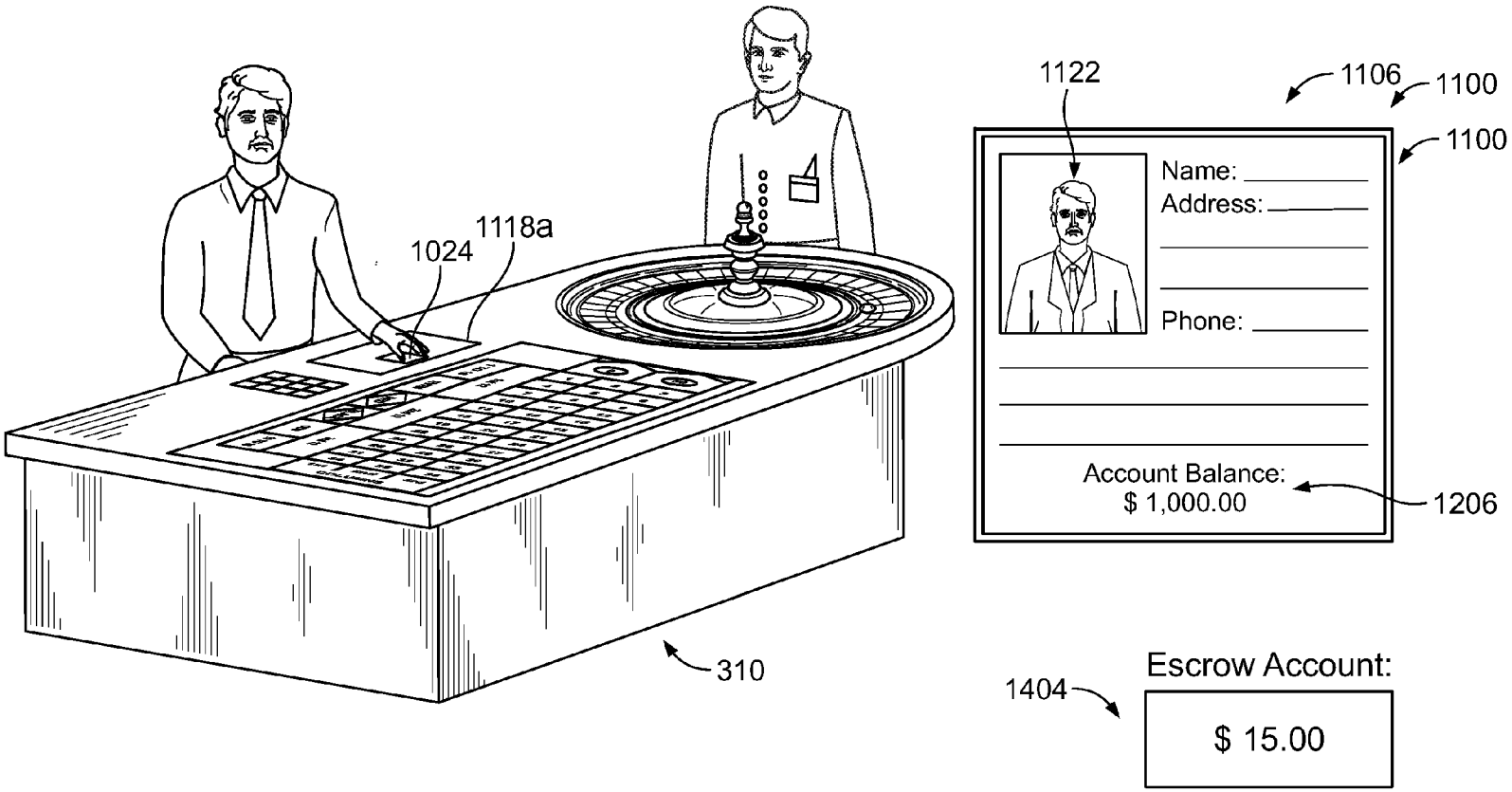
FIG. 14D is an exemplary gaming system illustrating a player poised to place a wager after the player has indicated an amount to be wagered via the EWID, wherein the funds to be wagered are stored in an optional escrow account linked to the player account.

Now that the player has selected an amount to be wagered with the EWID 1024, the player needs to place that wager on the wagering game using the EWID 1024. The wagering process approximates a player picking up one or more physical wagering chips to be wagered on a wagering game. A similar physical action is used, whereby the player picks up a physical object (here the EWID) and picks up one or more chips of various denominations. Referring to FIG. 14D, the player has indicated an amount to be wagered with the EWID 1024 in a manner described above. The account balance 1206 in one aspect still holds the initial $1000.00 in the player's account 1106. In another aspect, an escrow account 1404 holds the amount to be wagered (here, $15.00) and these funds are not released to the gaming establishment until the player has placed a wager. However, the funds are deducted from the player account 1106 in this aspect such that the total balance is $985.00 in this example.

Figure 14E:
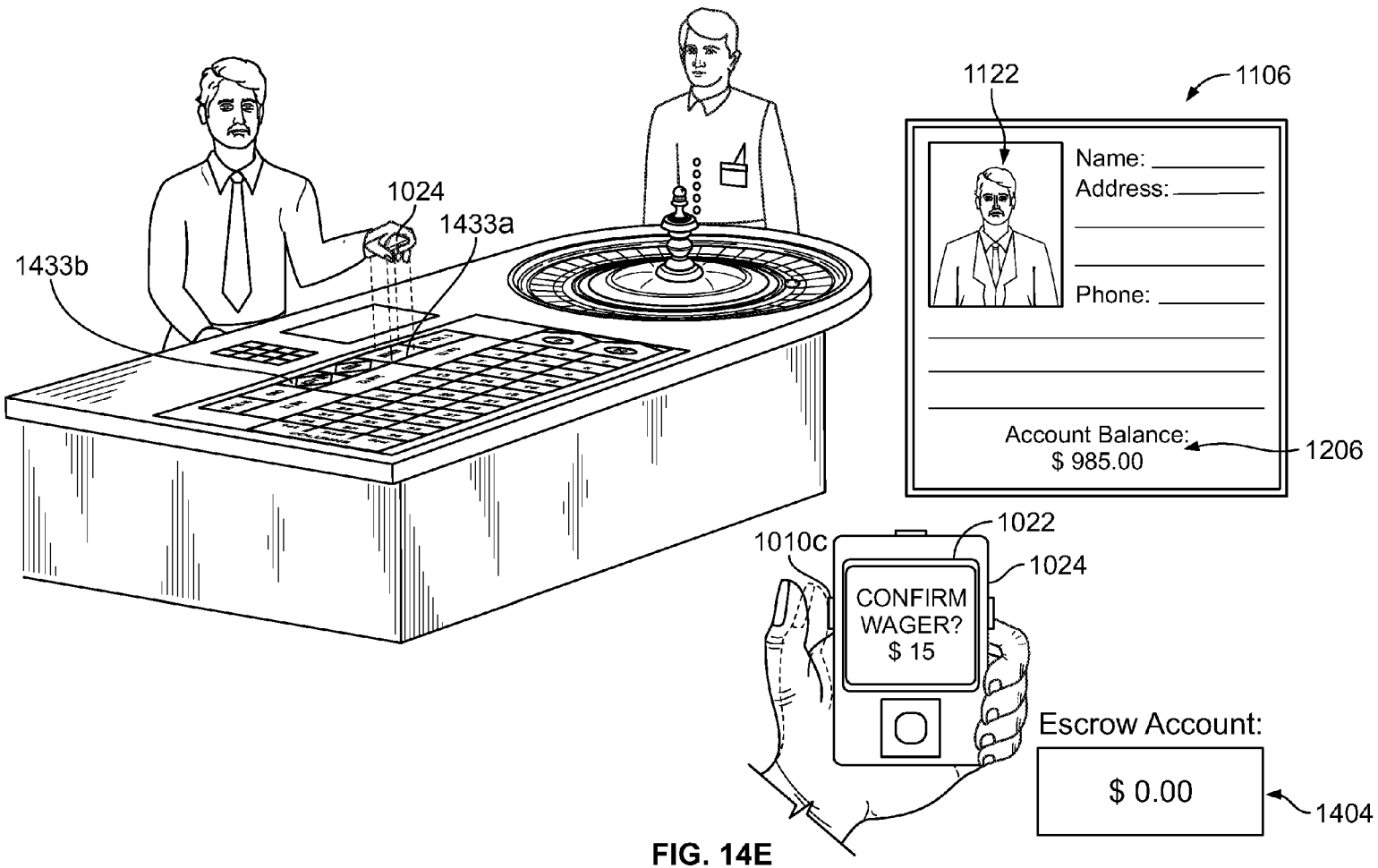
FIG. 14E is an illustration of a player placing a wager on a wagering game displayed on the gaming system by touching the EWID to a designated wagering area and optionally confirming the wager placement on the EWID.

In FIG. 14E, the player now touches the EWID 1024 to one of a plurality of wagering areas 1433, such as "Even" in a roulette game. The control system 334 detects the location of the EWID 1024 relative to the surface of the gaming system 310 and correlates the detected location with one of a plurality of predetermined wagering areas 1433 to determine the type of wager the player wishes to make. Once the control system 334 detects the type of wager placed by the player with the EWID 1024, in one aspect the funds are deducted from the account balance 1206 and transferred to the gaming establishment's financial account, or in another aspect, the funds temporarily held in the escrow account 1404 are transferred to the gaming establishment's financial account. Again, no funds are stored on the EWID 1024 itself. Optionally, the EWID 1024 can display on its display 1022 an indication for the player to confirm the wager amount (here, $15.00) by actuating one of the assignable buttons 1010*c* on the EWID 1024. For example, the EWID 1024 can display a graphic asking the player to confirm the wager amount of $15.00 and assigns a "Yes" response to one of the buttons 1010*c* and a "No" response to another of the buttons 1010. A graphic of the virtual chips placed on the wagering area 1433*a* is displayed on the surface in the area corresponding to the wagering area 1433*a*. Optionally, a custom graphic, like a family photo as described above, can be displayed on the face of the virtual chips to distinguish those chips from those placed by additional players at the gaming system 310.

In other aspects, no confirmation is made in this manner. To remove or move a wager, the player may simply touch the EWID 1024 to the original wagering area 1433*a* where the original wager was placed to "pick up" the virtual "wagering chips" that were previously placed there, and "move" those chips to another wagering area 1433*b* by subsequently touching the EWID 1024 to another wagering area 1433*b*. This sequence of actions approximates the physical actions that would be taken by the player to move physical wagering chips up until the dealer announces no more bets. The idea here is to simulate or approximate, as much as possible, the physical actions taken by the player to place, remove, or move wagers using the physical EWID 1024.

During game play of the wagering game at the gaming system 310, the player conventionally accumulates credits when wagers are placed on wagering games that result in a randomly selected winning game outcome. The account balance 1206 in the player account 1106 can be immediately adjusted by an amount commensurate with the winning credits so that those funds are immediately available for wagering.

When the player returns the EWID 1024 to an operator of the gaming establishment, the operator uses the computer 1110 to disassociate the EID 1018 from the player account 1106 and returns the EWID 1024 to inventory for subsequent usage within the gaming establishment. The player can leave whatever funds remain in the player account 1106 or can chose to withdraw any portion of those funds as currency.

The EWIDs and related methods and systems disclosed herein provide numerous advantages, including those disclosed herein. An advantage is that the gaming establishment, such as a casino, can eliminate legacy poker chips, thereby also eliminating the cost associated with storing, accounting, and handling such chips. Another advantage is that the EWID is a tactile device that is manipulated by the player in a way that approximates manipulation of real or physical chips. Still another advantage is that the artwork on the "virtual" chips displayed on the surface of the gaming system 310 can be changed on the fly via software either while in use or during play of a wagering game at the gaming system 310. Yet another advantage is that the EWID can display additional information to the player not necessarily related to the wagering game, such as directions, announcements, restaurant specials, show schedules, and the like. A further advantage is that there is no value stored on the EWID itself other than its intrinsic value. Player funds remain secure in the player's account. Another advantage compared to existing multi-touch tables is that the EWID reduces the liability of passing a signal through a player's body to identify the player at a multi-touch table. Passing signals through a player's body could invite mischief by unscrupulous players. A still further advantage is that the gaming systems herein can use a large multi-touch surface for playing a wagering game because multiple players can interact with the table surface simultaneously while still being uniquely identified.

Figure 15:
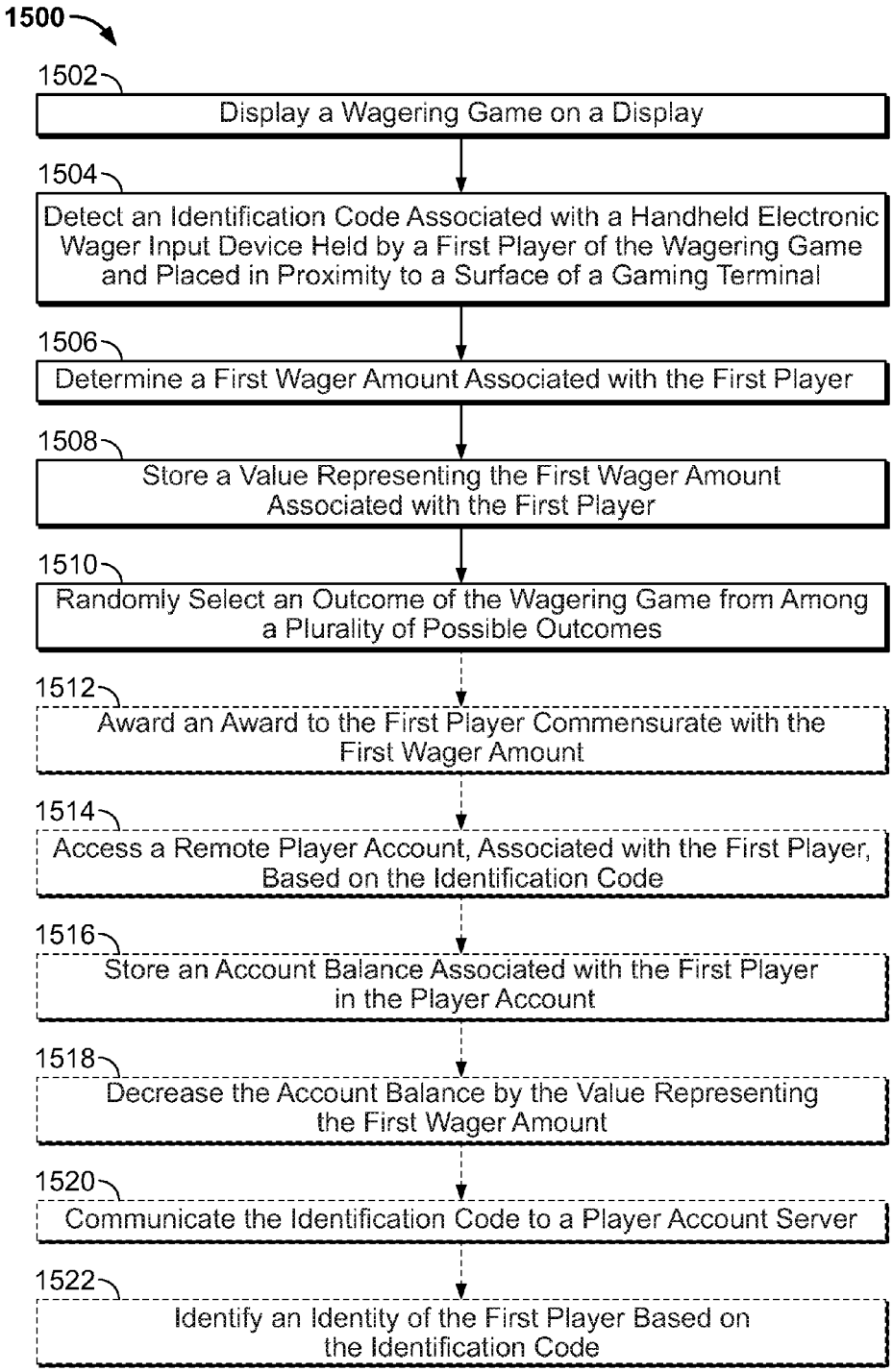
FIG. 15 is a flowchart for an algorithm that corresponds to instructions executed by a controller in accord with at least some aspects of the present disclosure.

FIG. 15, described by way of example above, represents an algorithm 1500 that corresponds to at least some instructions executed by the controller 34, control system 334, controller 1000, server 1100, computer 1110, and/or external systems 50 in FIG. 2 to perform the above described functions associated with the present disclosure. The algorithm 1500 displays a wagering game on a display (1502), such as a roulette game on the table surface of the gaming system 310. The algorithm 1500 detects an identification code, such as the barcode 600*a*, the pattern of dots 600*b*, a code encoded in the LED 600*c*, or the EID 418, 1018, associated with a handheld EWID, such as the EWID 324, 1024, held by a first player of the wagering game and placed in proximity to a surface of a gaming terminal, such as the surface of the gaming system 310 (1504). The algorithm 1500 determines a first wager amount based on the identification code (1506). The algorithm 1500 stores a value representing the first wager amount associated with the first player (1508). The algorithm 1500 randomly selects an outcome of the wagering game from among a plurality of possible outcomes (1510).

The following optional blocks can be carried out by the algorithm 1500. The algorithm 1500 can award an award to the first player commensurate with the first wager amount (1512). The algorithm 1500 can access a remote player account, such as the player account 1106, associated with the first player, based on the identification code (1514). The algorithm 1500 can store an account balance, such as the account balance 906, 1106, associated with the first player in the player account (1516). The algorithm 1500 can decrease the account balance by the value representing the first wager amount (1518). The algorithm 1500 can communicate the identification code to a player account server, such as the server 1100 (1520). The algorithm 1500 can identify an identity of the first player based on the identification code (1522).

Figure 16:
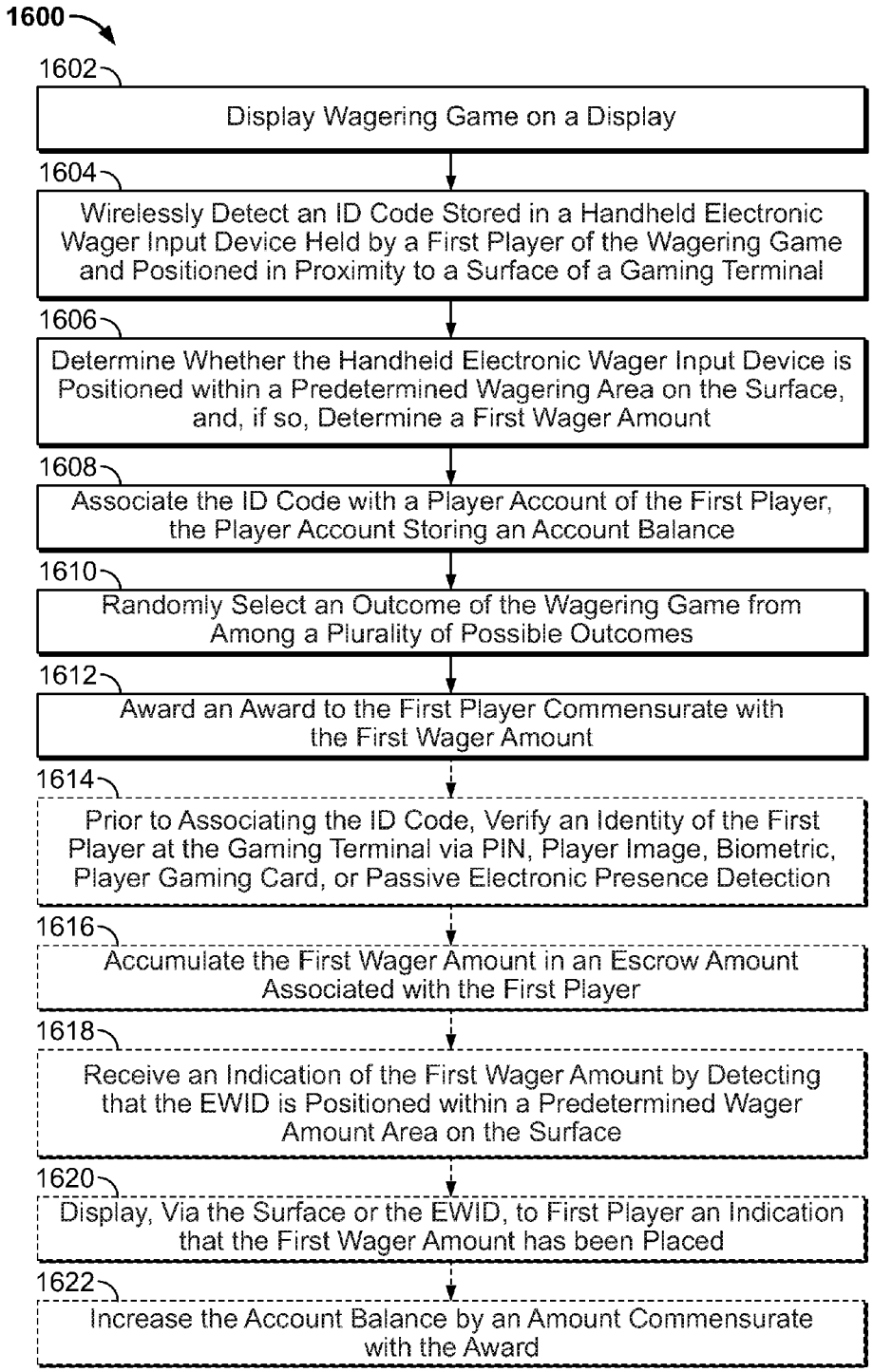
FIG. 16 is a flowchart for another algorithm that corresponds to instructions executed by a controller in accord with at least some aspects of the present disclosure.

FIG. 16, described by way of example above, represents an algorithm 1600 that corresponds to at least some instructions executed by the controller 34, control system 334, controller 1000, server 1100, computer 1110, and/or external systems 50 in FIG. 2 to perform the above described functions associated with the present disclosure. The algorithm 1600 displays a wagering game on a display (1602), such as a roulette game on the table surface of the gaming system 310. The algorithm 1600 wirelessly detects an identification code, such as the barcode 600*a*, the pattern of dots 600*b*, a code encoded in the LED 600*c*, or the EID 418, 1018, stored in a handheld EWID, such as the EWID 324, 1024, held by a first player of the wagering game and positioned in proximity to a surface of the gaming terminal (1604). The algorithm 1600 determines whether the EWID is positioned within a predetermined wagering area, such as areas 333, 1433*a,b* on the surface, and, if so, determines a first wager amount (1606). The algorithm 1600 associates the ID code with a player account, such as the player account 1106, of the first player, wherein the player account stores an account balance, such as the account balance 906, 1206 (1608). The algorithm 1600 randomly selects an outcome of the wagering game from among a plurality of possible outcomes (1610). The algorithm 1600 awards an award to the first player commensurate with the first wager amount (1612).

The following optional blocks can be carried out by the algorithm 1600. The algorithm 1600 can, prior to associating the ID code, verify an identity of the first player at the gaming terminal via PIN, player image, biometric, player gaming card, or passive electronic presence detection (1614). The algorithm 1600 can accumulate the first wager amount in an escrow account, such as the escrow account 1404, associated with the first player (1616). The algorithm 1600 can receive an indication of the first wager amount by detecting that the EWID is positioned within a predetermined wager amount area on the surface of the gaming terminal (1618). The algorithm 1600 can display, via the surface or via the EWID, to the first player an indication, such as shown in FIG. 9D, that the first wager amount has been placed (1620). The algorithm 1600 can increase the account balance by an amount commensurate with the award (1622).

The examples above have described a roulette game, but this disclosure is hardly limited to roulette-type wagering games. For example, besides slots, keno, poker, and blackjack, this disclosure contemplates a long table that resembles a bar top with video displays where players sit and use an EWID to place wagers while drinking at a bar or eating at a restaurant, for example. Gesture tracking software or hardware can orient the video displays so that they display in a normal orientation to the player while seated in front of them.

One style of EWID 324 is described in connection with FIGS. 3-9E, while another style of EWID 1024 is described in connection with FIGS. 10-14E. It is contemplated that the discussion of one style is equally applicable to the other style. These different figures simply represent two different types of EWIDs 324, 1024 as contemplated herein, but the functionality, hardware, and software associated with one type is equally applicable to the other. FIGS. 15 and 16 are applicable to any of the disclosed examples in FIGS. 1A-14E.

Instead of having predefined wager amount areas, such as the designated areas 318, 1118, the player can touch the EWID 324, 1024 to a wagering area, such as the areas 333, 1433, and twist the top 502 of the EWID 324 or hold a button 1010 or otherwise interact with some feature of the EWID 324, 1024 to cause a wager to be placed on the wagering area. By continuing to twist the top 502 or actuating or holding a button 1010, the wager amount can be increased (e.g., from $1 to $2 to $3 and so forth) by a denomination until the player removes the EWID 324, 1024 from the wagering area. There are numerous ways the player can interact with the EWID 324, 1024 to cause a wager to be placed on a wagering area. For example, the player can twist the top 502 to cycle through various wager denominations and actuate the button 510 to place that wager amount on a designated wagering area. The player twists the top 502 again to change the denomination, and actuates the button 510 again to add that denomination to the total wager amount, while keeping the EWID touched to the table surface of the gaming system 310.

The EWID 324, 1024 can have multiple states, which can be changed by twisting the top 502 or actuating a button 1010 (to name only a few exemplary ways). For example, the state can be indicative of a type of data to be communicated from the EWID 324, 1024, or a denomination of a wager, or of a wagering or non-wagering state. In the latter example, the state of the EWID 324, 1024 can be changed from a wagering to non-wagering state to allow the EWID 324, 1024 to be used for some purpose other than placing wagers on a wagering game. As discussed above, the EWID can be used for various non-wagering purposes including summoning a casino employee, making restaurant reservations or checking restaurant specials, checking directions, receiving announcements, restaurant specials, or checking show schedules, to name a few examples.

Figure 17:
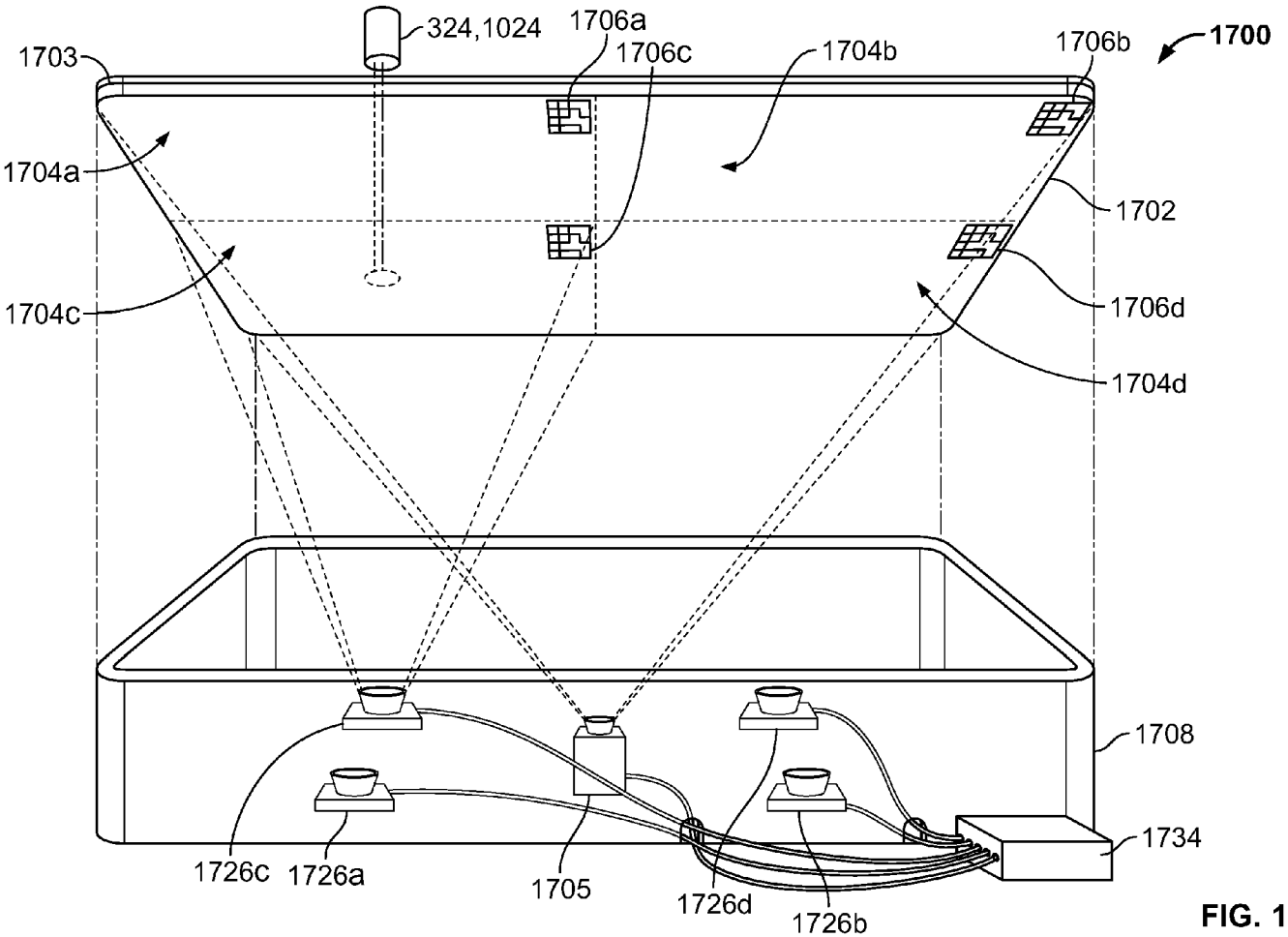
FIG. 17 is a functional block diagram of a gaming system having a display that has four sections with a tag defining each section.

FIG. 17 is an exploded perspective view of a functional diagram of a gaming system 1700 having multiple imaging devices 1726*a-d* positioned below a bottom surface of a display 1702 within a base 1708 of the gaming system 1700. The imaging devices are cameras having a resolution of 1600×1200 under natural light. The gaming system 1700 operates a wagering game, such as any of those described above and in a similar manner. Due to the constraints of optics and depending upon the size of the display 1702, more than one imaging device is provided to image the entire display surface. However, when multiple imaging devices (in this example, cameras) are present, there will be overlap in the field of view of each of the cameras. Therefore, the display 1702 is subdivided into sections or areas, one for each camera. In this example, there are four such sections 1704*a-d* shown. At the corner or boundary of each section 1704*a-d*, a section tag 1706*a,b,c,d* is disposed, which is visible only to the camera. A player viewing the top surface of the display 1702 would not be able to see the section tags 1706*a-d*. These section tags 1706*a-d* are also placed outside of the game-play space on the top surface of the display 1702 because the tags 1706*a-d* would interfere with the ability of the cameras 1726*a-d* to image any object placed over the tags 1706*a-d*. Although the section tags 1706*a-d* are shown in specific locations relative to the display in FIG. 17, in other implementations, they can be positioned in other locations, such as in the upper left, upper right, lower left, and lower left corners of the display 1702, along the edges of the display 1702, or in the center of the display 1702. Such locations would position the section tags 1706 in areas where they would be less likely to interfere with the game-play space on the top surface of the display 1702. Each section tag 1706*a,b,c,d* identifies the corresponding section 1704*a,b,c,d* that the corresponding camera 1726*a,b,c,d* will sense or image things placed on the top of the display surface 1702. The section tags 1706 can be any 2D or data matrix code, including the 2D code 1900, 1920 described below in connection with FIGS. 19A-19B.

Alternately, in stead of using section tags 1706, in a different implementation, each port number corresponding to the port to which each imaging device 1726 is connected is used to discern which imaging device 1726 is imaging an object on the display 1702. Software running on the controller 1734 segments the entire display surface 1702 into regions of interest, which are mapped respectively to the port numbers of each of the imaging devices 1726. The display 1702 can include a multipoint sensing device, as described above, and can include a light diffuser substrate 1703 composed of ground glass to permit video images projected thereon by a projector 1705 to be visible to the players under ambient lighting conditions. A light diffuser substrate 1703 composed of ground glass (such as from American Science & Surplus) has been found to provide the appropriate balance of opacity and transparency needed to obscure the components below the display 1702 from the player while allowing the video images projected onto the light diffuser substrate 1703 to be visible to the players under ambient lighting conditions. Other examples of suitable light diffusers 1703 include frosted acrylic, such as from Menard or Pease Plastics, rear projection material from 3M, light diffusing acrylic from JimR, milk white acrylic from Pease Plastics, acrylic from Endlighten, or frost film. Acrylic ground glass or thicker ground glass can be used to strengthen the substrate against cracking or damage from frustrated players. Preferably, the substrate of the display 1702 includes thin ground glass with a thick acrylic support or an acrylic ground glass made with fine grit sandpaper.

It should be noted that the light diffuser substrate 1703 is positioned closest to the object 324, 1024 on which a 2D code is disposed. The object 324, 1024 is placed directly on the light diffuser substrate or in very close proximity to it (e.g., there may be a protective transparent layer over the light diffuser substrate), to ensure that any pattern on the bottom of the object 324, 1024 is focused and clear to the imaging devices 1726. It has been found that by placing the light diffuser substrate too far away on the display 1702 from the pattern on the object 324, 1024, the diffuser diffuses and scatters the light to such an extent that the pattern becomes blurry or unreadable to the imaging devices 1726 located below the display 1702.

A projector 1705 positioned below the display 1702 operates as a rear projection system, rear-projecting video images from underneath the display 1702 onto the display 1702. When the video images strike the light diffuser substrate 1703, they are visible on the other side through the light diffuser substrate 1703 by the player(s) of the gaming system 1700. The rear projection system has a high gain for tolerance of high ambient light, a half angle of 60 degrees or better, a sharp contrast ratio, HDTV resolution or better, uniform brightness, tolerates high ambient light, and has a matte front to deflect ambient light. Alternately, the projector can be positioned above the display 1702.

The section tags 1726*a-d* advantageously avoid the need for any special cabling or addressing techniques for the imaging devices 1726*a-d* to determine which section of the display surface 1702 the imaging device 1726*a-d* is imaging. The section tags 1704*a-d* are read by the imaging devices 1726*a-d* upon boot up of the gaming system 1700. Imaging devices 1726 that become broken can be easily replaced without any additional setup or configuration of the replacement imaging device.

The section tags 1706*a-d* are two-dimensional codes, such as any of the 2D codes mentioned above, including the Mosey code, shot code, Semacode, QR code, ColorZip code, or the 2D code 1900, 1920 described below. The imaging devices 1726*a-d* include a USB, Firewire (IEEE 1394), or Ethernet connection so that they can be networked via a network controller 1734 to a network. The location of each imaging device throughout a gaming establishment can be tracked via the section tag 1706. The location of a rogue or unscrupulous player can be quickly tracked by the section tag 1706 and an EWID 324, 1024 used by the player. The ability to locate players throughout a gaming establishment provides enhanced security for all patrons and the gaming establishment and can also be used for marketing purposes to determine, for example, traffic or interest in a particular wagering game.

In various aspects disclosed herein, there is contemplated optical tag reading in a wagering game environment. Optical tag reading involves the use of cameras or imaging devices to recognize optical tags. An optical tag can include a sticker or a casino chip on which player or object identifiers are printed or disposed in the form of a two-dimensional (2D) code or can include the pips on the surface of dice, to name a few examples. Numerous other ways of disposing an optical tag on a device used in a wagering game environment such as a casino are contemplated and disclosed herein.

Figure 18:
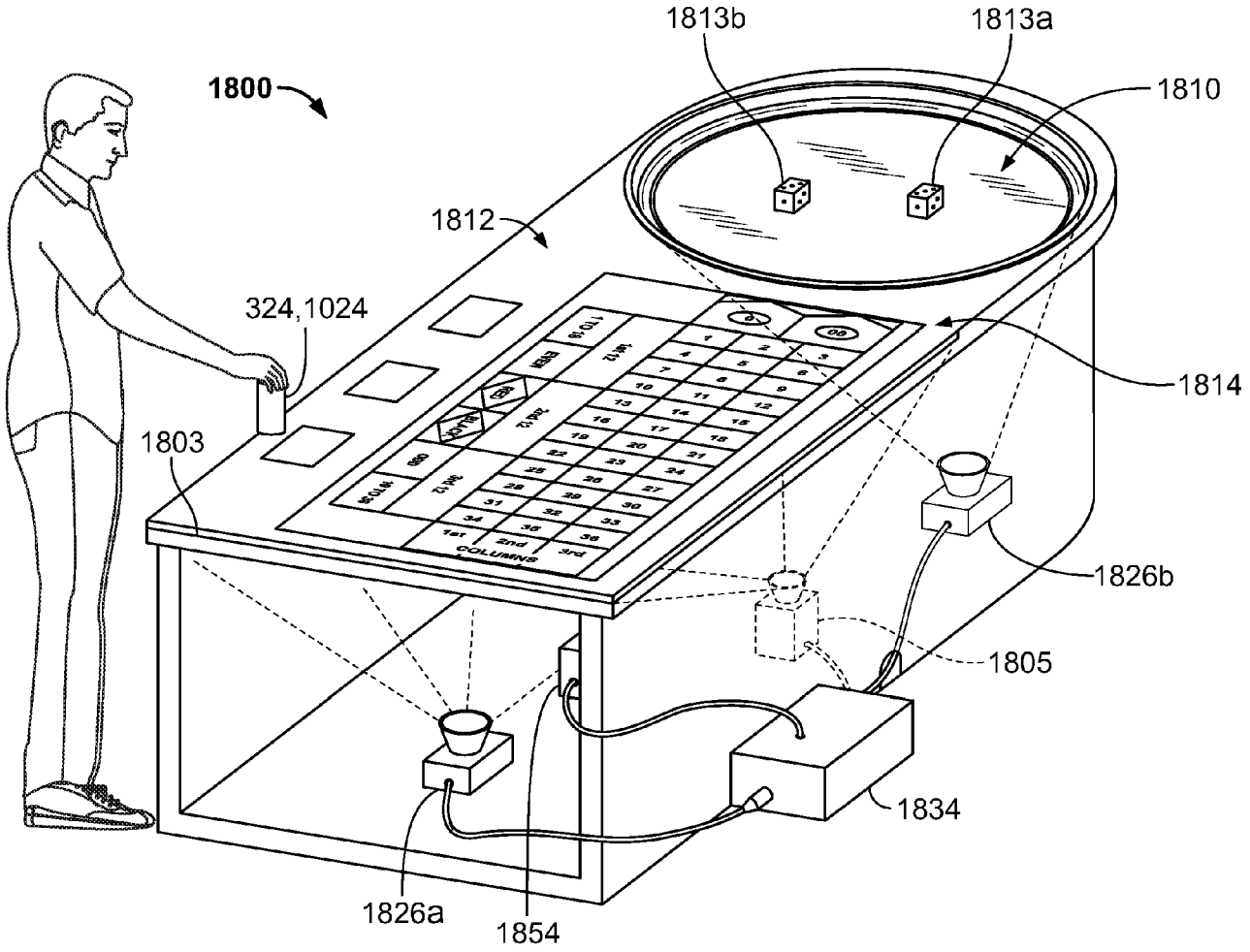
FIG. 18 is a functional block diagram of a gaming system having two cameras, one for imaging a display on which the player places an EWID and one for imaging dice thrown by a player into a designated dice-throwing area.

FIG. 18 is an example of a gaming system 1800 that includes an optical tag reading system. The gaming system 1800 includes two imaging devices 1826*a,b* for optical tag reading and a projector 1805 for rear-projection of video images of a wagering game onto a light diffuser substrate 1803 disposed proximal to the player. In this example, the wagering game being rear-projected is illustrated in FIG. 18 as being roulette, but it can be any wagering game, such as craps. The first imaging device 1826*a* is positioned under a game play area 1814 of a display 1812 of the gaming system 1800. Optionally, the first imaging device 1826*a* includes an infrared sensor to detect infrared light emitted or reflected from the electronic wager input device 324, 1024. The first imaging device 1826*a* images optical tags placed on or in close proximity to the top surface of the display 1812 sufficient to permit the first imaging device 1826*a* to image the optical tag. The optical tag is displayed on or via an electronic wager input device 324, 1024, such as described above, or any other handheld object carried by the player disclosed herein above or below. The optical tag associated with the EWID 324, 1024 or other handheld device encodes identification information associated with the player, such as a player identifier. This identification information is used to identify the person carrying the EWID 324, 1024 and optionally to access that person's account for purposes of placing wagers or transferring, debiting, or crediting funds, for example.

The gaming system 1800 includes a second imaging device 1826*b* that is positioned under a second game play area 1810 on the gaming system 1800. Two dice 1813*a,b* are shown with conventional pips on their respective faces. The dice can be related to the wagering game being rear-projected onto the game play area 1814 (such as craps) or can be related to a bonus or other wagering game. The second imaging device 1826*b* images the pips on the dice 1813*a,b*, and those images are converted into a number corresponding to the number of pips via a controller 1834 as described above. Basically, what is contemplated in FIG. 18 is that a gaming system can use an imaging system simultaneously for both player identification and object identification (in the illustrated example, identifying pips on the dice 1813). Of course, any imaging system disclosed herein can be used solely for the purpose of player identification or solely for object identification, but both purposes are also contemplated herein.

An advantage of optical tag reading is that it increases player engagement and interaction with the gaming system 1800. With tags associated with both objects (such as dice) and players (via a player identifier), the gaming systems herein can associate players with objects in any forms and provide a much richer and more exciting game play experience than previously possible. Players do not need to sit in any special chairs or stand on special pads to be identified to the gaming system nor do their bodies need to complete an electrical circuit for their identity to be distinguished from other players at the gaming system.

There are several conventional 2D codes, including data matrix codes, that are well known, and those conventional 2D codes are contemplated as acceptable optical tags. However, a new 2D code is proposed herein and will be described next with reference to FIGS. 19A-19B. It should be understood that the new 2D code proposed herein can encode any data. Specific examples will be described next, but it should be understood that the new 2D code described below can encode any data that conventional 2D codes can encode in addition to the data specifically discussed below, including any information that is stored in a conventional player tracking card used in wagering game environments. The new 2D code can be applied to any handheld object carried by the player described herein, including the electronic wager input device 324, 824 disclosed above.

A 2D code 1900 is shown in FIG. 19A, which includes a base pattern 1912 and non-overlapping coded images 1908 in the form of colored circles arranged about the center of an object on which the 2D code is provided. The object can be in the shape and form of a poker chip or any of the other form factors described herein, including the EWID 324, 1024. It should be understood that the 2D codes described herein can be provided with any handheld object carried by the player described herein, including the EWID, a poker chip, a mobile phone as discussed further below, or an object used to play a wagering game such as a baseball bat as discussed below.

The base pattern 1912 is provided in an authentication area 1904, which is imaged by an imaging device (not shown) and detected using a conventional pattern recognition algorithm. The base pattern 1912 preferably has an asymmetric shape. In the example shown, the base pattern 1912 resembles an asymmetric arrowhead. The base pattern 1912 corresponds to a trademark of the assignee of the present disclosure, which further promotes the brand of the provider of the 2D code.

The 2D code is contained within a region of interest, defined by the outer circumference of the region of interest 1902. To detect the region of interest, the image of the 2D code can search for the largest circle or a circle having a dimension greater than a threshold that is also greater than a dimension of the coded images of the 2D code. Note that there are no coded images 1908 in the authentication area 1904. The imaging device locates the base pattern 1912 using conventional pattern matching techniques, and a coordinate system 1906 is established based on the located base pattern 1912. In the example shown, the origin (0,0 coordinate) of the coordinate system 1906 is centered at the point where the two halves of the arrowhead-like pattern 1912 meet in the rear. Due the asymmetrical nature of the base pattern 1912, this point of origin of the coordinate system 1906 can be readily located even with low resolution imaging techniques and is also unique under rotation. Based on the orientation of the base pattern 1912, the orientation of the object (e.g., poker chip) on which the 2D code is disposed can also be determined.

Once the coordinate system 1906 has been established, the locations of the coded images 1908 are found within the region of interest based on the coordinate system 1906. One exemplary coordinate is shown in FIG. 19A, where the center of the coded image 1908 has (x,y) coordinates 1916*a, b*. The coded image 1908 is black, whereas the absence of coded images, designated by circles 1910, are white (or at least non-black). The circles shown in FIG. 19A need not actually be displayed on the 2D code 1900. In this example, a coded image can have one binary color, meaning each coded image can encode 1 bit of information. In other examples, shades of gray or colors can be used for the coded images to encode n bits of information depending upon the resolution of the imaging device.

The region of interest is optionally divided into a number of areas (m), and an optional matrix is created containing m cells. Each cell corresponds to a position within the region of interest of a possible coded image, and the value of the cell corresponds to the binary value of the color of the coded image. In the illustrated example, the matrix cell corresponding to the position of the coded image 1908 (located at coordinate position 1916*a,b*) has a value of 1. The total amount of information that can be encoded into a 2D code is represented by $2^{mn}$, where n is the number of bits represented by the coded image.

A pattern matching or shape detection algorithm locates each valid coded image 1908 and its respective coordinates on the coordinate system 1906. The size (e.g., diameter) of the coded image can also be determined to validate whether a candidate coded image is valid. Size detection avoids the possibility that smaller specks of dust or dirt on the 2D code 1900 could be mistaken for a valid coded image. A size threshold establishes a minimum size for coded images to be valid.

Based on the x,y locations of the coded images 1908 on the coordinate system 1906, a code number (which can include numeric only or alphanumeric characters) is determined either directly from the coordinates or based on the matrix. For example, the matrix can be mapped to a particular code number, which can be a player identifier, and each permutation of the matrix can be mapped to distinct code numbers. Alternately, a code number can be calculated directly from the coordinates of the located coded images 1908. To do so, each coded image 1908 may be assigned a number, and the code number is calculated by adding together all of the numbers or values associated with the coded images 1908.

The 2D code 1900 can be quickly and easily encoded and decoded. This new 2D code is very simple, requiring detection of a single base pattern 1912 in an authentication area 1904, establishing a coordinate system 1906 from that base pattern, detecting coded images 1908 from the coordinate system 1906, and determining a code number from the locations of the coded images 1908 on the coordinate system 1906. The base pattern 1912 is the only image on the 2D code from which the coordinate system 1906 is established and from which an orientation of the object is determined. No other images are required to establish the coordinate system 1906, further simplifying encoding and decoding.

A center 1914 of the 2D code 1900 can be transparent (or partially translucent) to permit light to be projected through the center 1914. When an object displaying the 2D code is placed on the surface of a display, for example, a value associated with the object can be projected through the transparent center 1914 such that the value is visible to the player. The value can be, for example, an amount wagered. Alternately, the center 1914 can include a liquid crystal display that displays a value associated with the object, such as a wager amount.

The 2D code itself may be printed on a sticker or any other conventional printing technique. Alternately, the object may include e-paper, and the 2D code, together with the base pattern 1912 and the coded images 1908, are displayed on an electrophoretic display. E-paper has a high resolution, are both human and machine readable, require no power to maintain an image on the display (it only requires power to modify the displayed image), and is low cost and relatively durable.

For security reasons, it can be desired to avoid having the coded images visible to the player. Although the information encoded in the 2D code can be encrypted, rendering the coded images invisible to the player adds an additional layer of security. Thus, the coded images 1908 can be coated with a reflective or absorptive infrared composition (e.g., infrared paint or beads) such that the coded images 1908 are not visible to the human eye. The imaging device includes an infrared sensor, which detects the coded images 1908 by reflecting infrared light off of the coded images 1908. Instead of painting the coded images 1908 with an infrared composition, the object on which the 2D code is displayed can include a monochrome LCD display that is backlit by infrared light. The coded images 1908 are thus displayed in the infrared wavelengths and are detectable by an infrared sensor. The ambient light in the wagering game establishment will not interfere with infrared light, making it easier to detect the coded images and base pattern on the 2D code.

The coded images 1908 encode identification information associated with a player or object information about a type of an object used to play a wagering game, such as a baseball bat, described in more detail below.

FIG. 19B shows another type of 2D code 1920 that uses a pattern of coded images 1928 in the shape of bars arranged in concentric circles about a central point of a region of interest 1922. Like the 2D code 1900 shown in FIG. 19A, the 2D code 1920 shown in FIG. 19B also includes a base pattern 1932 within an authentication area 1924, a coordinate system 1926 whose origin is based on a point on the base pattern 1932, and a center 1934 that can be transparent or include an LCD display for displaying wager amounts or other values associated with the object. Again, there are no coded images 1928 that overlap the base pattern 1932, from which the coordinate system 1926 is established.

Instead of locating the colored bars representing the coded images 1928 via their respective coordinates on the coordinate system 1926, an starting edge 1940 can be determined from the coordinate system, where the coded images 1928 start to appear. This starting edge 1940 defines a starting edge for locating all of the coded images 1928 around the concentric circles (there are two concentric circles in the illustrated example). Each bar may be defined to include a certain number of degrees, depending upon how many bars can be disposed about the concentric circles, except in the area where the base pattern 1932 is located. For example, if each "pie slice" (segment) of the circle is 10 degrees, and 60 degrees are reserved for the base pattern 1932, then there can be a maximum of 30 bars (30×10 degrees=300 degrees) that can be populated with coded images. The size of each segment about the region of interest 1922 can be based upon the amount of information desired to be encoded in the 2D code 1920 and the resolution of the imaging device. Once the edge radius 1940 is located, the presence 1928 or absence 1930 of a coded image is detected starting at the starting edge 1940 and circling around each of the concentric circles until arriving at a stopping edge 1942. Alternately, the coordinates of each coded image 1928 can be determined based on the coordinate system 1926 as described above in connection with FIG. 19A. The center 1934 of the 2D code 1920 can be used in the same manner as described above with reference to the 2D code 1900.

Although a somewhat regular pattern of coded images in FIG. 19A is shown and a regular pattern of coded images arranged in concentric circles is shown in FIG. 19B, alternately, a random or other pattern of non-overlapping coded images can be provided on the 2D code. The coordinate system allows any point in the region of interest to detect the presence or absence of a coded image, so as long as they do not overlap and are within the imaging device's resolution, they can be arranged in any non-overlapping pattern so long as they do not also overlap with the base pattern or impinge on the authentication area of the 2D code.

Figure 20:
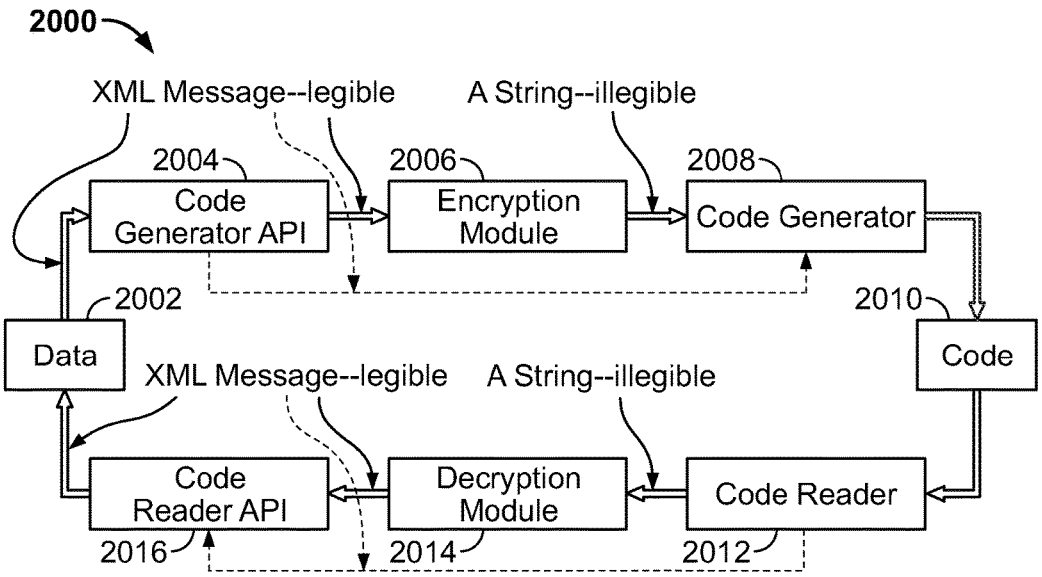
FIG. 20 is a functional block diagram of an encryption algorithm for encrypting data to be encoded into a 2D code.

FIG. 20 is a functional block diagram of an encryption algorithm 2000 for encrypting the information encoded in the 2D code 1900, 1920. The data 2002 to be encoded is, for example, identification information associated with a player or an object identifier that includes information about the type of object on which the 2D code is displayed, or any other data, such as a URL, player preferences. The data is preferably formatted as an XML message and passed to a code generator API 2004, which may include a web service.

The API 2004 passes the XML message to an encryption module 2006, which encrypts the data according to any conventional encryption technique, or bypasses the encryption module 2006 by sending the XML message directly to a code generator 2008. The code generator 2008 generates a 2D code 2010, such as the 2D code 1900, 1920. In one example, the code generator generates a matrix, where each cell of the matrix of the 2D code 1900, 1920 corresponds to the presence or absence of a coded image to be displayed on the 2D code 1900, 1920.

The 2D code 2010 is decoded in a code reader 2012, which extract the code number corresponding to the 2D code using the imaging and decoding techniques described above. A conventional Reed-Solomon algorithm can be used for error check and correction. If the original message was not encrypted, the code reader 2012 passes the decoded message (preferably in XML format) to a code reader API 2016, which extracts the data 2002 from the XML message. If the original message was encrypted, the code reader 2012 passes the decoded message to a decryption module 2014, which decrypts the decoded message using the reverse encryption method used in the encryption module 2006.

Figure 21:
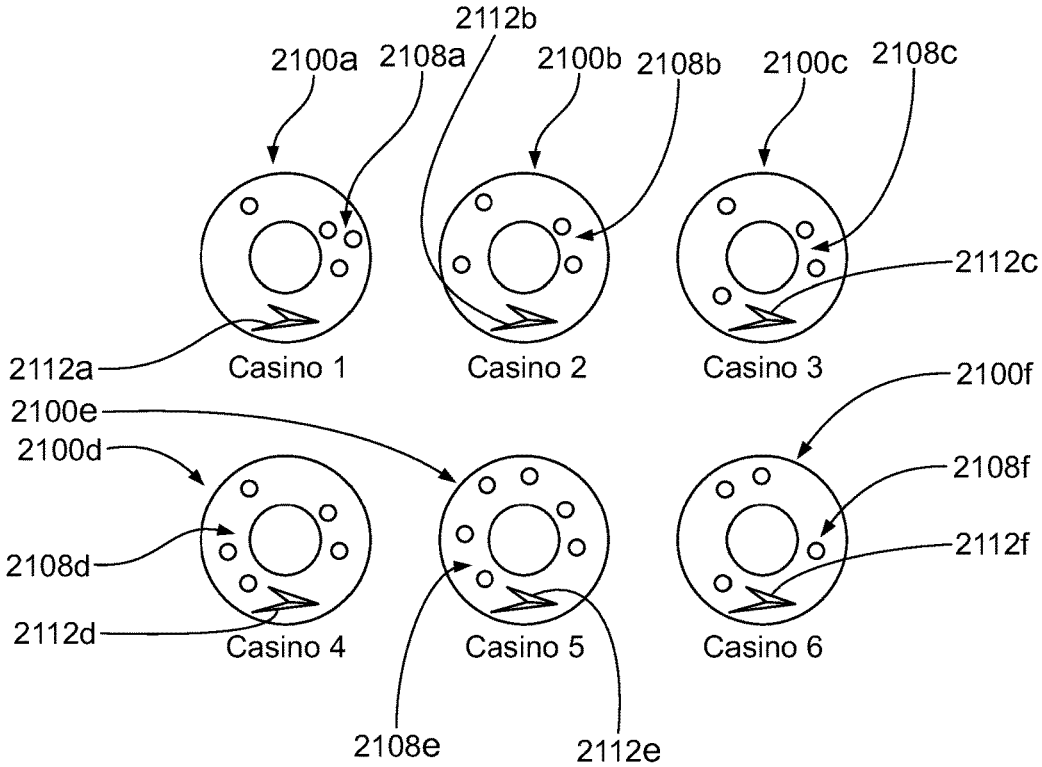
FIG. 21 is an illustration of six different 2D codes provided on different objects that can be used in different casinos.

FIG. 21 are illustrations of various 2D codes 2100*a-f* that can be used in different casinos. Each respective 2D code 2100*a-f* includes coded images 2108*a-f* and a base pattern 2112*a-f* as described above. Each set of coded images 2108*a,b,c,d,e,f* has a different pattern from all the other coded images. A player can store these 2D codes 2100 in, for example, a mobile phone as a graphic image. The player's identification information is associated with each of the 2D codes used at the particular casino. When the player desires to play a wagering game on a gaming terminal in Casino 1, the player calls up the 2D code 2100*a* that is associated with that player's identity at that casino. When the player desires to play a wagering game on a gaming terminal in Casino 2, the player calls up the 2D code 2100*b* that is associated with that player's identity at that casino. These aspects are discussed in more detail in connection with FIGS. 25A-26C below. Each respective casino can generate its own respective 2D code 2100*a-f*, or the 2D codes can be generated by a manufacturer of the device on which the 2D code is displayed. These 2D codes 2100*a-f* can be stored as graphic images (e.g., in JPG or TIFF format) in the player's tracking card, the player's mobile phone, the player's E-wallet, or on any other electronic device carried by the player.

An E-wallet is an electronic device that includes a display and a storage device and is readable by an imaging system. An example of an E-wallet is the EWID 324, 824, 1024 described herein. Data stored on the E-wallet is encrypted and can be protected by a password or other information known only to the player.

Figure 22:
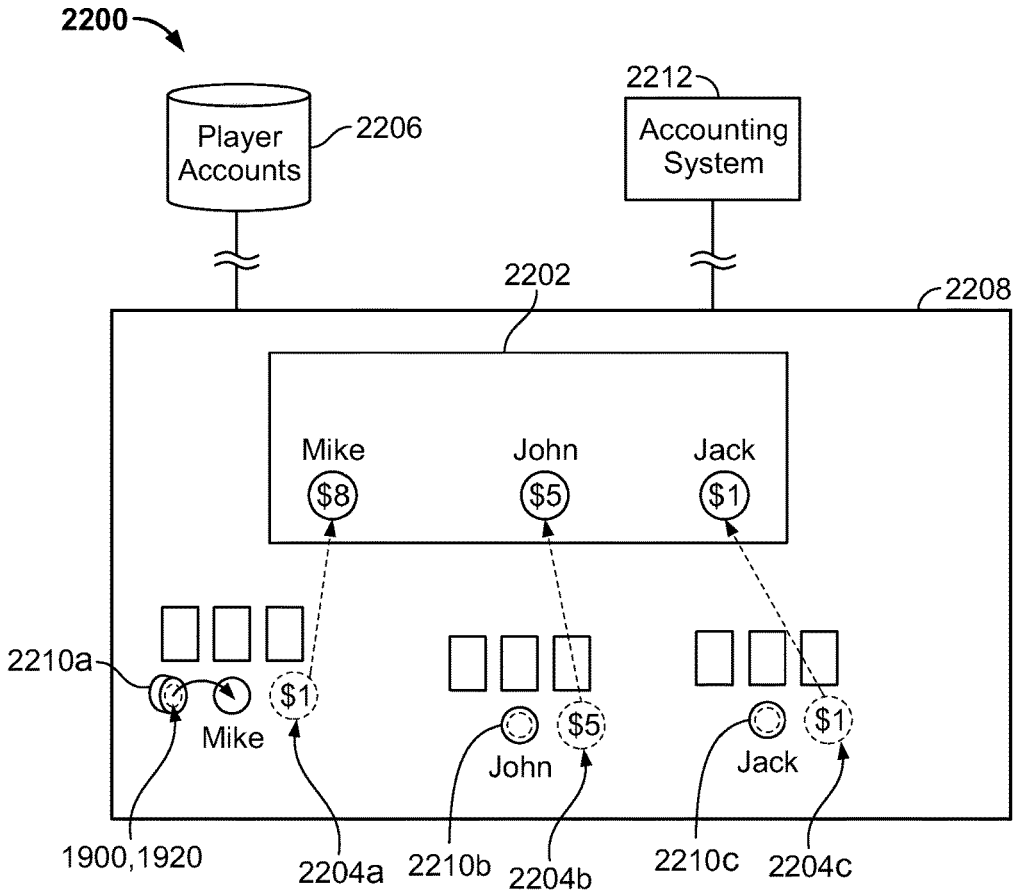
FIG. 22 is a functional block diagram of a multi-player gaming system in which players place objects bearing 2D codes onto a display to identify themselves and place wagers that are deducted from respective remote player accounts of each player.

FIG. 22 is a functional block diagram of a gaming system 2200 having a display 2208 on which E-wallets 2210*a-c* are placed. Each E-wallet 2210*a-c* displays a 2D code 1900, 1920 as disclosed above on a bottom surface of the E-wallet such that when the E-wallet is placed on the surface of the display 2208, an under-mounted imaging system can image and decode the 2D code. Each E-wallet 2210*a-c* is associated with a different identification information associated with a player. Each identification information associated with each player (Mike, John, and Jack) is stored in a player accounts database 2206, which is remote from the gaming system 2200. Each player can also place an EWID 2204*a,b,c* or conventional chips on the display 2208 for placing wagers in a wagering area 2202 on the display 2208. Each wager amount is associated with the player who placed it there.

In the following scenario, the player uses an E-wallet in an account-based wagering system, such as shown in FIG. 22. The player obtains a 2D code associated with the player's account from a casino or wagering-game establishment. The casino generates or receives a 2D code and associates it with identification information associated with the player. An image of the 2D code is stored in the E-wallet through a wired or wireless link or via a camera in the E-wallet. The player deposits funds into his account in the accounting system 2212, which can be remote from a gaming terminal or even remote from the gaming establishment.

To play a wagering game, the player enters a password or PIN number into the E-wallet, which communicates a representation (e.g., encrypted representation) of the password or PIN number to a remote account server that authenticates the password or PIN number. The E-wallet also displays the 2D code. Until a valid password or PIN number is entered and authenticated by the remote account server, the E-wallet does not display any 2D code. Note that as mentioned above, the 2D code may be visible only under infrared light.

The player faces the E-wallet to a camera of a gaming terminal. In the case of a table gaming system, the player places the E-wallet down on the surface of the table display. The gaming system images and decodes the 2D code and stores the corresponding identification information associated with the player.

The gaming machine displays different chips 2204*a-c* around the E-wallet for the player to place wagers. To place a wager, the player touches a chip on the display 2208 and drags it to the wagering area 2202. To increase the wager, the player can drag another "chip" to the wagering area 2202. Once the chips are placed into the wagering area, the gaming system 2200 notifies the accounting system 2212 to deduct the wager amount associated with the player who placed the wager by an amount corresponding to the amount wagered. The gaming system 2200 optionally displays the player's name or screen name and the wager amount on the display 2208. The wager amount can also be displayed through or on the E-wallets 2210*a-c* when they include a transparent substrate or an LCD as described above. The accounting system 2212 deducts the wager if there are sufficient funds in the player's account 2206, and the wagering game accepts the wager from that player. If the player does not have sufficient funds in his account 2206, the accounting system 2212 notifies the gaming system 2200 to reject the wager from that player and it does so. The gaming system 2208 also notifies the accounting system 2212 of any winning outcome, and credits the player's account 2206 with an amount commensurate with the winning outcome. Note that the player accounts 2206 may be part of the accounting system 2212 or may be communicatively linked to it.

In the foregoing scenario, the 2D code encodes identification information associated with the player and thus serves as a player ID card. No wired or wireless communication with the gaming system 2200 is required. The transaction history of wagers placed by which players and their winnings if any are recorded by the accounting system 2212 and optionally recorded also by the gaming system 2200. Players no longer need to carry many different player ID cards for different casinos.

Another advantage to the imaging system for imaging 2D codes is that players can switch seats and yet the gaming system 2200 can still recognize which players have placed wagers. For example, if Mike and John switch seats at the gaming system 2200 (taking their respective E-wallets with them), when Mike places his E-wallet 2210*a* back on the display 2208, the imaging system recognizes Mike's new location at the table and displays "chips" around Mike's newly positioned E-wallet 2210*a* for Mike to place wagers.

Figure 23A:
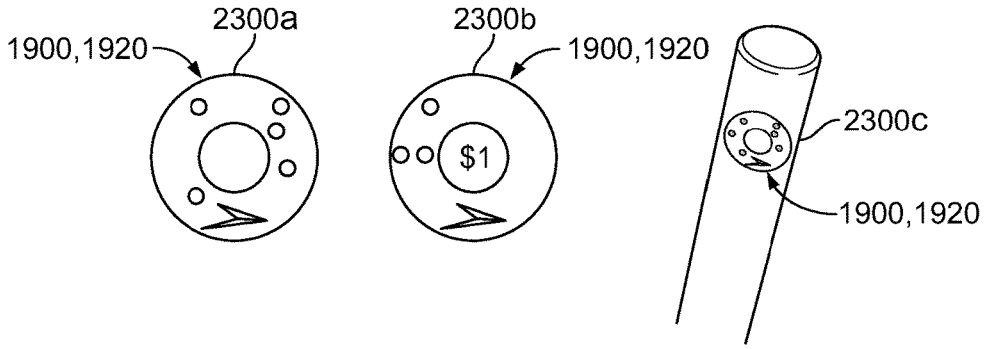
FIG. 23A is an illustration of three 2D codes, one encoding identification information associated with a player, one encoding object identification information associated with an object used to play a wagering game, and one encoding both player identification information and object identification information.
Figure 23B:
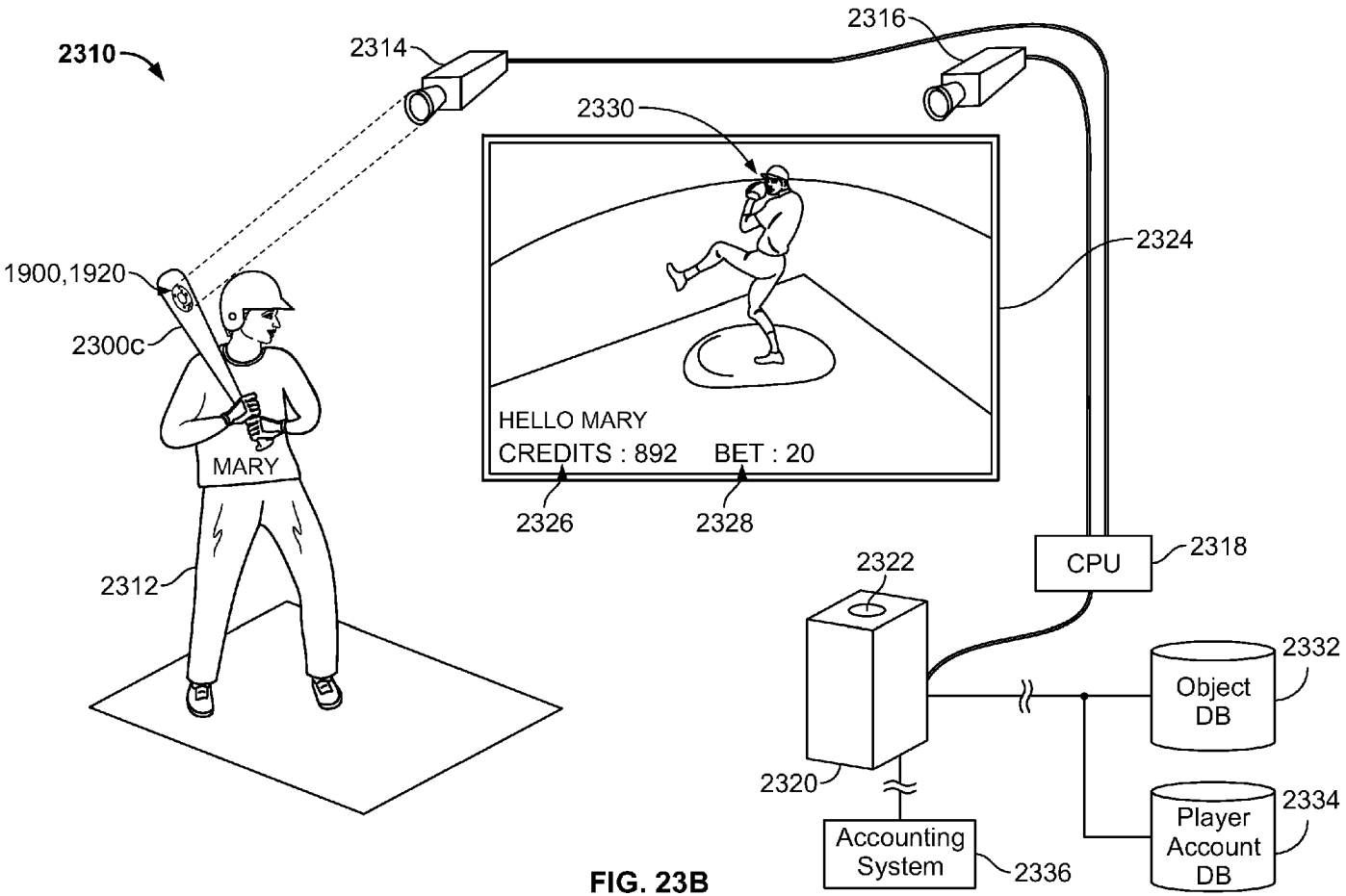
FIG. 23B is a functional block diagram of a gaming system in which the player holds a bat that bears a 2D code, which is used during the wagering game to cause an outcome to be randomly selected.

As mentioned above, a 2D code can represent a player ID or an object ID. In FIG. 23A, the E-wallet or EWID 2300*a* includes a 2D code 1900, 1920 that encodes identification information (e.g., the player's name or player's account number) associated with a player. The object 2300*c* includes a 2D code 1900, 1920 that encodes object identification information about the type of object (e.g., a baseball bat as shown in FIG. 23B). The E-wallet or EWID 2300*b* includes a 2D code 1900, 1920 that encodes both player identification information and object identification information in a single 2D code.

In another scenario, object identification information is encoded onto a 2D code, which is displayed on an object used to play a wagering game in a gaming system 2310. In FIG. 23B, a player 2312 holds an object 2300*c*, here a baseball bat, which displays a 2D code 1900, 1920, which may be a sticker. The player 2312 obtains a 2D code that encodes identification information associated with that player 2312. The casino generates or receives the 2D code, which is stored on a player's E-wallet or mobile phone. The casino can associate a password or other personal code or attribute (such as a biometric attribute) with the 2D code for authenticating the player's use of that 2D code.

The player presents the 2D code to an imaging device of the gaming system 2310. For example, a player/object registration device 2320 includes an area 2322 for presenting 2D codes and an imaging system (not shown) for imaging 2D codes presented in the area 2322. The player presents the 2D code displayed on his E-wallet to the area 2322, which decodes the identification information and accesses a player account database 2334 for the information about the player. An optional password or PIN number can be entered by the player to authenticate the 2D code.

The player 2312 shows an imaging device, such as the imaging device 2314 or the imaging system in the player/object registration device 2320, the 2D code displayed on or by the object 2300*c* for playing the wagering game 2330 displayed on a display 2324. A conventional controller 2318 controls the functions of the imaging devices 2314, 2316 and the object/player registration device 2320. The imaging device that imaged the 2D code on the object 2300*c* decodes the object identification information encoded in the 2D code, and accesses an object database 2332 to determine the type of object held by the player (in this example, a baseball bat). Another imaging device 2316 can be implemented to detect movements and velocities of the object 2300*c* as the player is playing the wagering game 2330. The object 2300*c* is related to a theme of the wagering game 2330. In this example, the theme is a baseball game, so the object 2300*c* is a baseball bat. The display 2324 also displays the number of credits 2326 available to the player 2312 and the amount wagered 2328 by the player on the wagering game.

Once the type of object has been identified by accessing the object database 2332, the object identification code is associated with the player identification information such that the player 2312 is now associated with the object 2300*c*. The gaming system 2310 now "knows" the identity of the player 2312 (and the player's name or screen name can be displayed on the display 2324) and that this player is holding the baseball bat 2300*c* as opposed to other objects or tools that can be used by other players to play other wagering games in the casino. In this manner, different players can use the same baseball bat 2300*c*, so as long as they identify themselves by presenting their account-associated 2D codes to the gaming system 2310, the gaming system 2310 can track which players are holding which objects and the types of those objects.

The movement of the object 2300*c* causes the wagering game to change a scene on the wagering game and can be related to the game outcome. While the movement of the object itself may not directly affect the game outcome, it can be made to appear to affect it. For example, as the pitcher 2330 pitches the ball, it may already be predetermined at the moment the ball leaves the pitcher's hand what the game outcome will be. For example, it may be predetermined that the player will "strike out." Thus, no matter how the player swings the bat 2300*c*, the player will still strike out. Alternately, the movement of the bat 2300*c* can determine whether the player 2312 achieves a winning outcome. The imaging device 2314 ensures that the player does not switch objects in the middle of a wagering game session.

The player 2312 selects an amount to wager on the wagering game 2330, and that amount 2328 is displayed on the display 2324. The gaming system 2310 notifies an accounting system 2336 of the wager amount, which deducts it from the player's account 2334 if there are sufficient funds to cover the wager. If the randomly selected outcome of the wagering game is a winning outcome, an amount commensurate with the award is credited to the player's account 2334, and the accounting system 2336 records the transaction.

Figure 24A:
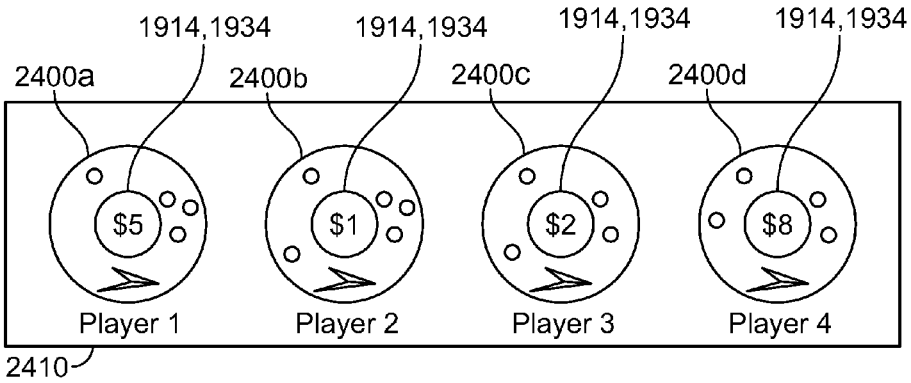
FIG. 24A is an illustration of four different 2D codes used by four different players to place wagers on a wagering game.

In another scenario, the player uses the E-wallet as electronic casino chips to place wagers on wagering games. FIG. 24A illustrates four E-wallets 2400*a-d* that are associated with four different players, and each E-wallet 2400*a-d* displays a 2D code like the 2D code 1900, 1920. The respective center 1914*a-d* of the E-wallets 2400*a-d* show a wager amount displayed on (in the case of an LCD) or through (in the case of projecting the wager amount through a transparent center of the E-wallet from below the display surface) the center 1914*a-d*.

Figure 24B:
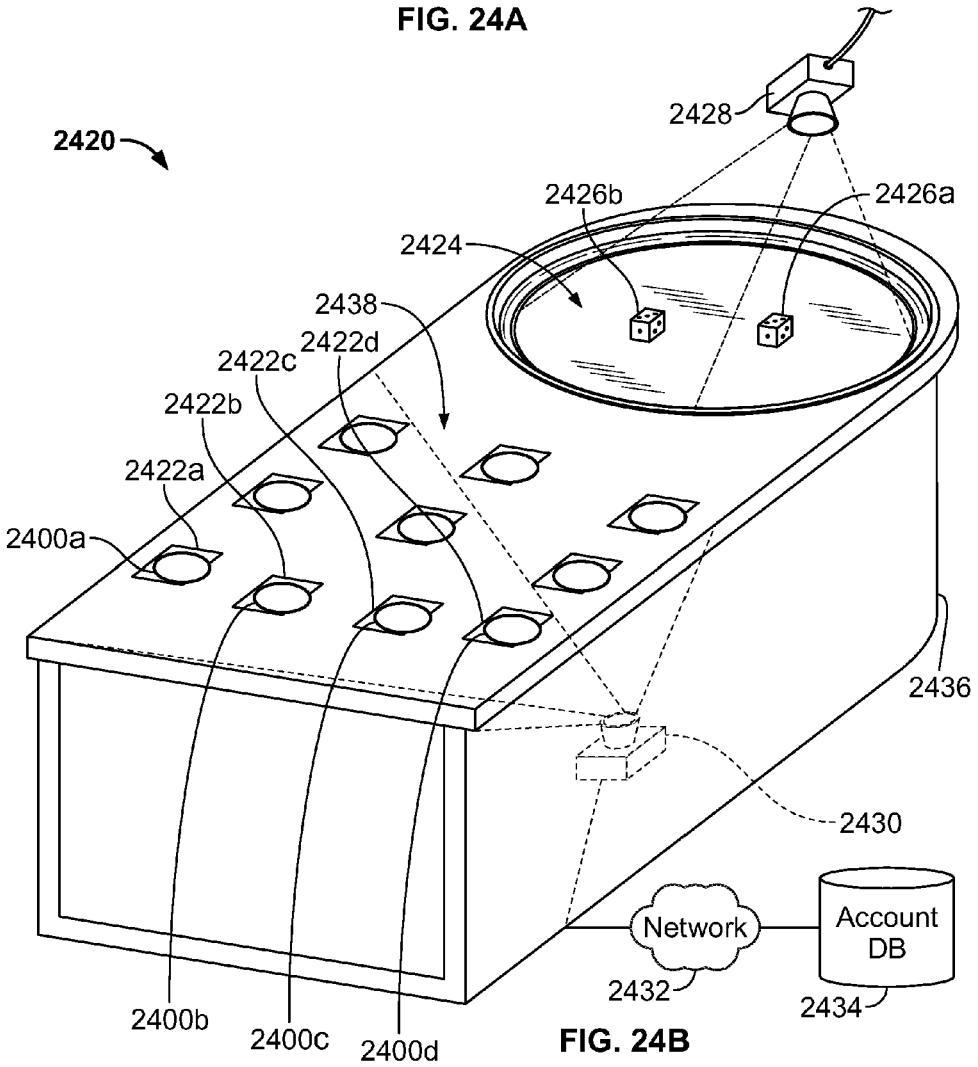
FIG. 24B is a functional block diagram of a gaming system in which players place objects bearing 2D codes on a display to place wagers on a wagering game displayed on the display.

In FIG. 24B, a group challenge wagering dice game is shown being played by 10 players. For convenience, four of the players' E-wallets 2400*a-d* are shown in designated wagering areas 2422*a-d* on a display 2438 of a gaming system 2420. The gaming system 2420 includes a dice throwing area 2424 in which a pair of dice 2426*a,b* are thrown. Players take turn throwing the dice 2426*a,b*, or when the dice are "virtual" dice displayed on a video display or projected by a projector, the dice appear to be thrown and come to a stop. An imaging device 2428 mounted above the dice 2426*a,b* throwing area 2424 image and determine the number of pips shown on the dice 2426*a,b* when they come to a rest after being thrown. Another imaging device 2430 mounted in a base 2436 below the display 2438 image the 2D codes displayed by the 10 players' respective E-wallets 2400*a-d*, and those images are decoded into corresponding identification information associated with each of the players, which is stored in an account database 2434 that is remote from the gaming system 2420 and coupled thereto via a network 2432. Each player's wager amount can be displayed on or through the E-wallets 2400*a-d* as described above. Alternately, one imaging device can be used to image the dice 2426*a,b* and the E-wallets 2400*a-d*.

The player who receives the highest dice number wins an award, and, if multiple players have wagered on the same dice number, the award is split in proportion to the respective amounts wagered by the winning players. The physical dice give the player a sense of control. The pips of the dice can be coated with an infrared coating or can display infrared patterns corresponding to the pips, and the imaging device 2428 can be an infrared sensor for detecting the infrared patterns on the dice. In this implementation, ambient light does not interfere with the infrared light, making detection of the pips easier in the presence of ambient light.

Figure 25C:
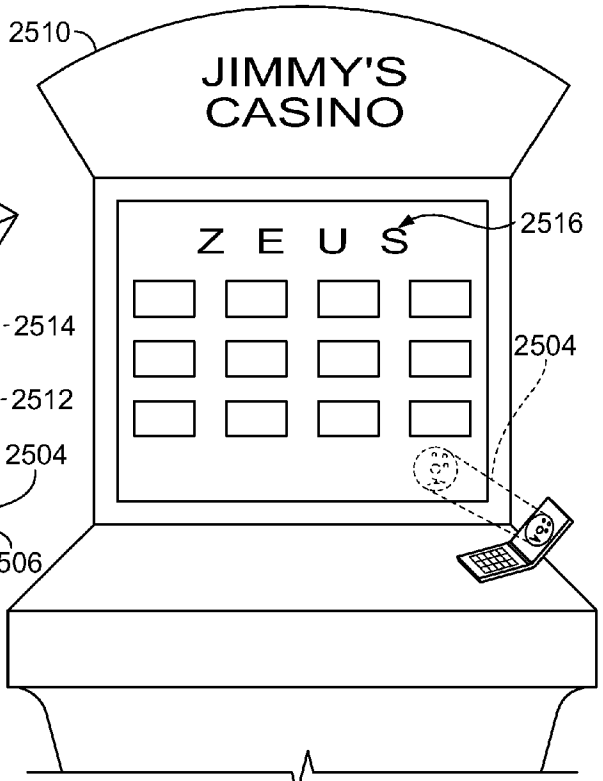
FIGS. 25A-C are illustrations of a sequence of actions by a player to capture an image of a 2D code on a TV screen and use the captured image to select a wagering game to play on a gaming terminal.
Figure 25B:
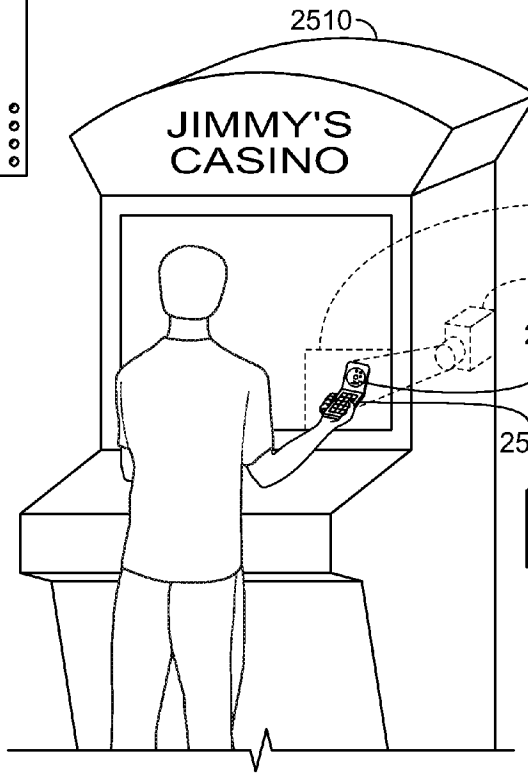
Figure 25A:
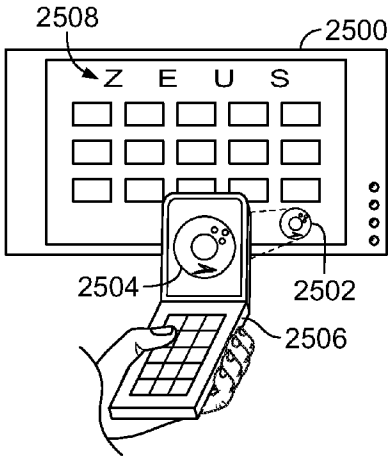

FIGS. 25A-C show how a player can use his mobile phone or other portable electronic device that includes an imaging sensor, such as a camera, to capture a 2D code that is displayed anywhere on any medium, then display that 2D code on the mobile phone and present the 2D code to an imaging device on a gaming terminal. In FIG. 25A, a television 2500 advertises and displays a wagering game 2508 that the player can play in the casino. In this example, the wagering game 2508 is called Zeus. An image of a 2D code 2502 is displayed on the television 2500. The 2D code encodes a particular wagering game, here called Zeus, as wagering game information. Note that this is an example of how the 2D code can encode information other than player identification information or object identification information, but rather can encode any other data relevant in a wagering game environment. The player captures an image of the 2D code 2502 by taking a picture of it with his mobile phone 2506 and stores it there. The player goes to the casino, and presents the mobile phone 2506 to an code reading area 2514 at a gaming terminal 2510 (of the "upright" type), which includes an imaging device 2512, such as a camera, that images the 2D code 2504 (shown facing the player for convenience), though the player would have to orient the image of the 2D code 2504 so that it can be imaged by the imaging device 2512. The gaming terminal 2510 does not display the game Zeus yet.

In FIG. 25C, the gaming terminal 2510 has recognized the 2D code, decoded it into wagering game information, looks up a table of wagering games to locate the wagering game (here "Zeus") corresponding to the wagering game information encoded in the 2D code 2504, and displays the wagering game 2516 corresponding to the 2D code 2504. In this manner, the player does not need to remember the name of a wagering game, and does not need to navigate through a menu of wagering games to locate the one he wants to play. Rather, he simply locates the image of the 2D code previously captured and stored on his mobile phone 2506, presents that image to an imaging device 2512 of the gaming terminal 2510, and the gaming terminal 2510 instantly calls up the wagering game corresponding to the 2D code.

The mobile phone can include software for decoding the 2D code into its representative data. For example, when the 2D code encodes a wagering game, the mobile phone converts the 2D code into data representing the wagering game, and can wirelessly transmit (e.g., via Bluetooth) that data to a gaming system for participation by the player in the wagering game on the gaming system. Wagers can be placed by the player wirelessly as well via the mobile phone or other wireless device.

Figure 26B:
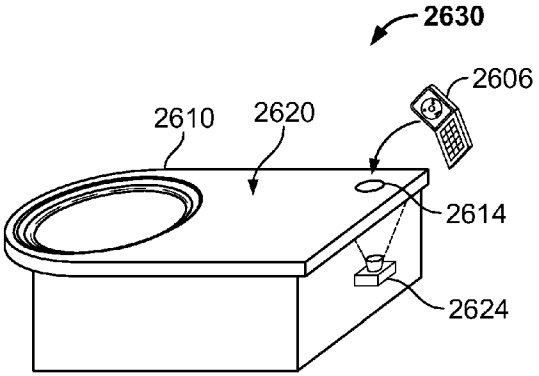
FIGS. 26A-C are illustrations of a sequence of actions by a player to capture an image of a 2D code on an advertisement poster and use the captured image to select a wagering game to play on a table wagering game.
Figure 26C:
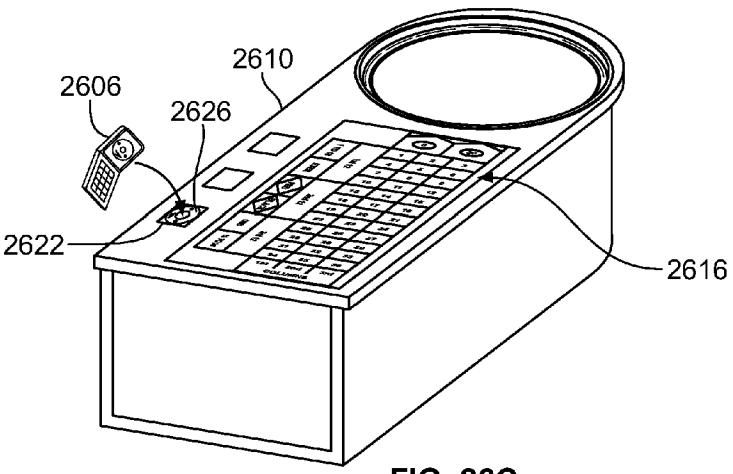
Figure 26A:
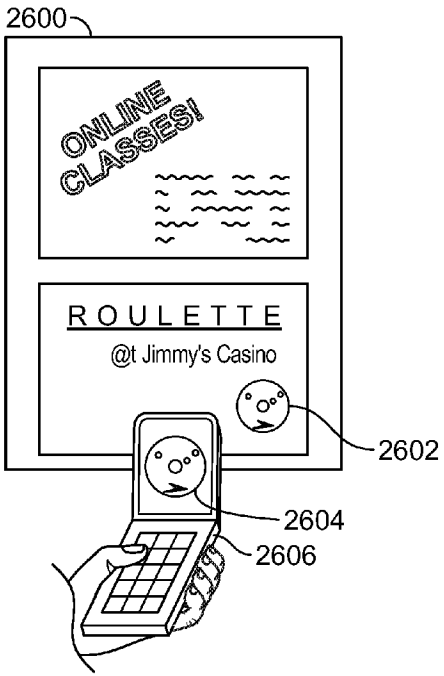

FIGS. 26A-C are similar to FIGS. 25A-C, except that the 2D code 2602 is displayed on a printed advertisement 2600 (note the different medium versus the television in FIG. 25A) and the gaming system 2630 resembles a table. In FIG. 26A, the player captures with a mobile phone 2606 an image of a 2D code 2602 displayed on a printed medium 2600 and stores that image on the mobile phone 2606. The 2D code corresponds to a particular wagering game, which in this example is a roulette wagering game. The player enters the casino and retrieves the stored image of the 2D code on the mobile phone 2606. The display 2610 of the gaming system 2630 is blank 2620 or does not display any particular wagering game yet. The player presents the image of the 2D code 2604 to a code reading area 2614 on the display 2610 of the gaming system 2630. An imaging device 2624 of the gaming system 2630 images the 2D code 2604, and the gaming system 2630 decodes the 2D code 2604 into the corresponding wagering game (here, roulette). In FIG. 26C, the gaming system 2630 has successfully decoded the 2D code 2604, determined that the associated wagering game is a roulette game, and displays the roulette wagering game 2616 on the display 2610.

Still referring to FIG. 26C, the player can retrieve a different 2D code 2626 stored on the mobile phone 2606, which corresponds to the player's identification information. The player now uses the mobile phone 2606, which displays the 2D code 2656, to place wagers on the wagering game 2616 by presenting the display of the mobile phone 2606 to a designated wagering area 2622 on the display 2610 of the gaming system 2630. In this scenario, the player stores at least two different 2D codes—one is used to select a desired wagering game to be played, and the other is used to identify the player to the gaming system to allow the player to place wagers with funds debited and credited from the player's remote account.

Figure 27A:
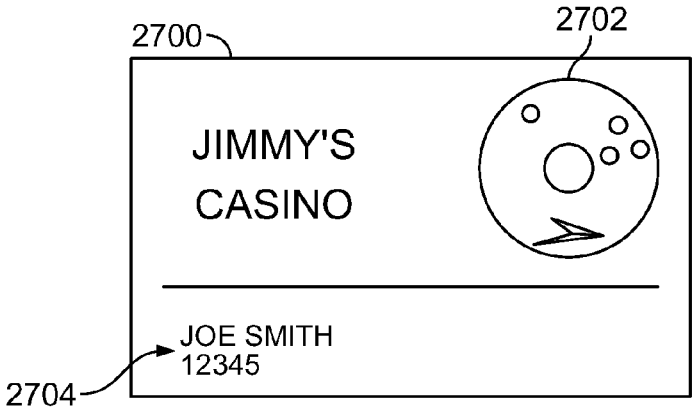
FIG. 27A is an illustration of a player tracking card bearing a 2D code that encodes player identification information.
Figure 27B:
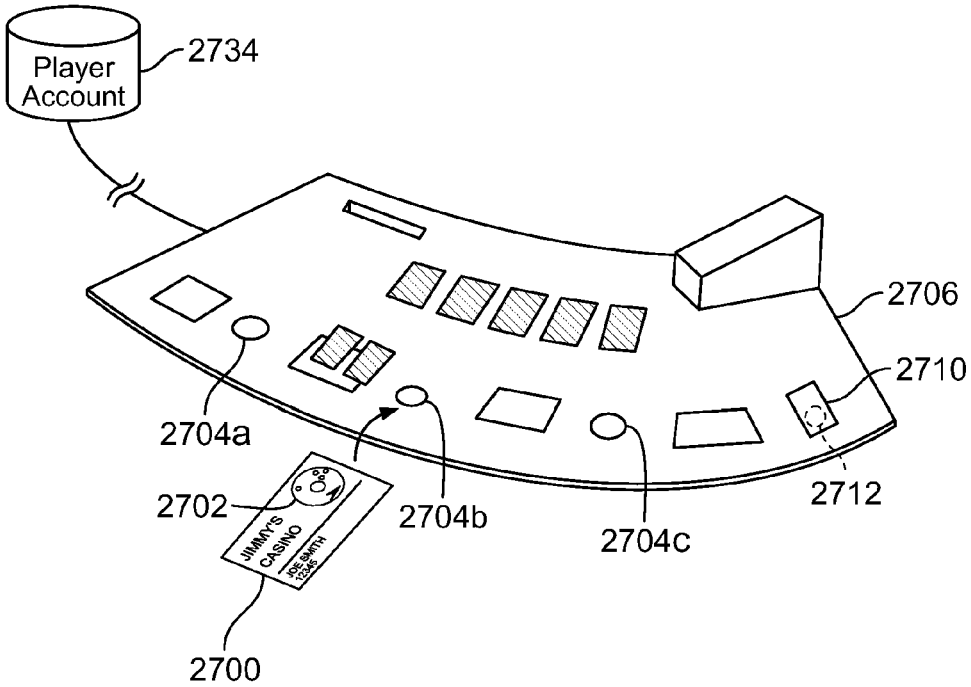
FIG. 27B is a functional block diagram of a wagering game in which the player places the player tracking card of FIG. 27A to identify himself to the wagering game.

While some of the above scenarios involve a 2D code that is displayed by a video display on an E-wallet, a mobile phone, or an EWID, in FIG. 27A, a 2D code 2702 is displayed on a player tracking card 2700 along with identification information 2704 associated with that player. The player enters the casino, sits down at a poker game, and places the tracking card 2700 in one of the code reading areas 2704*a-c* on the display 2706 of the wagering game such that an imaging system below the display 2706 can image the 2D code 2702, as shown in FIG. 27B. Another player can present his player tracking card 2710 bearing a 2D code 2712 to another code reading area 2704*a-c* to identify himself to the wagering game. A password or PIN number can be entered after detecting a valid 2D code to authenticate the player's identity from a remote player account server 2734. Once the player removes the tracking card 2710 from the code reading area 2704, the player account server 2734 disables any further access to the player's account. Thus, if another player attempts to place a wager after the player removes the tracking card 2710, the wagering game will reject the attempted wager.

Figure 28:
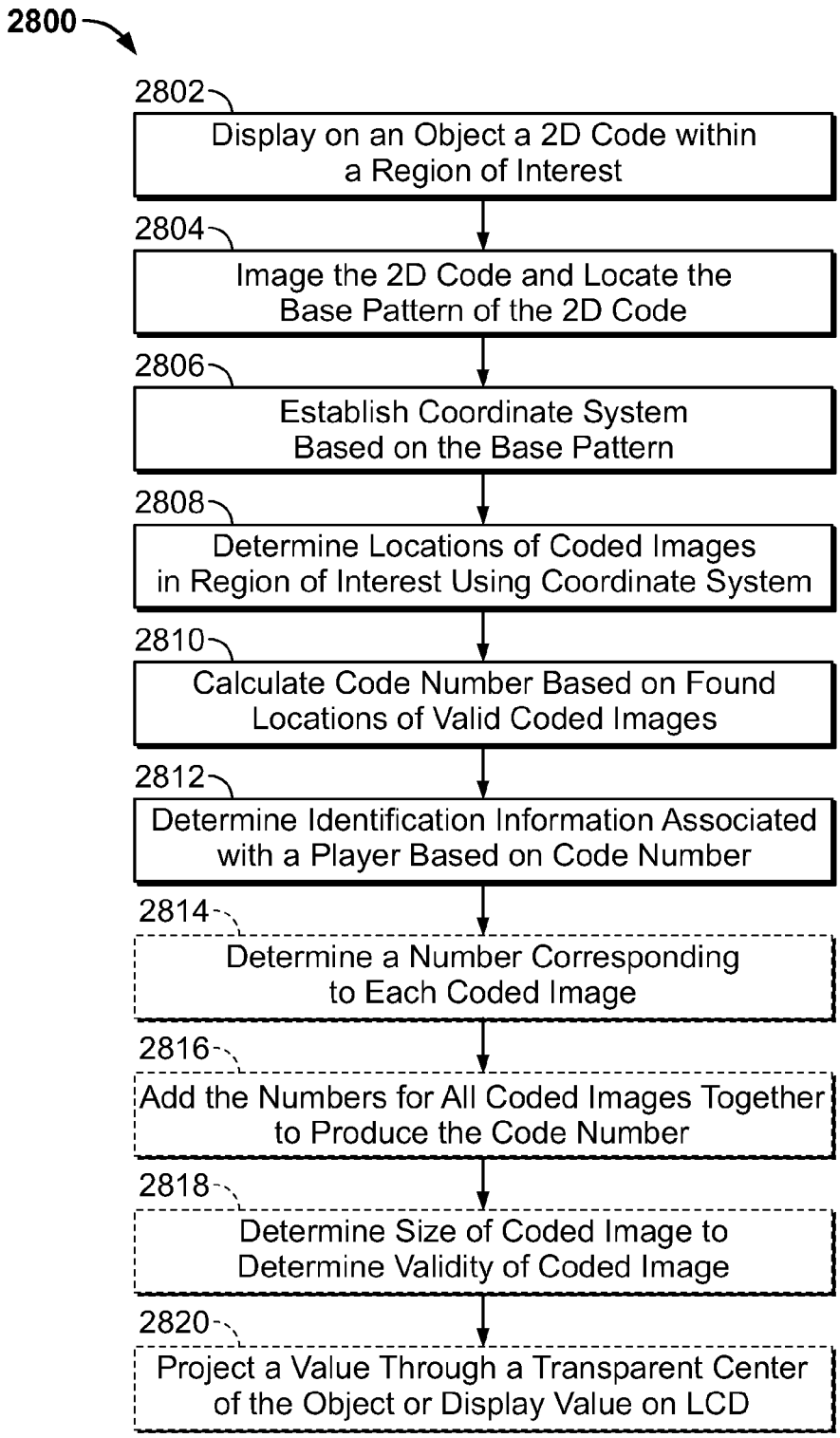
FIG. 28 is a flow chart diagram of an algorithm for identifying a player by imaging and decoding a 2D code that encodes player identification information.

FIG. 28 is a flow chart of an algorithm 2800 for identifying a player of a wagering game holding an object bearing a 2D code, like the 2D code 1900, 1920. The algorithm 2800 includes for displaying, on an object, a 2D code within a region of interest (2802). The 2D code includes a base pattern and coded images. The 2D code is imaged and the base pattern of the 2D code is located (2804) via a pattern matching technique. A coordinate system is established on a location based on the base pattern (2806). The locations of the coded images are determined within the region of interest based on the coordinate system (2808). A code number based on the determined locations of the coded images is calculated (2810). The algorithm 2800 determines an identity of a player of the wagering game based on the code number (2812).

The algorithm 2800 can optionally further include determining a number corresponding to each coded image (2814). This number can be different for each coded image. These numbers for all of the coded images are added together to produce the code number (2816). A size of the coded image can also be determined to determine whether a coded image is actually a coded image (2818). This prevents dust or other spurious specks on the object from being mistakenly detected as a coded image. A value, such as a wager amount, is projected through a transparent center of the object from below a surface of the display on which the object is placed, or the value is displayed on a video display, such as an electrophoretic display, of the object (2820).

The algorithm 2800 can further include dividing the region of interest into areas and creating a matrix in which each element of the matrix corresponds to a representation of respective ones of the coded images. The coordinate (x,y) position of the elements can correspond to the respective number associated with each coded image.

The algorithm 2800 can authenticate the base pattern via a pattern matching algorithm and reject the base pattern as invalid if the authentication fails. The algorithm 2800 can determine an origin of the coordinate system based upon the located base pattern. From this origin, any point in the region of interest can be defined relative to the coordinate system. Preferably, the base pattern is the only image on the 2D code from which the coordinate system is established and from which an orientation of the object is determined (e.g., when the base pattern has an asymmetric shape).

Figure 29:
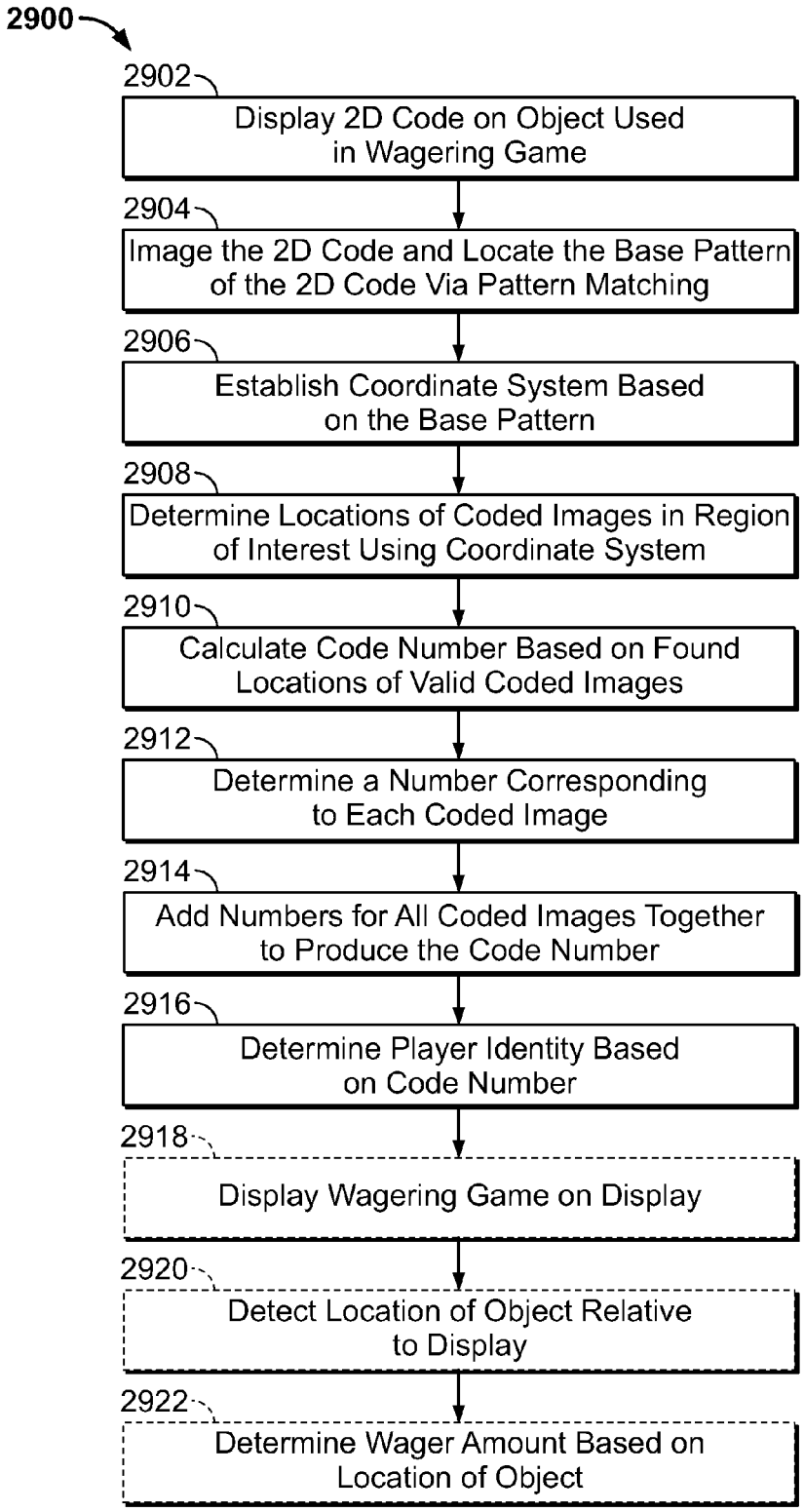
FIG. 29 is a flow chart diagram of an algorithm for identifying a player by imaging and decoding a 2D code that encodes player identification information by determining respective numbers corresponding to each coded image on the 2D code and adding the numbers together.

FIG. 29 is a flow chart diagram of an algorithm 2900 for identifying a player of a wagering game holding an object bearing a 2D code, like the 2D code 1900, 1920. A 2D code is displayed on the object used to interact with a wagering game (2902). The 2D code includes a base pattern and coded images. The base pattern has an asymmetric shape such that any rotational position of the object can be determined from the orientation of the base pattern. The 2D code on the object is imaged and its base pattern is located via pattern matching techniques (2904). The algorithm 2900 establishes a coordinate system based on a location on the base pattern (2906). The x,y locations of the coded images in the region of interest are determined using the coordinate system (2908). A code number based on the found locations of valid coded images is calculated (2910). Invalid coded images that do not meet a size requirement, for example, are ignored. The algorithm 2900 determines a number corresponding to each coded image (2912). The numbers for all of the coded images are added together to produce a code number (2914). The algorithm 2900 determines a player identity based on the code number (2916).

The algorithm 2900 optionally causes a wagering game to be displayed on a display (2918). The algorithm 2900 detects a location of the object relative to the display (2920). The algorithm 2900 determines a wager amount based on the location of the object (2922). Two imaging devices can be used for imaging the 2D code by a first imaging device and another object(s) relating to the wagering game, such as the dice shown in FIGS. 18 and 24B, by a second imaging device.

Figure 30:
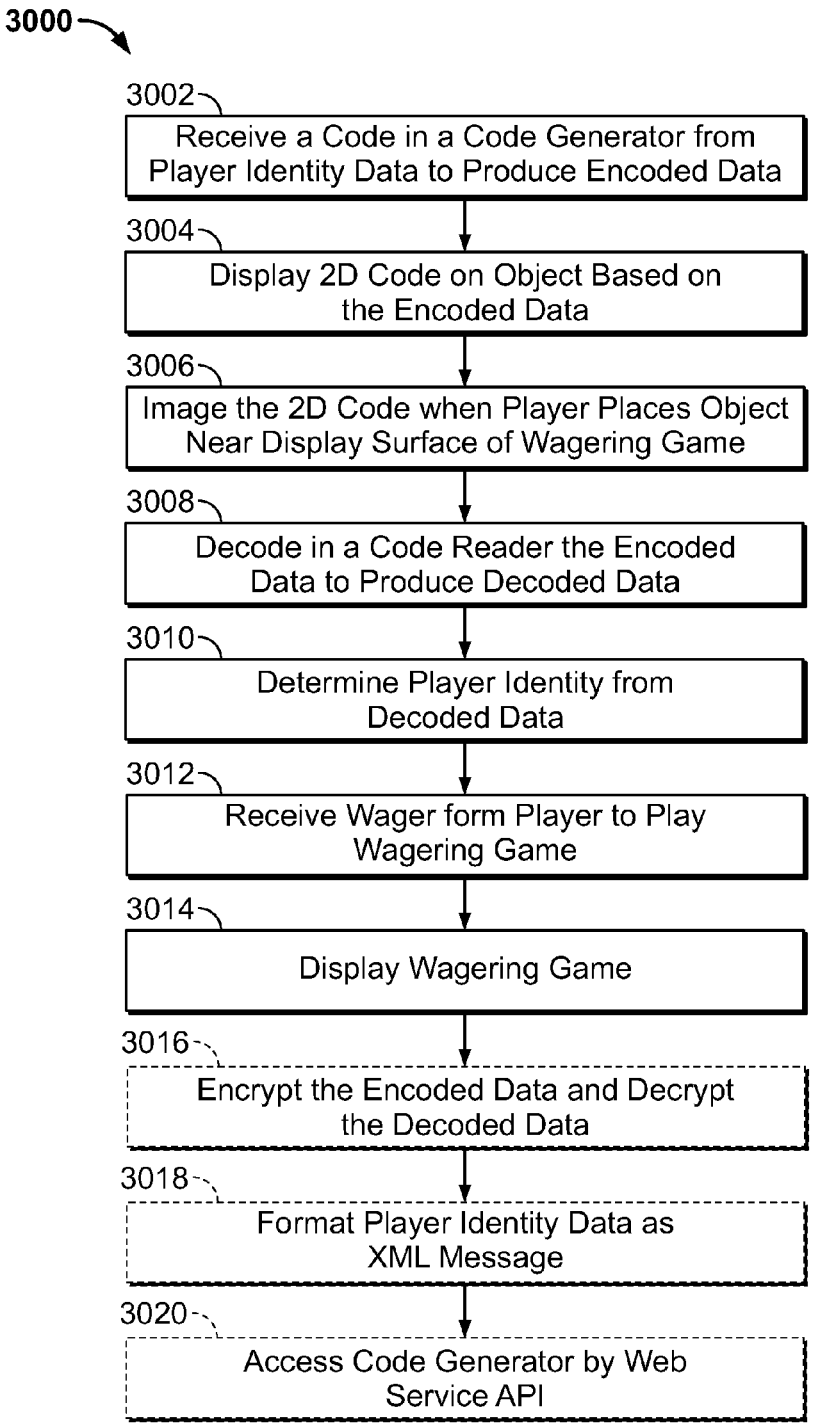
FIG. 30 is a flow chart diagram of an algorithm for receiving a 2D code and decoding the 2D code in a code reader.

FIG. 30 is a flow chart of an algorithm 3000 for encoding identification information associated with a player of a wagering game. The algorithm 3000 generates or receives a code in a code generator from player identity data to produce encoded data (3002). A 2D code, like the 2D code 1900, 1920, is displayed on an object carried by the player based on the encoded data (3004). The 2D code is imaged in response to the player's placing the object in proximity to a display of the wagering game (3006). In response to imaging the 2D code, the encoded data is decoded, in a code reader, to produce decoded data (3008). The algorithm 3000 determines the identification information associated with the player from the decoded data (3010). In response to determining the identification information, a wager is received from the player to play the wagering game (3012), and the wagering game is displayed (3014).

The algorithm 3000 can optionally encrypt the encoded data to produce encrypted data and decrypt the decoded data in response to imaging the 2D code (3016). The data representing the identification information (player identity data) can be formatted as an XML message (3018). The algorithm 3000 can access the code generator by a web service API (3020). The identification information can be an identification code associated with a player account of the player, or a player tracking number associated with the player, or a biometric attribute of the player, or compensation information associated with the player. The compensation information can include an accumulated award level, a complementary award level, or a bonus award level in a wagering game. The identification information can include monetary information associated with the player. The monetary information includes an account balance of a player account of the player.

Figure 31:
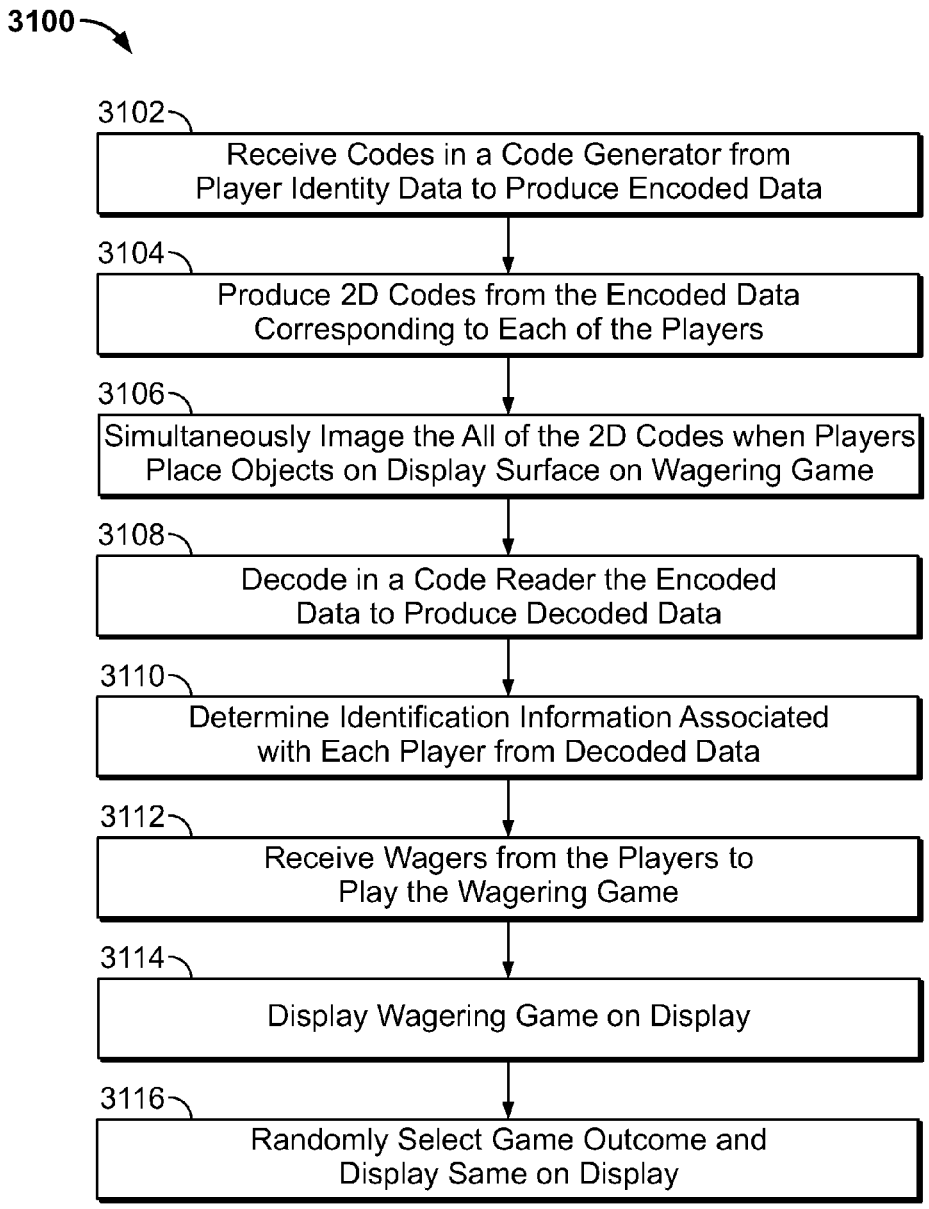
FIG. 31 is a flow chart diagram of an algorithm for identifying multiple players by imaging and determining from decoded 2D codes the respective player identification information encoded therein.

FIG. 31 is a flow chart diagram of an algorithm 3100 for encoding identification information associated with multiple players of a wagering game. The algorithm 3100 receives or generates, in a code generator, codes from respective data representing the identification information of each of the players (3102). The code generator produces encoded data (3102). Based on the encoded data, the algorithm 3100 produces corresponding 2D codes (3104). The 2D codes are simultaneously imaged by an imaging device in response to the players' placing objects each bearing a distinct 2D code in proximity to a display of the wagering game (3106). The algorithm 3100 decodes, in a code reader, the encoded data representing respective ones of the 2D codes (3108). The code reader produces corresponding decoded data (3108). The algorithm 3100 determines identification information for each player from the corresponding decoded data (3110). In response to determining the identification information, wagers from each of the players are received to play the wagering game (3112), which is displayed on a display (3114). A game outcome is randomly selected from among possible outcomes, and the game outcome is displayed on the display (3116)

Figure 32:
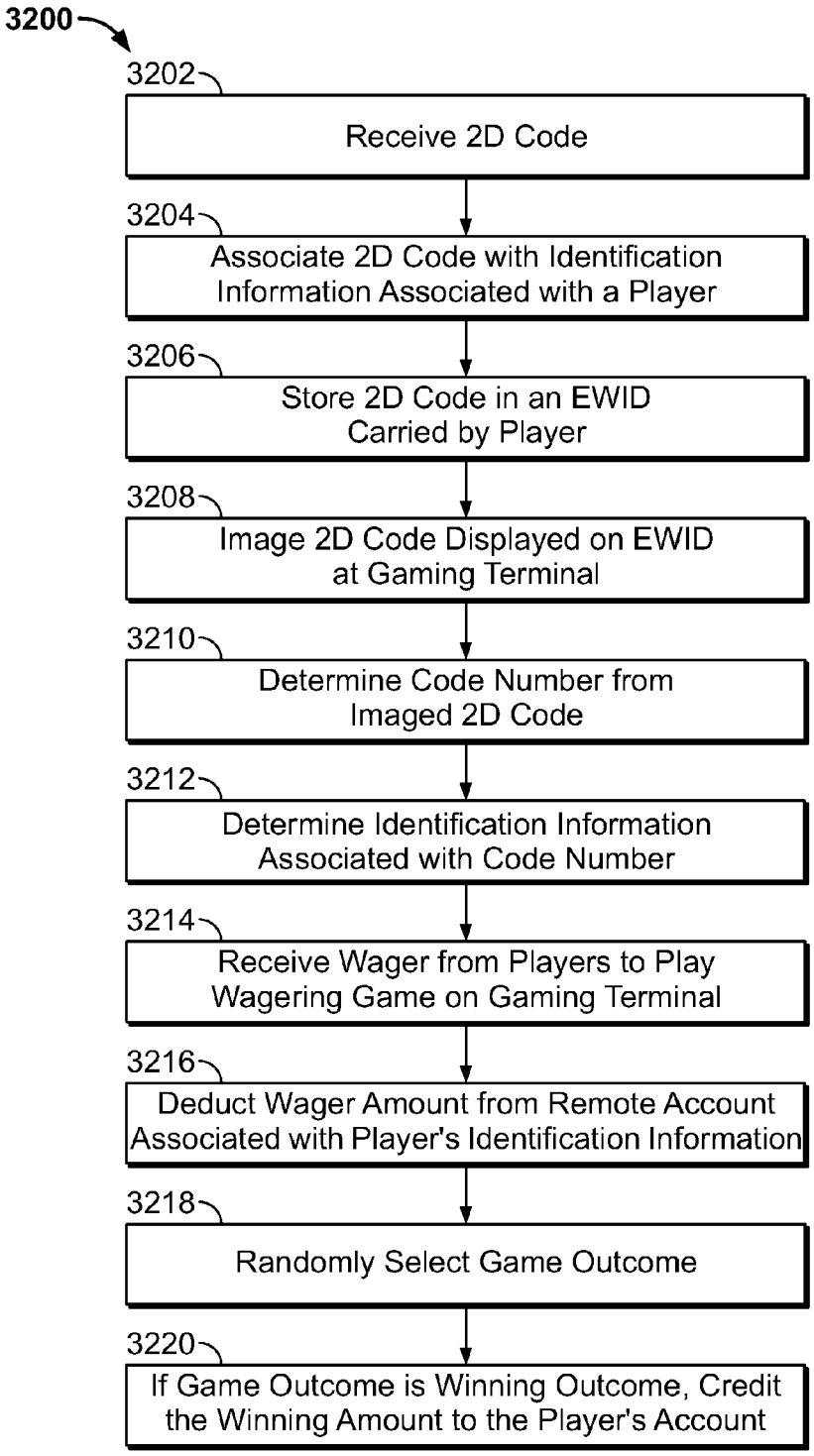
FIG. 32 is a flow chart diagram of an algorithm for determining player identification information from a 2D code on an EWID carried by the player and deducting and crediting amounts in a remote player account.

FIG. 32 is a flow chart diagram of an account-based wagering algorithm 3200. The algorithm 3200 receives or generates a 2D code (3202), like the 2D code 1900, 1920, and associates the 2D code with identification information associated with a player of a wagering game (3204). The 2D code is stored in an EWID, such as the EWID 324, 824, 1024 carried by the player (3206). The 2D code is contained within an area of interest on the EWID, and includes a base pattern and coded images. The 2D code displayed by the EWID is imaged at a gaming terminal (3208). The algorithm 3200 determines a code number from the imaged 2D code (3210) and the identification information associated with the code number (3212). A wager is received from the player to play the wagering game displayed via the gaming terminal (3214) by optionally detecting the presence of the EWID or a body part placed in proximity to a predetermined area on a display of the gaming terminal. An amount corresponding to the wager is deducted from an account that is stored remotely from the gaming terminal (3216). The account is associated with the identification information determined from the EWID. A game outcome is randomly selected from among possible outcomes (3218), and, if the game outcome is a winning outcome, an amount corresponding to the winning outcome is credited to the remote account (3220).

The algorithm 3200 can further include locating the base pattern from the imaged 2D code and establishing a coordinate system based on a location of the located base pattern. The algorithm 3200 determines respective locations of the coded images within the region of interest based on the coordinate system. The algorithm 3200 calculates the code number based on the determined locations of the coded images.

Figure 33:
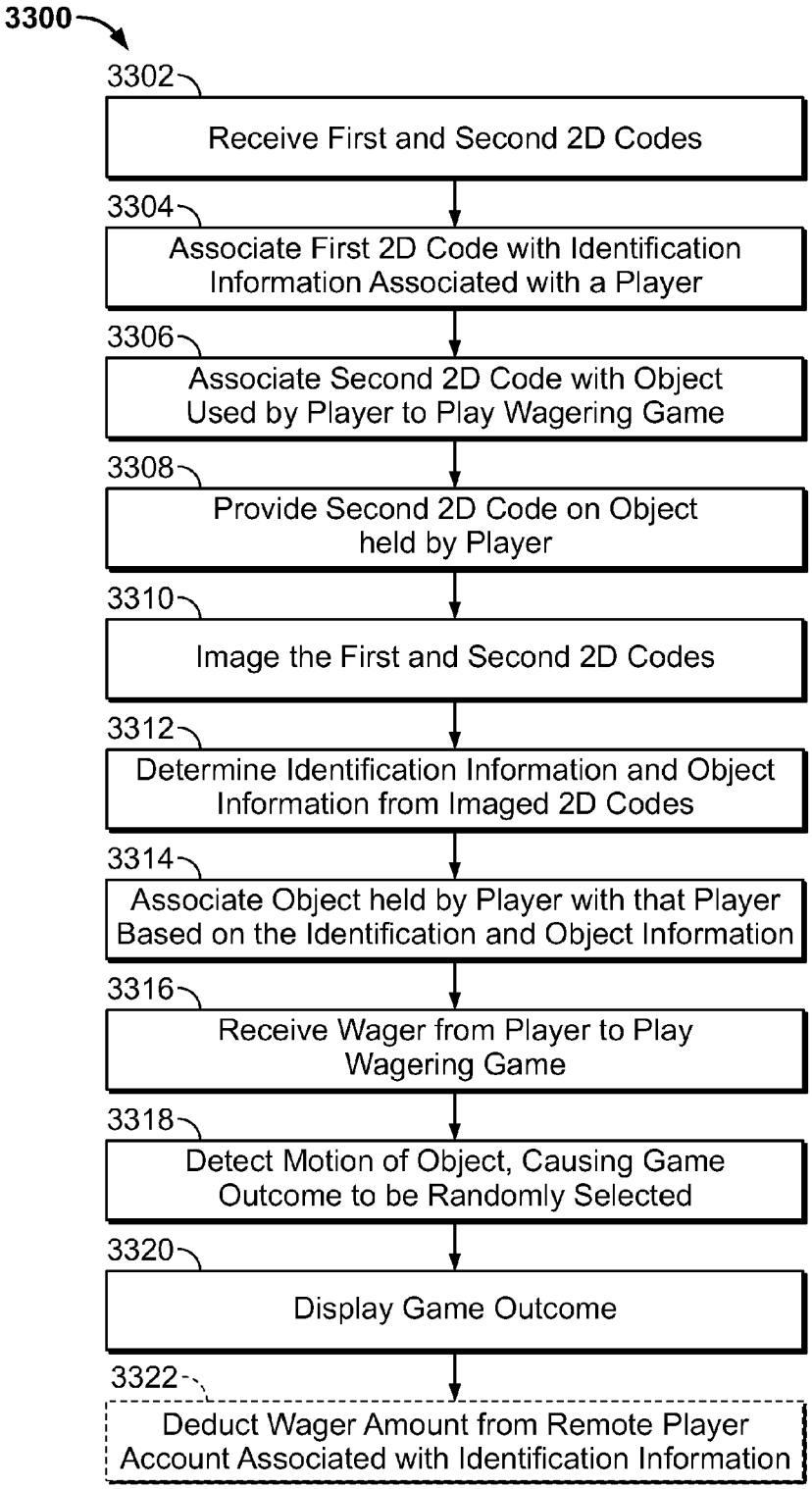
FIG. 33 is a flow chart diagram of an algorithm for associating a wagering-game object held by the player and a 2D code encoding player identification information such that the wagering game knows which player is holding which wagering-game object.

FIG. 33 is a flow chart diagram of an account-based wagering algorithm 3300. The algorithm 3300 receives or generates a first 2D code and a second 2D code (3302). The first and second 2D codes can be like the 2D code 1900, 1920. The 2D codes are contained within an area of interest on the EWID and include a base pattern and coded images. The algorithm 3300 associates the first 2D code with identification information associated with a player (3304) and the second 2D code with object identification information associated with a wagering-game object used to play a wagering game and related to a theme of the wagering game (3306). The second 2D code is provided (e.g., placed or displayed thereon) on the wagering-game object held by the player (3308). The first and second 2D codes are imaged by an imaging device (3310). The algorithm 3300 determines the identification information from the first imaged 2D code and the object identification information from the second imaged 2D code (3312). The algorithm 3300 associates the object with the player based on the identification information and the object identification information (3314). The algorithm 3300 detects a motion of the object, the motion being related to the theme of the wagering game (3318). In response to detecting the motion, the algorithm 3300 causes a game outcome to be randomly selected from among possible outcomes (3318), and the game outcome is displayed (3320).

The algorithm 3300 can optionally further include deducting an amount corresponding to the wager from an account associated with the identification information determined from the EWID and that is stored remotely from the gaming terminal (3322). In response to the game outcome being a winning outcome, the algorithm 3300 can credit an amount corresponding to the winning outcome to the remote account.

Figures 34A, 34B:
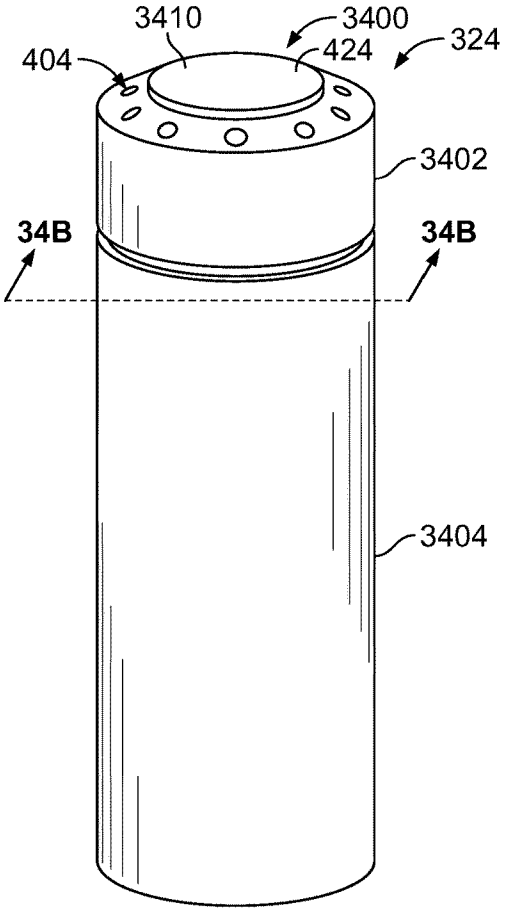
FIG. 34A is a side view of an electronic wager input device featuring a rotatable dial.
FIG. 34B is a top view of a base of the EWID shown in FIG. 34A.

FIG. 34A is a perspective view of an EWID 3400, which includes any or all of the components and features of the EWID 324, having a spring-loaded rotating dial 3402 that can be twisted in one direction or another to increase or decrease an amount of a wager to be placed on a wagering game of any of the gaming systems or gaming machines or terminals disclosed herein. The EWID 3400 includes a cylindrical base 3404 relative to which the dial 3402 can be rotated, and the dial 3402 rotates about a pin 3428 that extends into a central cavity of the base 3404. A disc 3430 separates the dial 3402 from the base 3404 and permits the dial 3402 to be rotated freely relative to the base 3404 and conceals the interior cavity of the base 3404 from view. The dial 3402 includes lights 404, such as light-emitting diodes, arranged about a circumference of a top surface of the dial 3402. In the center of the top surface of the dial 3402, a button 3410 corresponding to the switch 424 is disposed for confirming a wager amount indicated responsive to turning the dial 3402 one direction or another. Any of the EWIDs shown and described in connection with FIGS. 34A-40D can include a button like the button 3410 shown in FIG. 34A. The button 3410 can resemble a pointing stick or a joystick with 360 degrees of freedom of movement in any direction.

Figure 35A:
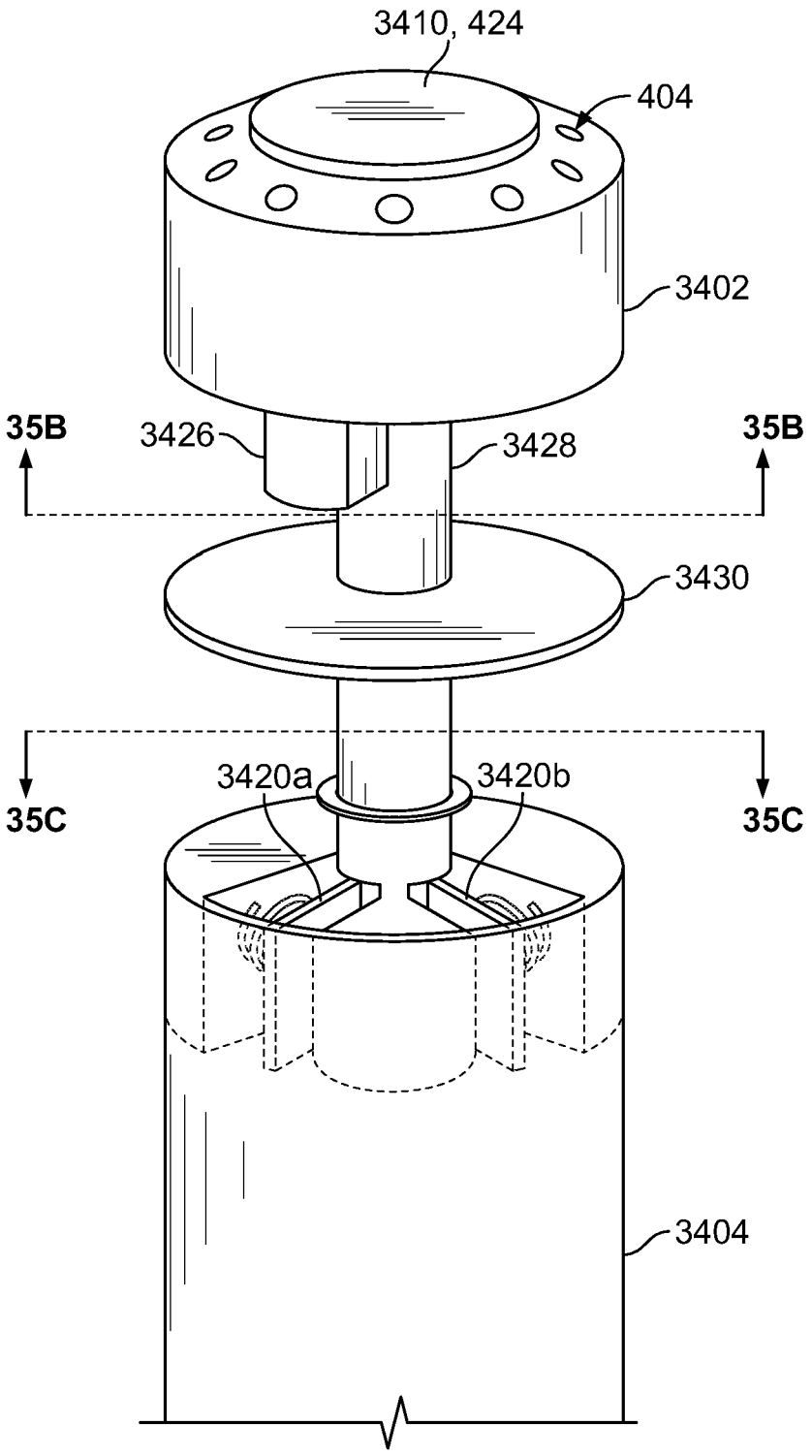
FIG. 35A is a partially exploded perspective view of the EWID shown in FIG. 34A.

When the dial 3402 is not being rotated, it rests in a starting position, shown in FIG. 34B. As the dial 3402 is rotated, a protruding member 3426, shown in FIG. 35A, that protrudes in a downward direction and extends below the dial 3402 as shown in FIGS. 34B and 35A. FIG. 35A is a partially exploded view of the EWID 3400. In the base 3404, a pair of springs 3422*a*, 3422*b* are arranged so that they are angled toward one another in the base 3404. One end of the springs 3422*a,b* is fixed to the base 3404, and the other end is coupled to a pressure sensor or transducer 3424*a,b*. As the dial 3402 is rotated in one direction or another, one of the springs 3422*a,b* is forced into compression against a corresponding flat member 3420*a,b*, which is shown in FIG. 34B, which applies a pressure to the pressure sensors 3424*a,b*. The uncompressed length of the spring determines the maximum angle of rotation, which can be decreased by the protruding member 3426. The pressure sensors 3424*a,b* measure the amount of force applied to the respective flat members 3420*a,b* and produce a pressure output signal indicative of the amount of pressure sensed by the pressure sensor 3424*a,b* that is received by the controller 400. The controller 400 determines whether this pressure output signal exceeds a predetermined threshold, and when it does, stores in the memory 416 data indicative of a wager increase or decrease, depending upon the direction that the dial 3402 was rotated, or communicates wirelessly such as via the IR transceiver 402 or the RF transceiver 406 to the gaming system data indicative of a wager increase or decrease. The data, for example, can correspond to a first value that indicates a wager increase or a second value that indicates a wager decrease. The gaming system in turn receives the data and increases or decreases the wager by a predetermined amount in response to receiving a confirmation signal from the EWID 3400 as described below.

Figure 35C:
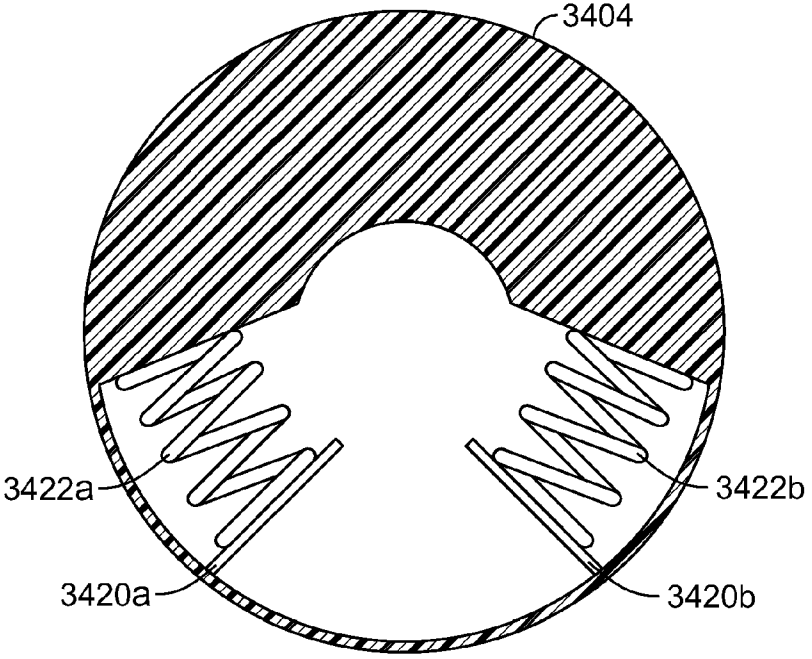
FIG. 35C is a cutaway view of the top of a base of the EWID shown in FIG. 34A.
Figure 35B:
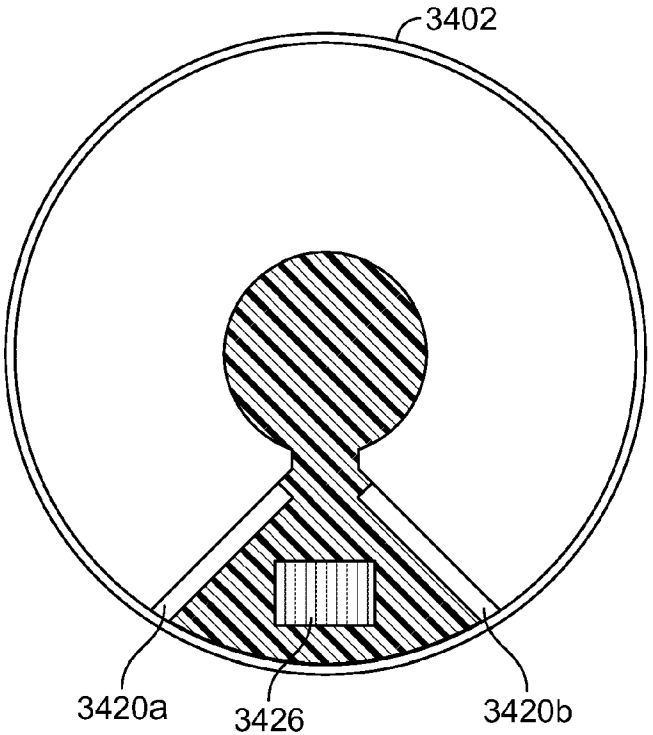
FIG. 35B is a cutaway view of the bottom of the dial of the EWID shown in FIG. 34A.

FIG. 35B is a bottom view of the dial 3402 that includes the flat members 3420*a,b* and the protruding member 3426. FIG. 35C is a top view of the base 3404 showing the springs 3422*a,b* terminating with the pressure sensors 3420*a,b*.

A method of changing and confirming an amount to be wagered using the EWID 3400, 324 is shown FIG. 36. The player twists the dial 3402 in a first direction (such as clockwise) to increase an amount to be wagered or in a second direction that is opposite the first direction (such as counter-clockwise) to decrease an amount to be wagered. The lights 404 can illuminate to indicate the extent that the amount to be wagered is being incremented or decremented. For example, if the minimum wager amount is $1, one clockwise twist of the dial 3402 will cause one of the lights 404 to illuminate to indicate that an amount to be wagered of $1 has been recorded by the EWID 3400. Another clockwise twist of the dial 3402 increases the amount to be wagered to $2, causing a second of the lights 404 to illuminate. Alternately, the player can twist and hold the dial 3402 in its clockwise-most position or counter-clockwise-most position, and as the player holds the dial 3402 in that position, the amount to be wager is incrementally increased or decreased, as the case may be, until the player releases the dial 3402 back to its default or initial position. As the amount to be wagered is increased or decreased, a corresponding number of lights can be successively illuminated or de-illuminated. Alternately, a different color of lights can indicate whether an amount to be wagered is being increased or decreased. For example, a red-colored light 404 can indicate that a wager amount has been decreased. A green-colored light 404 can indicate that a wager amount has been increased.

Figures 36A, 36B, 36C:
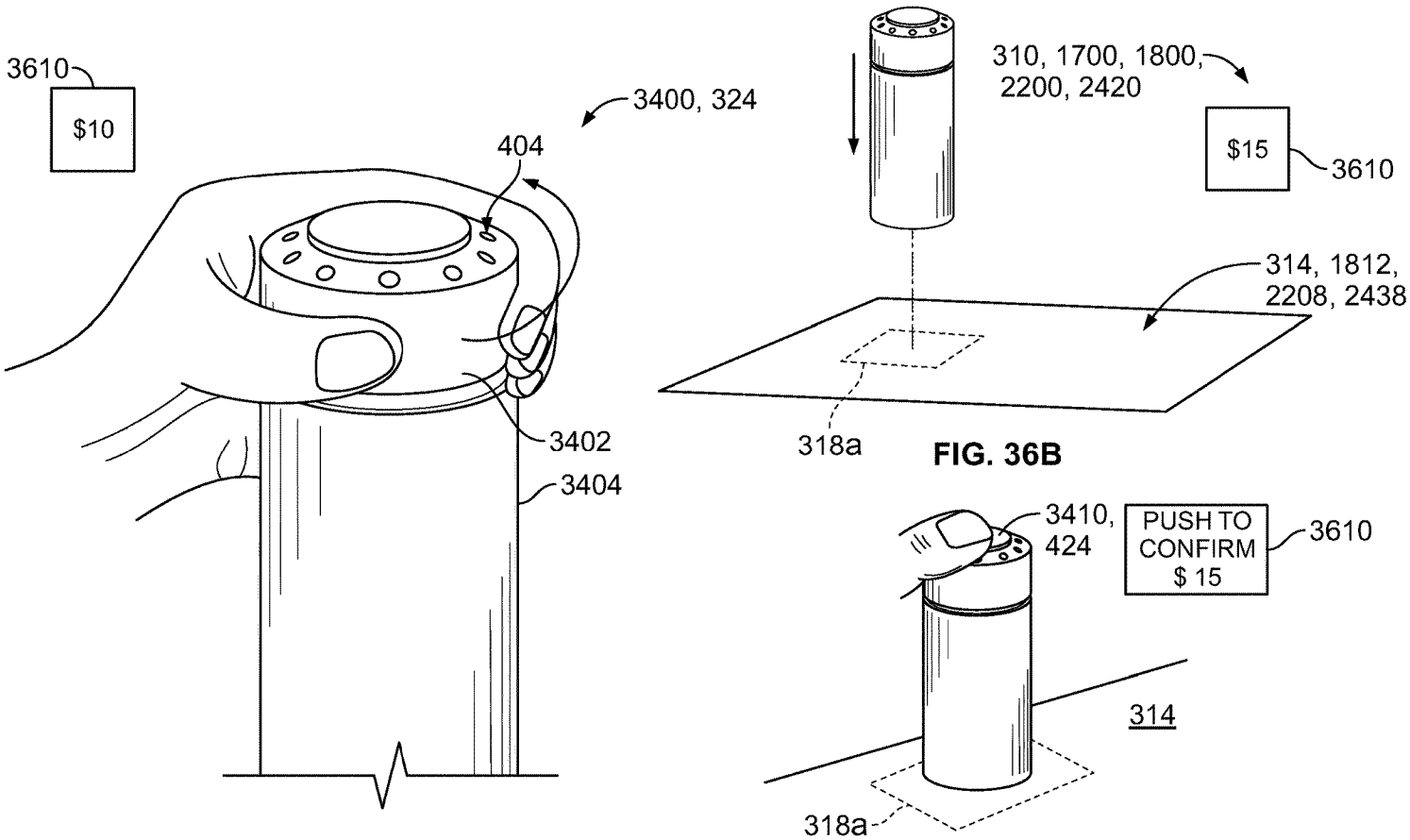
FIGS. 36A-36C show a sequence by which a player can change an amount to be wagered and confirm the wager amount using an EWID such as the one shown in FIG. 34A.

In FIG. 36B, once the player has set the amount to be wagered via the EWID 3400 by rotating the dial 3402 to the desired amount, the player places the EWID proximate a designated area on the surface of any of the displays 314, 1812, 2208, 2438 discussed above. A graphic 3610 indicating the amount to be wagered can be displayed on any of the displays 314, 1812, 2208, 2438 or on a separate video display (not shown). In the graphic 3610 shown in FIG. 36A, an amount of $10 to be wagered is displayed. In this example, the player has chosen to increase the amount to be wagered by $5 to $15, and the revised amount to be wagered is displayed as the graphic 3610 in FIG. 36B. To confirm the amount to be wagered (here $15), the player presses the button 3410, 424 on the top of the dial 3420, which causes a signal to be communicated to the gaming system 310, 1700, 1800, 2200, 2420 indicating that a wager has been placed. The wager amount can also be communicated to the gaming system, or it can already be stored in a memory coupled to the gaming system and correspondingly debited from the player's account as described above.

Figure 37A:
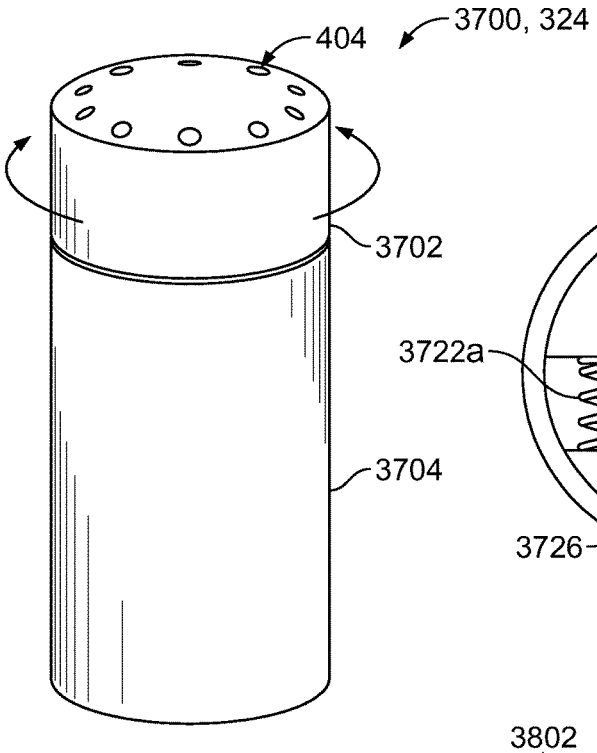
FIG. 37A is a side perspective view of an electronic wager input device having a rotatable dial.
Figure 37B:
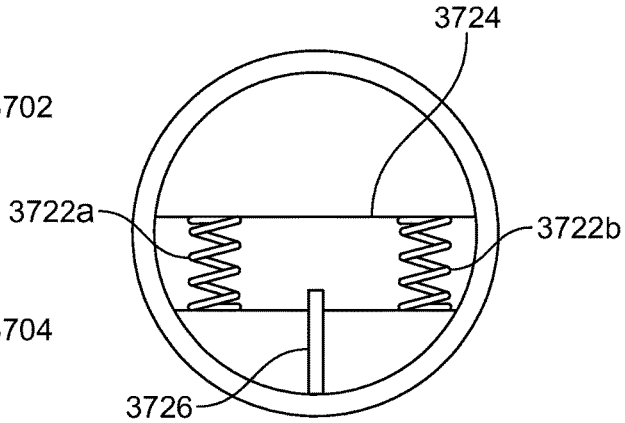
FIG. 37B is a bottom view of a dial of the EWID shown in FIG. 37A.

FIGS. 37A and 37B illustrate another EWID 3700, 324 having a dial 3702 and a base 3704. The dial 3702 includes lights 404 disposed about a periphery of a top surface of the dial 3702. The dial 3702 includes a pair of springs 3722*a,b* fixedly arranged in an interior of the dial 3702 to a pressure sensor 3724 that produces a signal indicative of the amount of force applied thereto by the springs 3722*a,b*. As the player turns the dial 3702, one of the springs 3722*a,b* compresses, increasing the force applied to the pressure sensor 3724. A stopper 3726 limits the maximum angle of rotation of the dial 3702. In this example, the player can slowly turn the dial 3702 to slowly increment an amount to be wagered, but when the player 3702 rotates the dial 3702 to its maximum clockwise or counter-clockwise position, a maximum or minimum amount to be wagered is made. The signal output of the pressure sensor 3724 varies in proportion to the amount of force applied thereto by the springs 3722*a,b*.

Figure 38:
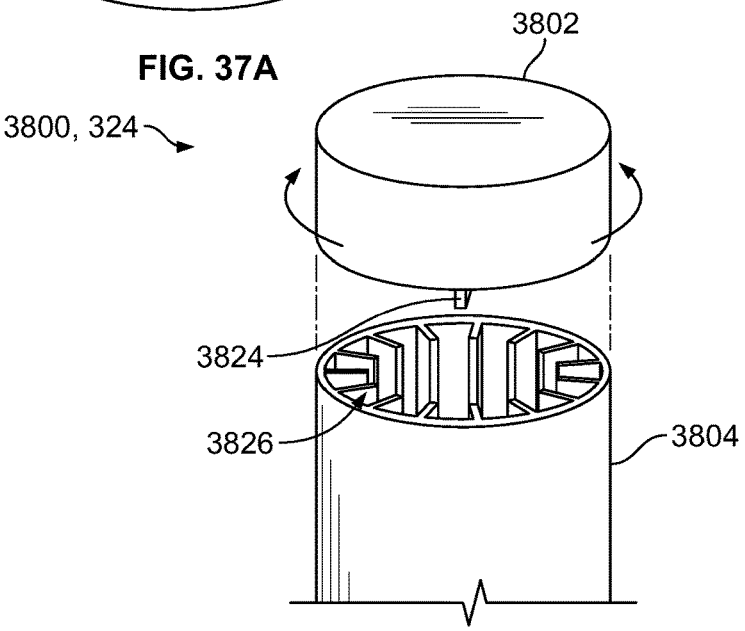
FIG. 38 is a side perspective view of an electronic wager input device having a rotatable dial featuring a protruding member that engages a plurality of teeth formed along an interior cavity of a base of the EWID.

In FIG. 38, an EWID 3800, which is based on the EWID 324, includes a rotatable dial 3802 and a base 3804. The dial 3802 includes an activator member 3824 that projects downward into the base 3804 and extends below the dial 3802. The activator member 3824 engages sequential ones of a plurality of vertical teeth or tabs 3826, formed along the periphery of an interior of the base 3804 as shown in FIG. 38. As the dial 3802 rotates, the activator member 3824 is bent by each of the vertical teeth 3826 and produces an output signal indicating that the activator member 3824 has been engaged and optionally indicating how far the activator member 3824 has been moved. The sequence and optionally speed that the output signals are received, such as by the controller 400 of the EWID 3800, is used by the EWID 3800 to determine whether to increase or decrease an amount to be wagered and by how much. The dial 3802 can be rotated in either directly indefinitely, and as it is rotated, tactile feedback is produced and conducted to the player's hand. With each "click" as the activator member 3824 passes each of the vertical teeth 3826, the amount to be wagered can be incremented or decremented by a predetermined amount. The controller 400 can also determine the speed at which the dial 3802 is rotated, thereby increasing or decreasing the amount to be wagered at a rate commensurate with the rotation speed. It should be noted that the EWIDs 3700, 3800 can be used to place and confirm wagers in the same manner as described in connection with FIGS. 36A-36C.

Figure 39A:
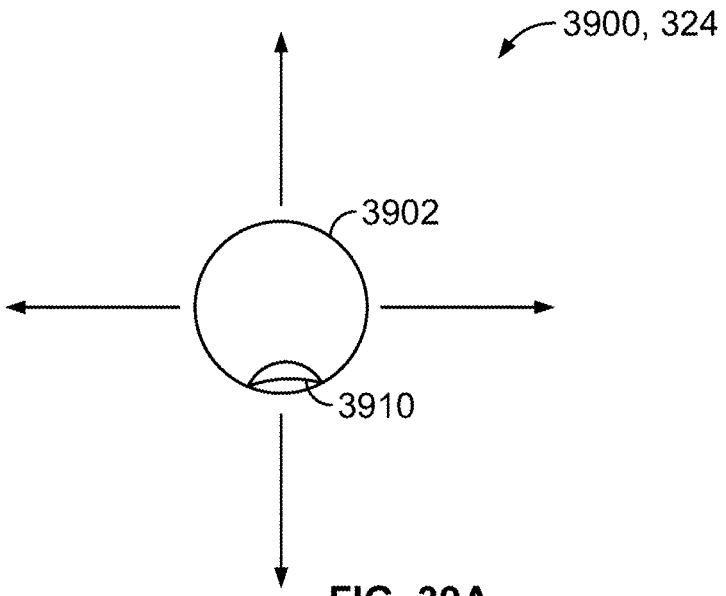
FIG. 39A is a top view of an electronic wager input device featuring a thumb slot along with four possible tilting directions of the EWID.
Figure 39B:
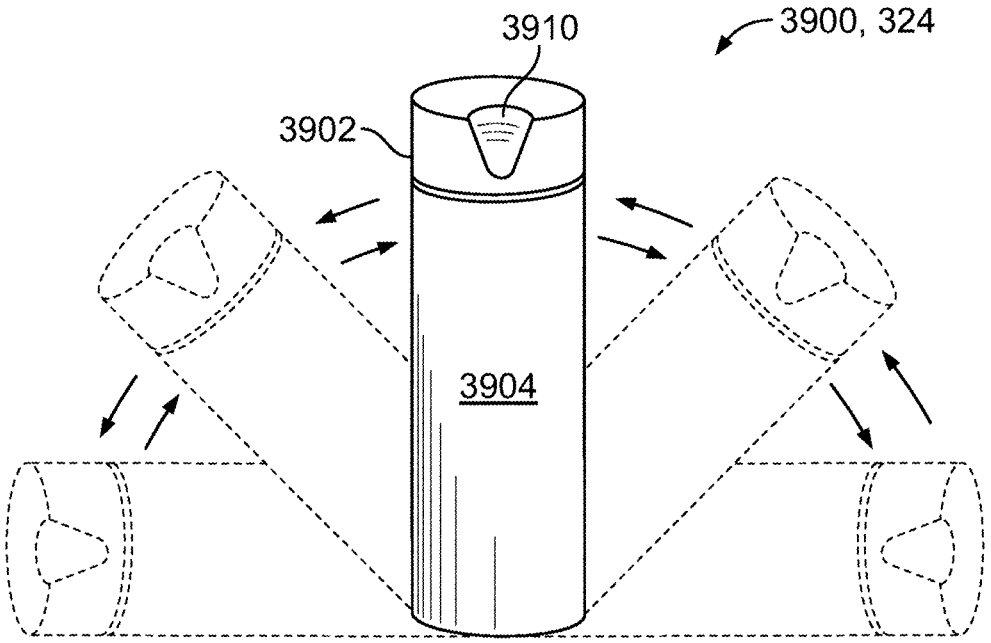
FIG. 39B is a side perspective view of the EWID shown in FIG. 39A with phantom lines showing two possible tilt directions.

FIGS. 39A-39B are illustrations of another way of incrementing or decrementing an amount to be wagered by tilting an EWID 3900, 324 in one of a plurality of directions. As shown in FIG. 39A, the EWID 3900 can be tilted away from a vertical direction relative to earth toward the player, away from the player, or to the left or to the right of the player. A thumb groove 3910 can be formed in a top member 3910 of the EWID 3900 for the player to insert a thumb therein to direct the EWID 3900 in the desired direction. The top member 3910 can also be a dial like any of those described in connection with FIGS. 35A-38 above. As shown in FIG. 39B, the EWID 3900 can be tilted in a first direction (such as to the right from the perspective of the player) to increase an amount to be wagered or in a second direction (such as to the left) to decrease an amount to be wagered. Tilting the EWID 3900 in directions away from and toward the player can also be associated with increasing or decreasing a denomination of the wager. Tilting the EWID 3900 to a completely horizontal position in one direction can be associated with increasing the amount to be wagered to the maximum amount that can be wagered for the wagering game being wagered on. Alternately, tilting the EWID 3900 in a direction toward the player can confirm the amount to be wagered, in a manner akin to pushing the button 3410 shown in FIG. 34A. The EWID 3900 employs conventional technology for detecting the tilt direction and the extent of the tilt. The EWID 3900 produces an output signal indicative of the tilt direction and the extent of the tilt. The controller 400 interprets the output signal and associates the tilt direction and/or the extent of the tilt with various wagering functions related to a wagering game, such as increasing or decreasing an amount to be wagered, changing a denomination of an amount to be wagered, or confirming an amount to be wagered.

For example, referring to FIG. 36B, the player tilts the EWID 3900 left or right in free space or on the surface of the display 314 to adjust the amount to be wagered. Once the desired amount to be wagered has been selected by the EWID 3900, the player places the EWID 3900 near the designated area 318*a* on the surface of the display 314, and, using the thumb groove 3910, tilts the EWID 3900 forward in a direction away from the player's body to confirm the wager amount. Once the EWID 3900 has been tilted forward, the wager amount is accepted by the gaming system 310, 1700, 1800, 2200, 2420.

Figures 40A, 40B, 40C, 40D:
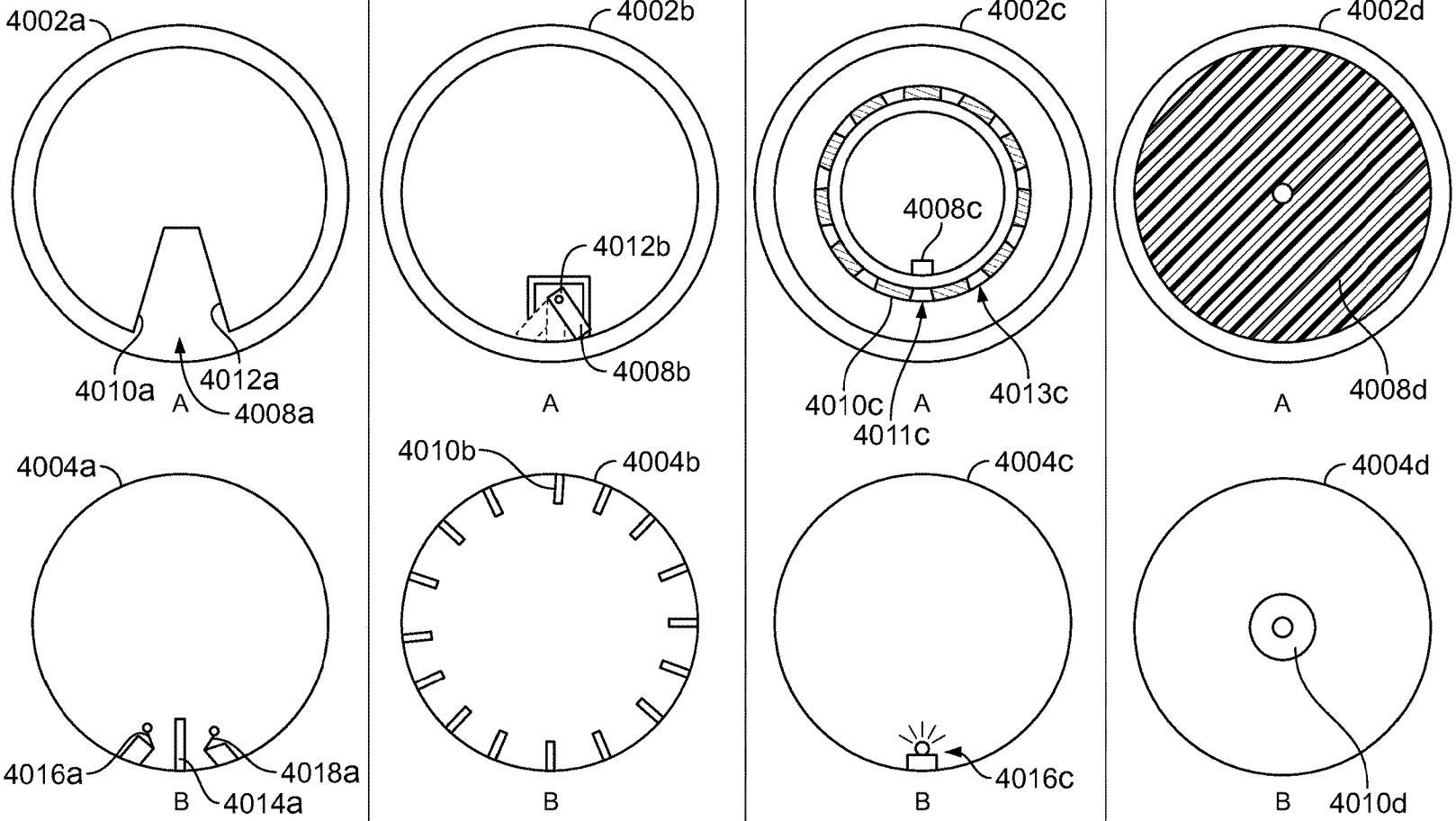
FIG. 40A illustrates views of a dial and a base of an electronic wager input device featuring a pair of switches that are engaged as the dial causes a hinged member to engage one of the switches.
FIG. 40B illustrates views of a dial and a base of an electronic wager input device featuring a pivotable member that engages one of a plurality of teeth.
FIG. 40C illustrates views of a dial and a base of an electronic wager input device featuring a light source and a light sensor arrangement for detecting a dial rotation.
FIG. 40D illustrates views of a dial and a base of an electronic wager input device featuring a potentiometer for determining dial rotation.

FIGS. 40A-40D illustrate other arrangements for converting twists of a dial of an EWID into a wagering function related to a wagering game, such as increasing or decreasing an amount to be wagered, changing a denomination of an amount to be wagered, or confirming an amount to be wagered. These arrangements can be incorporated into any EWID disclosed herein. In FIG. 40A, a dial 4002*a* of the EWID includes a shaped cavity 4008*a* whose end surfaces 4010*a*, 4012*a* engage a movable tab 4014*a* and urge the movable tab 4014*a* as the dial 4002*a* is turned in one direction or another toward respective switches 4016*a*, 4018*a*. As the movable tab 4014*a* is bent toward one of the switches 4016*a*, 4018*a*, the movable tab 4014*a* engages the respective switch 4016*a*, 4018*a*, which completes a circuit that is interpreted by the controller 400 and associated with a wagering function. As the movable tab 4014*a* engages the switch 4016*a*, 4018*a*, tactile feedback is communicated to the player's hand. It should be understood that the shaped cavity 4008*a* can be formed in the base 4004*a* instead and the movable tab 4014*a* together with the switches 4016*a*, 4018*a* can be positioned in the base 4002*a*.

In FIG. 40B, a pivotable switch 4008*b* in a dial 4002*b* of an EWID pivots freely about a pin 4012*b* such that when the pivotable switch 4008*b* is pivoted in one direction, a first output signal is produced that is associated with a first wagering function (e.g., increasing an amount to be wagered), but when the pivotable switch 4008*b* is pivoted in the opposite direction, a second output signal is produced that is associated with a second wagering function (e.g., decreasing an amount to be wagered). As the dial 4002*b* is rotated, the pivotable switch 4008*b* engages and disengages corresponding tabs 4010*b* formed along an inner wall of a base 4004*b* as shown in FIG. 40B. The tabs 4010*b* cause the pivotable switch 4008*b* to swing in one direction or another, depending upon the direction that the dial 4002*b* is rotated, each time completing a circuit via the pivotable switch 4008*b* that causes an associated wagering function to be carried out (e.g., increasing or decreasing an amount to be wagered, changing a denomination of an amount to be wagered, or confirming an amount to be wagered as a wager amount). It should be understood that instead of positioning the pivotable switch 4008*b* in the dial 4002*b*, it can be positioned in the base 4004*b*, and the tabs 4010*b* can be positioned in the dial 4002*b*.

In FIG. 40C, a light source 4016*c* is positioned along an inner wall of a base 4004*c* of an EWID. Light (e.g., visible or laser) emitted by the light source 4016*c* is received within one of a plurality of slots 4011*c*, 4013*c* spaced along a periphery of a cylinder 4010*c*. A light sensor 4008*c* is positioned within the cylinder 4010*c* to receive the light emitted by the light source 4016*c* when it passes through one of the slots 4011*c*, 4013*c*. The output signal from the light sensor 4008*c* is received by the controller 400 and associated with a wagering function. To determine the direction that the dial 4002*c* is rotated, any of the other techniques described herein can be employed. As stated above, the light source 4016*c* can be positioned in the dial 4002*c* instead with the light sensor 4008*c* and the cylinder 4010*c* positioned in the base 4004*c*.

In FIG. 40D, a potentiometer 4008*d* in a dial 4002*d* of an EWID is electrically coupled to a conductive element 4010*d* in a base 4004*d* of the EWID. As the dial 4002*d* is rotated, the circuit created by the potentiometer 4008*d* and the conductive element 4010*d* produces a varying voltage output that is received by the controller 400 and associated with a wagering function. For example, an increasing voltage output can be associated with increasing an amount to be wagered. A decreasing voltage output can be associated with decreasing an amount to be wagered. The potentiometer arrangement shown in FIG. 40D can be combined with the light sensor arrangement shown in FIG. 40C to allow the direction of the dial 4002*d* rotation to be determined. The potentiometer 4008*d* can be positioned in the base 4004*d* instead with the conductive element 4010*d* positioned in the dial 4002*d*.

The exemplary aspects provided above are not meant to be limited to the particular scenario, implementation, illustration, algorithm, or embodiment ("aspects") discussed in connection with a specific exemplary aspect. This disclosure expressly contemplates that the structural and functional aspects as well as their respective advantages associated with any scenario, implementation, illustration, algorithm, embodiment, or example disclosed herein can apply equally to any other scenario, implementation, illustration, algorithm, embodiment, or example. Any discussion of how these devices and their associated gaming systems can be used, are implemented, or are constructed are equally applicable to other scenarios, implementations, illustrations, algorithms, embodiments, or examples described herein.

Without intending to limit the numerous ways that aspects herein can be combined with other aspects or modified to incorporate or include other aspects, the following are just a few examples. For example, the descriptions and illustrations of the EWID and associated gaming systems are equally applicable to the descriptions of the E-wallet, the object bearing the 2D code and their associated gaming systems, and vice versa. The 2D code 1900, 1920 can be displayed on, by, or through the EWID 324, 824, 1024. The form factors of the various EWIDs 324, 824, 1024 and of the objects bearing the 2D codes 1900, 1920 are interchangeable. The gaming system 310 is equally applicable to any other of the gaming systems 1700, 1800, 2200, 2310, 2420, 2510, 2630. Instead of using the 2D codes 1900, 1920, any conventional 2D code can be used instead, such as the matrix code developed by Denso-Wave known as QR ("Quick Response") code. The imaging devices 1726, 1826, 2430, 2428, 2624 can be infrared cameras capable of detecting transmitted or reflected infrared light. In such cases, the coded images and the base pattern on the 2D code are coated with an infrared coating or are displayed by an infrared display. Any of the gaming systems 1700, 1800, 2200, 2310, 2420, 2510, 2630 can include a rear-projection system in which a projector is positioned below a display surface and projects video images of a wagering game onto a light diffuser substrate, or a top-mounted projection system in which a projector is positioned above the display surface and projects video images of a wagering game down onto a light diffuser substrate.

Any E-wallet, EWID, object carried by the player, or other handheld electronic device disclosed herein can include a camera for imaging a 2D code displayed by a gaming terminal, thereby establishing a simplex optical communication between the handheld electronic device and the gaming terminal. The 2D codes can represent or encode, for example, different wagering games, player preferences, awards, an advertisement to play a wagering game, casino preferences, gaming machine preferences, and the like, which can be stored in the handheld electronic device for later retrieval. These codes can be displayed by the gaming terminal.

Any of the software, algorithms, or methods described herein can include machine readable instructions for execution by: (a) a processor, (b) a controller, and/or (c) any other suitable processing device. It will be readily understood that the devices 10, 110, 34, 310, 334, 400, 1000, 1024, 1100, or 1110 can include such a suitable processing device. Any algorithm, software, or method disclosed herein can be embodied in software stored on a tangible medium such as, for example, a flash memory, a CD-ROM, a floppy disk, a hard drive, a digital versatile disk (DVD), or other memory devices, but persons of ordinary skill in the art will readily appreciate that the entire algorithm and/or parts thereof could alternatively be executed by a device other than a controller and/or embodied in firmware or dedicated hardware in a well known manner (e.g., it may be implemented by an application specific integrated circuit (ASIC), a programmable logic device (PLD), a field programmable logic device (FPLD), discrete logic, etc.). Also, some or all of the machine readable instructions represented in any flowchart depicted herein may be implemented manually. Further, although specific algorithms are described with reference to flowcharts depicted herein, persons of ordinary skill in the art will readily appreciate that many other methods of implementing the example machine readable instructions may alternatively be used. For example, the order of execution of the blocks may be changed, and/or some of the blocks described may be changed, eliminated, or combined.

Each of these embodiments and obvious variations thereof is contemplated as falling within the spirit and scope of the claimed invention, which is set forth in the following claims.

What is claimed is:

1. A gaming system comprising:

a table having a table surface configured to display a wagering game to a plurality of players;

an interface; and a gaming controller configured to:

communicate with a plurality of input devices through the interface;

detect unique codes associated with respective ones of the plurality of input devices; and receive commands from respective ones of the plurality of input devices, the unique codes determining from which of the plurality of input devices the commands are received.

2. The gaming system of claim 1, wherein the unique codes include unique visual indicia borne by respective ones of the plurality of input devices.

3. The gaming system of claim 1, wherein the table surface includes a video display configured to display the wagering game.

4. The gaming system of claim 1, wherein the commands include a wager amount.

5. The gaming system of claim 4, wherein the gaming controller is further configured to draw the wager amount from a credit meter or player account of the player using the input device from which the command was received.

6. The gaming system of 5, wherein the input device is associated with the player account.

7. The gaming system of claim 1, wherein at least one of the input devices is a mobile phone.

8. The gaming system of claim 1, wherein the gaming controller is further configured to receive the unique codes wirelessly from the input devices.

9. A gaming system comprising:

a table having a table surface configured to display a wagering game to a plurality of players;

an interface; and a gaming controller configured to:

communicate wirelessly with a plurality of input devices through the interface;

wirelessly detect unique codes associated with respective ones of the plurality of input devices; and receive commands from respective ones of the plurality of input devices, the unique codes determining from which of the plurality of input devices the commands are received.

10. The gaming system of claim 9, wherein the unique codes include unique visual indicia borne by respective ones of the plurality of input devices.

11. The gaming system of claim 9, wherein at least one of the input devices is a mobile phone.

12. The gaming system of claim 9, wherein a first of the commands relates to a wagering game purpose, and a second of the commands relates to a non-wagering game purpose.

13. The gaming system of claim 9, wherein the table surface includes a video display configured to display the wagering game, or the table surface includes a substrate through which a video display arranged under the substrate is visible.

14. A computer-implemented method of operating a gaming system, the gaming system including one or more gaming controllers, a table, and an interface, the method comprising:

displaying on the table a wagering game to a plurality of players, the table having a table surface;

communicating with a plurality of input devices through the interface;

detecting unique codes associated with respective ones of the plurality of input devices; and receiving commands from respective ones of the plurality of input devices, the unique codes determining from which of the plurality of input devices the commands are received.

15. The computer-implemented method of claim 14, wherein the unique codes include unique visual indicia borne by respective ones of the plurality of input devices.

16. The computer-implemented method of claim 14, wherein the table surface includes a video display configured to display the wagering game.

17. The computer-implemented method of claim 14, wherein the commands include a wager amount.

18. The computer-implemented method of claim 17, the method further comprising drawing the wager amount from a credit meter or player account of the player using the input device from which the command was received.

19. The computer-implemented method of claim 14, wherein at least one of the input devices is a mobile phone.

20. The computer-implemented method of claim 14, further comprising receiving the unique codes wirelessly from the input devices.

* * * * *